US008442251B2

(12) United States Patent
Jensen et al.

(10) Patent No.: US 8,442,251 B2
(45) Date of Patent: May 14, 2013

(54) ADAPTIVE FEEDBACK CANCELLATION BASED ON INSERTED AND/OR INTRINSIC CHARACTERISTICS AND MATCHED RETRIEVAL

(75) Inventors: Jesper Jensen, Smorum (DK); Thomas Bo Elmedyb, Smorum (DK)

(73) Assignee: Oticon A/S, Smorum (DK)

( * ) Notice: Subject to any disclaimer, the term of this patent is extended or adjusted under 35 U.S.C. 154(b) by 262 days.

(21) Appl. No.: 12/681,265

(22) Filed: Apr. 1, 2010

(65) Prior Publication Data

US 2011/0150257 A1 Jun. 23, 2011
US 2012/0140965 A9 Jun. 7, 2012

Related U.S. Application Data

(63) Continuation-in-part of application No. PCT/EP2009/053920, filed on Apr. 2, 2009.

(60) Provisional application No. 61/245,679, filed on Sep. 25, 2009.

(51) Int. Cl.
*H04R 25/00* (2006.01)

(52) U.S. Cl.
USPC ..... 381/318; 381/312; 381/94.1

(58) Field of Classification Search ..... 381/312, 381/317–318, 93, 94.1, 94.9, 71.11–12
See application file for complete search history.

(56) References Cited

U.S. PATENT DOCUMENTS 6,418,227 B1 7/2002 Kuo
8,116,473 B2 * 2/2012 Salvetti et al. ..... 381/317
8,199,948 B2 * 6/2012 Theverapperuma ..... 381/318
2003/0053647 A1 3/2003 Kates
2007/0172080 A1 7/2007 Janse et al.

FOREIGN PATENT DOCUMENTS

EP 0 415 677 A2 3/1991
EP 0 579 152 1/1994
EP 1 003 154 A2 5/2000
WO WO 01/10170 2/2001

(Continued)

OTHER PUBLICATIONS

Dansk Standard "Coding of moving pictures and associated audio for digital storage media at up to about 1,5 Mbit/s—Part 3:Audio" ISO/IEC 11172-3 (1993).

(Continued)

*Primary Examiner* — Suhan Ni
(74) *Attorney, Agent, or Firm* — Birch, Stewart, Kolash and Birch, LLP

(57) ABSTRACT

An audio processing system processing an input sound to an output sound includes: an input transducer for converting input sound to an electric input signal and defining an input side; an output transducer for converting a processed electric output signal to an output sound and defining an output side; a forward path defined between the input transducer and the output transducer; a signal processing unit for processing an SPU-input signal originating from the electric input signal and to provide a processed SPU-output signal, and an electric feedback loop from the output side to the input side, having a feedback path estimation unit for estimating an acoustic feedback transfer function from the output transducer to the input transducer, and a enhancement unit for estimating noise-like signal components in the electric signal of the forward path and providing a noise signal estimate output.

20 Claims, 22 Drawing Sheets

FOREIGN PATENT DOCUMENTS

| | | | |
|---|---|---|---|
| WO | WO 2007/113282 | A1 | 10/2007 |
| WO | WO 2007/125132 | A2 | 11/2007 |
| WO | WO 2008/151970 | A1 | 12/2008 |

OTHER PUBLICATIONS

Dau et al. "A quantitative model of the "effective" signal processing in the auditory system. I. Model structure", J. Acoust. Soc. Am. 99, pp. 3615-3622 (1996).
Forssell et al., "Closed-loop Identification Revisted" Technical Report, Report No. LiTH-ISY-R-1959, Linkoping University, pp. 1-46 (1997).
Johnson "Estimation of Perceptual Entropy Using Noise Masking Criteria" International Conference on Acoustics, Speech and Signal Processing (ICASSP), pp. 2524-2527 (1988).
Odelius, "Generation of probe signal for feedback cancellation systems" Project Report, LiTH-ISY-Ex-3449 , pp. 1-70 (2003).
Shusina et al., "Feedback Cancellation in Hearing Aids based on indirect Closed-Loop Identification", Proc. 3rd IEEE Benelux Signal Processing Symposium (SPS-2002), Leuven, Belgium, pp. 1-4 (2002).
Shusina et al., "Unbiased Adaptive Feedback Cancellation in Hearing Aids by Closed-Loop Identification", IEEE Transactions on Audio, Speech, and Language Processing, vol. 14, No. 2 (2006).
Van de Par et al., "A new perceptual model for audio coding based on spectro-temporal masking" Audio Engineering Society, pp. 1-14 (2008).
EPO Communication of EP Application No. 10 157 933.2-1224, dated Apr. 29, 2011.

* cited by examiner

ADAPTIVE FEEDBACK CANCELLATION BASED ON INSERTED AND/OR INTRINSIC CHARACTERISTICS AND MATCHED RETRIEVAL

This application is a Continuation-In-Part which claims priority under 35 U.S.C. §120 of Application No. PCT/EP2009/053920, filed on Apr. 2, 2009. This application also claims priority under 35 U.S.C. §119(e) on U.S. Provisional Application No. 61/245,679, filed on Sep. 25, 2009.

TECHNICAL FIELD

The present invention relates to methods of feedback cancellation in audio systems, e.g. listening devices, e.g. hearing aids. The invention relates specifically to an audio processing system, e.g. a listening device or a communication device, for processing an input sound to an output sound. The invention furthermore relates to a method of estimating a feedback transfer function in an audio processing system, e.g. a listening device. The invention further relates to a data processing system and to a computer readable medium.

The invention may e.g. be useful in applications such as public address systems, entertainment systems, hearing aids, head sets, mobile phones, wearable/portable communication devices, etc.

BACKGROUND ART

The following account of the prior art relates to one of the areas of application of the present invention, hearing aids.

It is well-known that in standard adaptive feedback cancellation systems, correlation between the receiver signal and the microphone target signal, the so-called autocorrelation (AC) problem, leads to a biased estimate of the feedback transfer function. This, in turn, leads to cancellation of (parts of) the target signal and/or sub-oscillation/howls due to bias in the estimate of the feedback transfer function. One way to deal with the AC problem is to rely on AC detectors and decrease convergence rate in sub-bands where AC is dominant, see e.g. WO 2007/113282 A1 (Widex). Although this is definitely better than not dealing with the AC problem at all, the disadvantage is that adaptation can be very slow in frequency regions often dominated by AC, e.g. low-frequency regions in speech signals. Another way to deal with the AC problem is to introduce so-called probe noise, where an, ideally inaudible, noise sequence is combined with the receiver signal before play back (being presented to a user). In principle, this well-known class of methods, see e.g. EP 0 415 677 A2 (G N Danavox), completely eliminates the AC problem. However, since in general the probe noise variance must be very small for the noise to be inaudible, the resulting adaptive system becomes very slow. An improvement can be obtained by using masked noise as e.g. described in US 2007/172080 A1 (Philips).

WO 2007/125132 A2 (Phonak) describes a method for cancelling or preventing feedback. The method comprises the steps of estimating an external transfer function of an external feedback path defined by sound travelling from the receiver to the microphone, estimating the input signal having no feedback components of the external feedback path using an auxiliary signal, which does not comprise feedback components of the external feedback path, and using the estimated input signal for estimating the external transfer function of the external feedback path.

Traditional Probe Noise Solution:

Prior art probe noise based solutions of an adaptive feedback cancellation (FBC) system, where, ideally, a perceptually undetectable noise sequence is added to the receiver signal, can in principle completely by-pass the AC-problem. FIG. 1*a* shows an example of an audio processing system, e.g. a listening device, comprising a traditional adaptive system based on probe noise, where the goal is to approximate the unknown, time-varying transfer function F(z,n) (representing leakage feedback from receiver to microphone) by an estimate Fh(z,n), which here is assumed to be an FIR system. A forward path is defined between the microphone and the receiver. The estimate Fh(z,n) may be updated using any of the standard adaptive filtering algorithms such as NLMS, RLS, etc. (cf. Algorithm unit feeding update filter coefficients to variable filter part Fh(z,n) in FIG. 1*a*). The probe noise (generated by Probe signal unit in FIG. 1*a*) is denoted as us(n) and can be generated in a variety of ways (cf. e.g. methods A and B discussed below or any other appropriate method, e.g. by filtering a white noise sequence through an analysis-modification-synthesis filter bank, or through an IIR filter). The probe signal us(n) is connected to the Algorithm part of the adaptive FBC-filter as well as being added to output signal y(n) from the forward gain unit G(z,n) in output SUM unit '+', whose output u(n) is connected to the receiver and to the variable filter part Fh(z,n) of the adaptive FBC-filter. The Algorithm part additionally bases the estimate of filter coefficients of the variable filter part Fh(z,n) of the FBC-filter on the feedback corrected input signal e(n) generated by a subtraction in input SUM unit '+' of the feedback estimate vh(n) of the variable filter part Fh(z,n) of the FBC-filter from the input signal comprising feedback signal v(n) and target signal x(n) as picked up by the microphone. Due to the preferably inaudible nature of the probe noise, such prior art solutions lead to relatively slow adaption rates of the adaptive system.

DISCLOSURE OF INVENTION

The present invention relates in general to methods for feedback cancellation in audio processing systems, e.g. listening devices, e.g. hearing aids. The methods can in principle be used with any Dynamic Feedback Cancellation (DFC) system based on the traditional setup where a model (e.g. a FIR or IIR model) of the feedback channel transfer function is updated using any adaptive filter algorithm, e.g. normalized least mean square (NLMS), recursive least squares (RLS), affine projection type of algorithms, etc., see e.g. [Haykin, 1996] or [Sayed, 2003]. While the presented methods are expected to be used in a sub band based system, the concepts are in principle general and may be used in full band based systems as well. Also warping, e.g. in the form of warped filters, cf. e.g. [Härmä et al., 2000], may be used in combination with other functional elements (e.g. linear filters, such as FIR or IIR filters) of the present invention. In preferred embodiments, some of, such as a majority of, the features of the present invention are implemented as software algorithms adapted for running on a processor of an audio processing system, e.g. a public address system, e.g. a teleconference system, an entertainment system, e.g. a portable device, e.g. a communication device or a listening device. The applications may comprise a single or a multitude of microphones and a single or a multitude of loudspeakers. In general, the present inventive concept can be used in a configuration comprising a forward path comprising a microphone, an amplifier for amplifying the microphone signal and a loudspeaker for outputting the amplified microphone signal, wherein the distance between a microphone and a speaker of the system is such that acoustic feedback from the receiver to the microphone (at least at some time instances) is enabled. The microphone(s) and speaker(s) in question may be located in the same or separate physical units.

In an aspect, the invention relates to the introduction and/or identification of specific characteristic properties in an output signal of the forward path of an audio processing system, e.g. a listening device. A signal comprising the identified or introduced properties is propagated through the feedback path from output to input transducer and extracted or enhanced on the input side in an Enhancement unit matching (in agreement between the involved units) the introduced and/or identified specific characteristic properties. The signals comprising the specific characteristic properties on the input and output sides, respectively, (i.e. before and after having propagated through the feedback path) are used to estimate the feedback path transfer function in a feedback estimation unit.

Enhancement of Characteristics, Noise Retrieval (Noise Enhancement):

The invention relates in particular to the retrieval or enhancement of characteristics (e.g. modulation index, periodicity, correlation time, noise or noise-like parts) of a signal in the forward path of an audio processing system, e.g. a listening device, and to the use of the retrieved or enhanced characteristics in the estimation of acoustic feedback. FIG. 1*b* illustrates the general concept of and the basic functional elements of a method and system using retrieval or enhancement of characteristics of a signal in the forward path, e.g. intrinsic noise-like signals, in the estimation of the feedback path as suggested by the present invention. The embodiment in FIG. 1*b* comprises the same elements as the listening device of FIG. 1*a*, except that the Probe signal generator (in the most general embodiment) is omitted. An Enhancement unit (e.g. a noise retrieval unit) for extracting characteristics (e.g. noise-like parts) of the output signal u(n) is inserted in a first input path to the algorithm part of the adaptive FBC filter. It takes the output signal u(n) as an input and provides as an output an estimate us(n) consisting of components having certain specified characteristics (e.g. components with a certain modulation index, components with a certain correlation time, e.g. noise-like parts, etc.) of the output signal u(n), the estimate being connected to the Algorithm part of the adaptive FBC-filter. The ideal purpose of the Enhancement unit is to ensure that the signal us(n) is uncorrelated with the (target) input signal x(n). This may (ideally) e.g. be achieved by filtering out (retrieving) signal components from the receiver signal u(n), which are uncorrelated with x(n). Alternatively or additionally, the or an Enhancement unit may be located on the input side of the forward path (cf. the Enhancement unit in FIG. 1*b* with a dashed outline). In a preferred embodiment, an additional Enhancement unit is provided on the input side (dashed outline in FIG. 1*b*), which is matched to the Enhancement unit on the output side, in this case to extract the same characteristics from the (here) feedback corrected input signal e(n) that are extracted or estimated from the output signal u(n) by the Enhancement unit on the output side.

An object of the present invention is to provide an alternative scheme for minimizing feedback in audio processing systems, e.g. listening devices.

Objects of the invention are achieved by the invention described in the accompanying claims and as described in the following.

An Audio Processing System, e.g. a Listening Device or a Communication Device:

An object of the invention is achieved by an audio processing system, e.g. a listening device or a communication device for processing an input sound to an output sound. The audio processing system, e.g. a listening device, comprises, an input transducer for converting an input sound to an electric input signal and defining an input side, an output transducer for converting a processed electric output signal to an output sound and defining an output side, a forward path being defined between the input transducer and the output transducer, and comprising a signal processing unit adapted for processing an SPU-input signal originating from the electric input signal and to provide a processed SPU-output signal, and an electric feedback loop from the output side to the input side comprising a feedback path estimation unit for estimating an acoustic feedback transfer function from the output transducer to the input transducer, and an enhancement unit for extracting characteristics of an electric signal of the forward path and providing an estimated characteristics output;

wherein the feedback path estimation unit is adapted to use the estimated characteristics output in the estimation of the acoustic feedback transfer function.

This has the advantage of providing an adaptive feedback cancellation system which is robust in situations with a high degree of correlation between the output signal and the input signal of an audio processing system, such as a listening device.

In an embodiment, the output transducer is a receiver (loudspeaker) for converting an electric input (e.g. said processed electric output signal) to an acoustic output (a sound).

The aim of the enhancement unit is to extract signal components with certain pre-specified characteristics (e.g. inserted modulation characteristics, e.g. an AM-function, noise-like signal components, etc.) in the input signal to the enhancement unit, or in other words to eliminate or reduce signal components (in the input to the feedback path estimation unit), which are NOT related to a deliberately inserted probe signal or NOT related to the 'noise' intrinsically present in the signal (e.g. the receiver signal).

The term 'originating from' is in the present context taken to mean being equal to or related to by means of attenuation, amplification, compression, filtering or other audio processing algorithms.

In the present context, terms 'noise' or 'noise-like components' in relation to signal components of the audio processing system, e.g. a listening device (e.g. related to a signal of the forward path, e.g. to an input signal to a receiver of the audio processing system (listening device)), refer to signals or signal components (e.g. viewed in a particular frequency range or band), which are uncorrelated with the (target) input signal x(n). This noise or these noise-like components of a signal, typically having very little structure (or short correlation time) and therefore noisy in appearance, is/are of key importance to the present invention.

In the present context, a 'noise like part of the (receiver) signal' is taken to mean one or more components in the (receiver) signal, which are substantially uncorrelated with the input signal. The terms 'uncorrelated' or 'substantially uncorrelated' are in the present context taken to mean 'having a correlation time smaller than or equal to a predefined value'. Since, typically, the receiver signal is approximately a delayed (and scaled) version of the input signal, this is equivalent to saying that a noise-like part of the receiver signal comprises signal components in the receiver signal with a correlation time smaller than the delay of the forward path. For a noise-free speech signal, for example, these components would correspond to time-frequency regions corresponding to 'noise-like' speech sounds such as /s/ and /f/, or high-frequency regions of some vowel speech sounds. For a speech signal contaminated by acoustical noise, these components would typically include time-frequency regions where the acoustical noise is dominant as well, assuming that the acoustical noise has low correlation time itself; this is the case for many noise sources, see e.g. [Lotter, 2005].

The term 'time-frequency region' implies that a signal is available in a time-frequency representation, where a time representation of the signal exist for the frequency bands constituting the frequency range considered in the processing. A 'time-frequency region' may comprise one or more frequency bands and one or more time units. Alternatively, the signal may be available in successive time units (frames $F_m$, m=1, 2, . . . ), each comprising a frequency spectrum of the signal in the corresponding time unit (m), a time-frequency tile or unit comprising a (generally complex) value of the signal in a particular time (m) and frequency (p) unit. A 'time-frequency region' may comprise one or more time-frequency units.

The concepts and methods of the present invention may in general be used in a full band processing system (i.e. a system wherein each processing step is applied to the full frequency range considered). Preferably, however, the full range considered by the audio processing system, e.g. a listening device (i.e. a part of the human audible frequency range (20 Hz-20 kHz), such as e.g. the range from 20 Hz to 12 kHz) is split into a number of frequency bands (e.g. 2 or more, such as e.g. 8 or 64 or 256 or 512 or 1024 or more), where at least some of the bands are processed individually in at least some of the processing steps.

In an embodiment, the feedback path estimation unit comprises an adaptive filter. In a particular embodiment, the adaptive filter comprises a variable filter part and an algorithm part, e.g. an LMS or an RLS algorithm, for updating filter coefficients of the variable filter part, the algorithm part being adapted to base the update at least partly on said noise signal estimate output from the enhancement unit and/or on a probe signal from a probe signal generator.

In an embodiment, the input side of the forward path of the audio processing system, e.g. a listening device or a communication device, comprises an AD-conversion unit for sampling an analogue electric input signal with a sampling frequency $f_s$ and providing as an output a digitized electric input signal comprising digital time samples $s_n$ of the input signal (amplitude) at consecutive points in time $t_n=n*(1/f_s)$, n is a sample index, e.g. an integer n=1, 2, . . . indicating a sample number. The duration in time of X samples is thus given by $X/f_s$.

In an embodiment, the signal processing unit is adapted for processing the SPU-input signal originating from the electric input signal in frequency bands. In an embodiment, the processing of the signal in the forward path (e.g. the application of a frequency dependent gain) is based on the time varying (wideband) signal. In an embodiment, the processing of the signal in the forward path is performed in a number of frequency bands. In an embodiment, a control path for determining gains to be applied to the signal of the forward path is defined. In an embodiment, the processing in the control path (or a part thereof) is performed in a number of frequency bands.

In an embodiment, the consecutive samples $s_n$ are arranged in time frames $F_m$, each time frame comprising a predefined number Q of digital time samples $s_q$ (q=1, 2, . . . , Q), corresponding to a frame length in time of $L=Q/f_s$, where $f_s$ is a sampling frequency of an analog to digital conversion unit (each time sample comprising a digitized value $s_n$ (or s(n)) of the amplitude of the signal at a given sampling time $t_n$ (or n)). A frame can in principle be of any length in time. Typically consecutive frames are of equal length in time. In the present context, a time frame is typically of the order of ms, e.g. more than 3 ms (corresponding to 64 samples at $f_s$=20 kHz). In an embodiment, a time frame has a length in time of at least 8 ms, such as at least 24 ms, such as at least 50 ms, such as at least 80 ms. The sampling frequency can in general be any frequency appropriate for the application (considering e.g. power consumption and bandwidth). In an embodiment, the sampling frequency $f_s$ of an analog to digital conversion unit is larger than 1 kHz, such as larger than 4 kHz, such as larger than 8 kHz, such as larger than 16 kHz, e.g. 20 kHz, such as larger than 24 kHz, such as larger than 32 kHz. In an embodiment, the sampling frequency is in the range between 1 kHz and 64 kHz. In an embodiment, time frames of the input signal are processed to a time-frequency representation by transforming the time frames on a frame by frame basis to provide corresponding spectra of frequency samples (p=1, 2, . . . , P, e.g. by a Fourier transform algorithm), the time-frequency representation being constituted by TF-units (m, p) each comprising a complex value (magnitude and phase) of the input signal at a particular unit in time (m) and frequency (p). The frequency samples in a given time unit (m) may be arranged in bands $FB_k$ (k=1, 2, . . . , K), each band comprising one or more frequency units (frequency samples).

In an embodiment, the audio processing system comprises at least one input transducer (e.g. a microphone) for picking up a noise signal (termed ANC-reference) from the environment. In an embodiment, the audio processing system comprises at least one input transducer (e.g. a microphone) for picking up (measuring) a residual (noise) signal (termed ANC-error). In an embodiment, the audio processing system is adapted to provide an anti-noise signal presented by the output transducer of the system in the form of an acoustic signal having an amplitude and phase adapted for cancelling the noise signal from the environment, whereby an active noise cancelling system is provided.

Noise Retrieval. No Probe Signal Inserted (cf. FIGS. 1*b* and 2*c*. Method C):

In an embodiment, no probe signal generator is included in the audio processing system, e.g. a listening device. In that case the enhancement unit (block Retrieval of intrinsic noise in FIG. 2*c*) is adapted to extract noise-like parts of the receiver signal (and/or of a signal on the input side), e.g. originating from a speech signal, and to use the extracted noise estimate as an input to the estimation of the acoustic feedback path.

Noise Retrieval without Inserted Probe Signal. Processing of Signal y(n) on Output Side and/or Signal e(n) on the Input Side:

In an embodiment, the enhancement unit is adapted for retrieving intrinsic noise-like signal components in the electric signal of the forward path. In a particular embodiment, the enhancement unit is adapted for extracting noise-like parts of the output signal u(n). The enhancement unit takes the output signal u(n) as an input and provides as an output an estimate us(n) of the noise-like parts of the output signal u(n), the estimate being connected to the feedback path estimation unit, e.g. the Algorithm part of an adaptive FBC-filter (cf. e.g. FIG. 1*b*). Additionally (or alternatively), an enhancement unit for extracting noise-like parts of the feedback corrected input signal e(n) may be inserted (as indicated in FIG. 1*b* by the dashed outline of the Enhancement unit in the input path for the Algorithm part). The output from the additional or alternative enhancement unit provides an estimate es(n) of characteristics (e.g. noise-like parts) in the feedback corrected input signal e(n), which is connected to the feedback path estimation unit, e.g. the Algorithm part of an adaptive FBC-filter and used in the calculation of update filter coefficients of the variable filter part Fh(z,n) of the adaptive FBC-filter (cf. e.g. FIG. 1*b*).

The retrieval of intrinsic noise may be combined with insertion of probe signal(s). Examples thereof are described in the section on 'Modes for carrying out the invention' (cf. e.g. FIGS. 2*e*, 2*f*, 2*g*, 6*b*).

In an embodiment, the correlation time $N_1$ of the noise signal estimate output from the enhancement unit is adapted to obey the relation $N_1 \leqq dG+dA$, where dG is the delay of the forward path and dA is the average acoustic propagation delay of an acoustic sound from the output of the receiver to the input of the microphone, when following a direct physical path (not including reflections e.g. from external objects). In an embodiment, the correlation time $N_1$ of the noise signal estimate output obeys $N_1 \leqq dg$. The delay of the forward path is in the present context taken to mean the delay from the microphone input via the electric forward path to the output of the receiver. The forward path delay can e.g. be determined by adding the delays of the components constituting the forward path, which are usually known, or measuring the delay acoustically/electrically by applying a known input signal and measuring the resulting output from the receiver. An analysis of the input and output signal allows determining the delay. The average acoustic propagation delay can e.g. be determined in a similar manner with the hearing device mounted on/in the ear.

In an embodiment, the enhancement unit comprises an adaptive filter. In a preferred embodiment, the enhancement unit comprises an adaptive filter C(z,n) of the form $$\begin{aligned} C(z,n) &= 1 - DR(z) \times LR(z,n) \\ &= 1 - z^{-N_1} \times \sum_{p=0}^{P_1} c_{p+N_1} z^{-p} \\ &= 1 - \sum_{p=N_1}^{N_1+P_1} c_p z^{-p}, \end{aligned}$$

where C(z,n) represents the resulting filter, $DR(z)=z^{-N1}$ represents a delay corresponding to $N_1$ samples, LR(z,n) represents the variable filter part, $N_1$ is the maximum correlation time, and $c_p$ are the filter coefficients adapted to minimize a statistical deviation measure of us(n) (e.g. $\epsilon[|us(n)|^2]$, where $\epsilon$ is the expected value operator) and us(n) is the noise signal estimate output, and where $P_1$ is the order of LR(z,n). The filter coefficients $c_p$ are estimated here to provide the MSE-optimal linear predictor, although other criteria than MSE (Mean Square Error) may be equally appropriate (e.g. minimize $\epsilon[|us(n|^S]$, where s>1, or any other appropriate statistical deviation procedure). In an embodiment comprising a full band setup, $P_1$=128 samples (corresponding to 6.4 ms at a sampling rate of 20 kHz). In an embodiment comprising a sub-band setup, the sub-band signals are down-sampled, so that the efficient sample rate is much lower. The time span, e.g. 6.4 ms can be the same, but since the sample rate is usually much lower, the filter order used for each sub-band filter can then be correspondingly lower.

In a particular embodiment, the enhancement unit(s) is/are fully or partially implemented as software algorithms.

Retrieval of Characteristics and Inserted Probe Signal (FIGS. 1*c*, 1*d*, 2*a*, 2*b*, 2*d*, 2*e*, 2*f*, 2*g*, 3, 4*a*, 4*b*, 5, 6*a*, 6*b*):

In a particular embodiment, the audio processing system, e.g. a listening device, comprises a probe signal generator for generating a probe signal (e.g. embodied in the signal processing unit). In a particular embodiment, the probe signal contributes to the estimation of the feedback transfer function.

In a particular embodiment, the probe signal generator is adapted to provide that the probe signal has predefined characteristics, and wherein the enhancement unit is adapted to provide a signal estimate output based on said characteristics (it is matched to the predefined characteristics). In a particular embodiment, the characteristics of the probe signal are e.g. selected from the group comprising a modulation index, periodicity, correlation time, noise-like signal components and combinations thereof.

In a particular embodiment, the probe signal generator is adapted to provide that the probe signal has a correlation time $N_0 \leqq 64$ samples (corresponding to 3.2 ms at a sampling rate of 20 kHz). Typically, the following tradeoff exists: Increasing $N_0$ allows for higher spectral contrast in the noise, and generally more inaudible noise energy can be inserted. With higher $N_0$, however, an enhancement unit located on the input side can retrieve less of the total noise inserted. Fortunately, the performance of the proposed system does not seem to be very sensitive to an "optimal" choice of $N_0$. Generating a noise sequence with a prescribed correlation time can e.g. be done by filtering a white noise sequence through an FIR shaping filter in that case, the correlation time $N_0$ of the generated noise is simply P+1, where P denotes the order of the FIR shaping filter.

Preferably, the probe signal us(n) is adapted to be inaudible when combined with the output signal y(n) from the forward gain unit. In an embodiment, us(n) is adapted to provide that u(n)=y(n)+us(n) is perceptually indistinguishable from y(n) for the user of the particular audio processing system, e.g. a listening device.

In an embodiment, the algorithm part of the feedback path estimation unit comprises a step length control block for controlling the step length of the algorithm in a given frequency region, and wherein the step length control block receives a control input from the probe signal generator. The step length control block adjusts the speed at which the adaptive filter estimation algorithm converges (or diverges). Generally speaking, in spectral regions where a relative large amount of noise has been inserted and/or retrieved, the step length control algorithm would typically increase the convergence rate.

In a particular embodiment, the probe signal generator(s) is/are fully or partially implemented as software algorithms.

FIG. 1*c* illustrates the general concept of the use of retrieval of characteristics (e.g. noise or any other specific property) AND insertion of a probe signal for estimating a feedback transfer function. The embodiment of an audio processing system, e.g. a listening device, according to the invention in FIG. 1*c* comprises the same components as the audio processing system, e.g. a listening device, of FIG. 1*a*. Additionally, the embodiment in FIG. 1*c* comprises an Enhancement unit for extracting characteristics (e.g. noise-like parts) of the feedback corrected input signal e(n) and providing an estimate es(n) of such characteristics to the Algorithm part of the adaptive FBC-filter (instead of the feedback-corrected input signal e(n)) as discussed in connection with FIG. 1. The Enhancement unit is matched to the characteristics of the inserted probe signal (be the inserted probe signal characterized by its correlation time, its modulation form, its periodicity, or the like). In the embodiment of FIG. 1*c*, the Probe signal generator unit receives its input from the output y(n) from the forward gain unit G(z,n). The Probe signal unit may alternatively (or additionally) receive its input from the input side of the forward path to provide sufficient processing time for the generation of the Probe signal relative to the output signal u(n). This is illustrated by the dashed arrow connecting the feedback corrected input signal e(n) to the Probe signal unit. In general, the probe signal may be generated in any appropriate way, e.g. fulfilling the requirements of non-correlation indicated in the following.

Noise Generation and Noise Retrieval. Processing of Signal y(n) on Output Side:

In an aspect of the invention, based on the signal y(n) from a forward path gain unit, a signal us(n) for use in feedback estimation, which is substantially uncorrelated with the input signal x(n), is generated. In some cases us(n) consists of a synthetic noise sequence added to y(n), in other cases us(n) consists of filtered noise replacing signal components in y(n), and in still other cases us(n) consists of signal components already present in y(n). To this end, we propose in particular embodiments a combination of one or more probe signal generation and/or enhancement/retrieval methods (as indicated in the embodiment of FIG. 1*d* by the blocks Probe signals and/or Retrieval of intrinsic noise in combination with Control block). Some appropriate exemplary probe signal generation methods are:

A) Methods based on masked added noise (Block Probe signals in FIG. 1*d*)

B) Methods based on perceptual noise substitution (Block Probe signals in FIG. 1*d*)

Methods A and B modify the signal y(n) (cf. e.g. FIG. 1*d*) by adding/substituting filtered noise, whereas the method of intrinsic noise retrieval mentioned above under the heading 'Noise retrieval. No probe signal inserted' (and referred to in the detailed description of embodiments as Method C) does not modify the signal but simply aims at extracting (retrieving) the signal components which are uncorrelated with x(n), and which are intrinsically present in a signal of the forward path (the intrinsic 'noise-like part of the signal'), e.g. signal u(n) in the embodiments of FIG. 1*b* and 1*d*.

Masked Probe Noise (FIGS. 2*a*, 2*d*, 2*e*, 2*g*, 3, 4*a*, 4*b*, 5, 6*a*, 6*b*):

In a particular embodiment, the probe signal generator is adapted to provide a probe signal based on masked added noise.

In a particular embodiment, the probe signal generator comprises an adaptive filter for filtering a white noise input sequence w, the output of the variable part M of the adaptive filter forming the masked probe signal, and the variable part M of the adaptive filter being updated based on a signal from the forward path by an algorithm part comprising a model of the human auditory system. Preferably, the masked probe signal is based on a signal from the output side. Alternatively or additionally, it may be based on a signal from the input side of the forward path. In the present context, 'a white noise sequence' is taken to mean a sequence representing a digital version of a white noise signal. White noise is in the present context taken to mean a signal with a substantially flat power spectral density (in the meaning that the signal contains substantially equal power within a fixed bandwidth when said fixed bandwidth is moved over the frequency range of interest, e.g. a part of the human audible frequency range). The white noise sequence may e.g. be generated using pseudo random techniques, e.g. using a pseudo-random binary sequence generator.

Preferably, the correlation time $N_0$ of the masked probe signal us(n) is adapted to not exceed dG+dF, where dG, dF denote the forward and feedback path delay, respectively. That is, us(n) is adapted to be uncorrelated with itself, delayed by an amount corresponding to the combined delay of the feedback path and the forward path, i.e., $Eus(n)us(n-\tau)=0$ for $\tau>dG+dF$.

Insertion of Probe Signal by Perceptual Noise Substitution (FIGS. 2*b*, 2*d*, 2*f*, 2*g*, 6*b*):

In a particular embodiment, the probe signal generator is adapted to provide a probe signal based on perceptual noise substitution, PNS.

In a particular embodiment, the probe signal generator comprises a PNS-part located in the forward path, and bases its output on a perceptual noise substitution algorithm (PNS) for substituting one or more spectral regions of its input signal with filtered noise sequences. Preferably, the PNS-part receives an input from the output side of the forward path, i.e. originating from the signal processing unit. Alternatively or additionally, the PNS-part receives an input from the input side of the forward path, e.g. originating from the feedback corrected input signal.

The purpose of the PNS-part is to process the signal y(n) so as to ensure that the receiver signal u(n) is uncorrelated to the (target) input signal x(n), at least in certain frequency regions (cf. e.g. FIG. 2*b*). This is achieved by substituting selected spectral regions of the output signal y(n) of the forward path unit G(z,n) (cf. FIGS. 1*d* and 2*b*) and/or of another signal of the forward path (e.g. the feedback corrected input signal e(n)) with filtered noise sequences and thereby ensure a predefined degree of (un-) correlation in the frequency regions in question.

Several possibilities exist for deciding which frequency regions can preferably be substituted without substantial perceptual consequences. One is to compare the original and the modified signal using a perceptual model and let the model predict the detectability of the modification. Another is to use a masking model as outlined in relation to the discussion of masked noise (Method A) to identify spectral regions of low sensitivity. (e.g. frequency regions for which the signal-to-masking function ratio is low).

Feedback Noise Retrieval: Processing of Signal e(N) on Input Side:

As shown in FIG. 1*d*, we propose (in an embodiment of the invention) to process the feedback corrected input signal e(n) in the enhancement unit block Retrieval of feedback noise before the signal enters the Fh filter estimation block of the feedback cancellation (FBC) system (comprising an adaptive filter comprising algorithm part LR filter estimation and variable filter part Fh(z,n)). The purpose of the Retrieval of feedback noise block is the following. The signal e(n) comprises inserted characteristics, e.g. noise components, or intrinsic noise components (filtered through the feedback channel F(z,n) and the estimated feedback channel Fh(z,n)) along with non-noise components, e.g. speech (which typically have much higher energy). Seen from the Fh filter estimation block of the FBC system, the noise-like components in e(n) represent the signal of interest, whereas the 'rest' of e(n) (here) is considered as 'interference'. The adaptive Fh filter estimation block may operate using e(n) as an input, as is done in traditional probe noise solutions (cf. e.g. EP 0 415 677 A2), but due to the unfavourable target noise-to-interference ratio (NIR), the adaptation must be very slow, leading to a system which is generally too slow to track real-world feedback paths. It is, however, possible to significantly improve the NIR by processing the signal to retrieve the target noise (here implemented by the enhancement unit Retrieval of feedback noise) and use this 'enhanced noise' signal as an input to the Fh filter estimation block of the FBC system.

The algorithms for noise enhancement/retrieval include, but are not limited to:

I) Methods based on long-term prediction (LTP) filtering.

II) Methods based on binaural prediction filtering.

As mentioned above, any method (or combination of methods) of generating noise, including the methods outlined above are intended to be combinable with any method (or combination of methods) for noise enhancement/retrieval including the methods outlined in the following.

In an embodiment, the enhancement unit comprises an adaptive filter. The adaptive filter can be non-linear or linear. The non-linear and linear filters can be based on forward prediction or backward prediction or a combination of both. A linear adaptive filter can be of the IIR or FIR-type.

Noise Retrieval Based on Long-Term Prediction Filtering (FIGS. 4, 6*a*, 6*b*):

In an embodiment, the enhancement unit is adapted to base the signal estimate output on an adaptive long-term prediction, LTP, filter D(z,n) adapted for filtering a feedback corrected input signal on the input side of the forward path to provide a noise signal estimate output comprising noise-like signal components of said feedback corrected input signal.

In an embodiment, the adaptive LTP filter D has a time varying filter characteristic and is of the specific form $$\begin{aligned} D(z,n) &= 1 - DE(z) \times LE(z,n) \\ &= 1 - z^{-N_2} \times \sum_{p=0}^{P_2} d_{p+N_2} z^{-p} \\ &= 1 - \sum_{p=N_2}^{N_2+P_2} d_p z^{-p} \end{aligned}$$

where D(z,n) represents the resulting filter, $DE(z)=z^{-N2}$ represents a delay corresponding to $N_2$ samples, LE(z,n) represents the variable filter part, $N_2$ is the maximum correlation time, $d_p$ are the filter coefficients adapted to minimize a statistical deviation measure of es(n) (e.g. $\epsilon[|es(n)|^2]$, where $\epsilon$ is the expected value operator), and $P_2$ is the order of the filter LE(z,n), and where es(n) is the output signal of the filter D(z,n), and $$es(n) = e(n) - \sum_{l=0}^{P2} d_l e(n - N2 - l) = e(n) - z(n),$$

where e(n) is a feedback-corrected input signal on the input side at time instant n and z(n) can be seen as a linear prediction of e(n) based on past samples of e(n). The filter coefficients d, are estimated here to provide the MSE-optimal linear predictor, although other criteria than MSE (Mean Square Error) may be equally appropriate (e.g. minimize $\epsilon[|es(n)|^s]$, where s>1).

In an embodiment, $N_2$ is larger than or equal to 4, or larger than or equal to 8, or larger than or equal to 16 or larger than 32, such as in the range between 4 and 400 samples, such as in the range between 40 and 200 samples for $f_s$=20 kHz. In a particular embodiment, $N_2$ is larger than or equal to $N_0$+N, where $N_0$ represents the correlation time of the probe noise sequence, and N represents the efficient length of the feedback path impulse response ($N=d_{IR,eff}$). In the present context, the feedback path delay (dF) is taken to mean the time it takes an impulse in the electrical receiver signal u(n) to be registered in the electrical microphone signal. In the present context, the efficient impulse response length ($d_{IR,eff}$) is taken to mean the time span from the impulse is registered in the electrical microphone signal until the final decay of the impulse response. The feedback path delay can e.g. be estimated from the distance from the receiver to the microphone (and the speed of sound), or determined more accurately using acoustical/electrical measurements.

In an embodiment, the order $P_2$ of the LTP-filter is in the range from 16 to 512.

In an embodiment, the enhancement unit comprises a sensitivity function estimation unit. Basically, this unit aims at compensating for the fact that the hearing aid operates in closed-loop in any practical situation, while the feedback path estimation algorithms are designed with an open-loop situation in mind. By taking the sensitivity function into account, the algorithms are brought closer to the situation for which they were designed, and their performance is improved. The estimation of the sensitivity function has the largest impact on the performance at high loop gains. The sensitivity function is e.g. discussed in [Forsell, 1997].

Noise Retrieval Based on Binaural Prediction Filtering (FIGS. 5, 6*a*, 6*b*):

In an embodiment, the enhancement unit is adapted to provide a noise signal estimate output based on binaural prediction filtering, wherein an adaptive noise retrieval unit is adapted for filtering a signal $y_c$ from another microphone, e.g. from the input side of the forward path (e.g. a feedback corrected input signal) of a contra-lateral listening device. The use of a signal from another microphone has the advantage that it allows, in principle, more of the introduced noise to be retrieved than with the LTP method described above. This is the case since the proposed filtering is based on current signal samples (from an external sensor) rather than past samples from the current sensor.

In an embodiment, the adaptive noise retrieval unit has a time varying filter characteristic described by the difference equation $$e_s(n) = e(n - N_3) - \sum_{p=0}^{P_3} e_p y_c(n - p),$$

where $y_c(n)$ represents samples from the other microphone, e.g. an external sensor, and $$LB(z,n) = \sum_{p=0}^{P_3} e_p z^{-p}$$

represents the variable filter part, where $e_p$ are the filter coefficients adapted to minimize a statistical deviation measure of es(n) (e.g. $\epsilon[|es(n)|^2]$, where $\epsilon$ is the expected value operator) and where, $N_3$ is a delay in samples and $P_3$ is the order of the filter LB(z,n).

In an embodiment, $N_3$ is chosen in the range $0 \leqq N_3 \leqq 400$ samples (corresponding to 20 ms at a sampling rate of 20 kHz).

In an embodiment, the order $P_3$ of the filter LB(z,n) is in the range from 32 to 1024 or larger than 1024.

In an embodiment, the audio processing system comprises a first enhancement unit on the input side and a second enhancement unit on the output side, each enhancement unit being electrically connected to the feedback estimation unit, and an enhancement control unit adapted to improve, e.g. optimize, the working conditions of the feedback estimation unit, e.g. maximize the ratio between the probe signal and the interfering signal, the interfering signal comprising all other signal components which are NOT associated with the probe signal.

In an embodiment, the audio processing system comprises a master enhancement unit on the input side and a slave enhancement unit on the output side, each enhancement unit being electrically connected to the feedback estimation unit, wherein the slave enhancement unit is adapted to provide the same transfer function as the master enhancement unit. In an embodiment, the master and slave enhancement units are electrically connected to an algorithm part of an adaptive filter forming part of or constituting the feedback estimation unit, the inputs to the algorithm part from the master and slave enhancement units constituting e.g. the error signal and the reference signal, respectively. In an embodiment, the master and slave enhancement units each comprise an adaptive filter. In an embodiment, the (time varying) filter coefficients of the master enhancement unit are copied to the slave enhancement unit to provide a filtering function which is equal to the filtering function of the master enhancement unit. In an embodiment, the adaptive filter comprises an algorithm part and a variable filter part. In an embodiment, the algorithm part of the adaptive filter of the master enhancement unit simply controls the variable filter parts of the adaptive filters of the master and slave enhancement units.

In an embodiment, the audio processing system comprises a public address system (e.g. for use in a classroom or auditorium, in a theatre, at concerts, etc.), an entertainment system (e.g. a karaoke system), a teleconferencing system, a communication system (e.g. a telephone, e.g. a cellular phone, a PC, etc.), a listening device (e.g. a hearing aid, a headset, an active ear protection system, a head phone, etc.). In an embodiment, the audio processing system comprises two or more separate physical units, e.g. separate microphone and/or speaker unit(s), which are connected to other parts of the system via wired or wireless connection(s).

Use of an Audio Processing System:

Use of an audio processing system as described above, in the detailed description of 'mode(s) for carrying out the invention' and in the claims is furthermore provided by the present application.

In an embodiment, use of the audio processing system in a communication device or in a listening device or in an audio delivery system is provided. In an embodiment, use of the audio processing system in a device or system selected from the group comprising a mobile telephone, a headset, a head phone, a hearing instrument, an ear protection device, a public address system, a teleconferencing system, an audio delivery system (e.g. a karaoke system, an audio reproduction system for concerts, etc.), or combinations thereof.

In an embodiment, use in connection with active noise control ANC (e.g. adaptive noise cancellation) is provided. In an embodiment, use of the audio processing system for active noise control in a communication device or in a listening device is provided. In an embodiment, use of the audio processing system for active noise control of noise from a machine (or other article of manufacture providing acoustic noise or mechanical vibrations) is provided. Use is e.g. provided in connection with ANC applications in the fields of automotive (e.g. noise from motor, exhaustion, etc. in a vehicle compartment), appliances (e.g. noise from air conditioners or household appliances), industrial (e.g. noise from power generators, compressors, etc.) and transportation (e.g. noise from airplanes, helicopters, motorcycles, locomotives, etc.).

In an embodiment, use in connection with a low delay acoustic system is provided. A low delay acoustic system is a system with a low delay between input and output transducer (low forward path delay), in particular a system with a low loop delay (loop delay being defined as the sum of the processing delay in the forward path and the delay in the feedback path), in particular a system where a large correlation exists between the target input microphone signal and the loudspeaker signal. In the present context, 'low delay' is e.g. taken to mean less than 50 ms, such as less than 20 ms, such as less than 10 ms, such as less than 5 ms, such as such than 2 ms.

A Method of Operating an Audio Processing System, e.g. a Listening Device or a Communication Device:

A method of estimating a feedback transfer function in an audio processing system, e.g. a listening device or a communication device, comprising a feedback estimation system for estimating acoustic feedback is furthermore provided by the present invention. The audio processing system, e.g. a listening device or a communication device, comprises a forward path between an input transducer and an output transducer and comprising a signal processing unit adapted for processing an SPU-input signal originating from the electric input signal and to provide a processed SPU-output signal u, an electric feedback loop from the output side to the input side comprising a feedback path estimation unit for estimating the feedback transfer function from the output transducer to the input transducer, the method comprising extracting characteristics of the electric signal of the forward path and providing an estimated characteristics output;

adapting the feedback path estimation unit to use the estimated characteristics output in the estimation of the feedback transfer function.

It is intended that the structural features of the device described above, in the detailed description of 'mode(s) for carrying out the invention' and in the claims can be combined with the method, when appropriately substituted by a corresponding process. Embodiments of the method have the same advantages as the corresponding devices.

In an embodiment, characteristics of the electric signal of the forward path comprise one or more of the following: modulation index, periodicity, correlation time, noise or noise-like parts.

In an embodiment, extracting characteristics of the electric signal of the forward path comprises estimating signal components in the electric signal of the forward path originating from noise-like signal parts and the estimated characteristics output comprises a noise signal estimate output.

In an embodiment, noise-like signal parts in the forward path are provided in the form of intrinsic noise in the target signal.

In an embodiment, the method further comprises inserting noise-like signal parts in the forward path, e.g. in the form of a probe signal.

A Computer-Readable Medium:

A tangible computer-readable medium storing a computer program comprising program code means for causing a data processing system to perform at least some of the steps (such as a majority or all of the steps) of the method described above, in the detailed description of 'mode(s) for carrying out the invention' and in the claims, when said computer program is executed on the data processing system is furthermore provided by the present invention. In addition to being stored on a tangible medium such as diskettes, CD-ROM-, DVD-, or hard disk media, or any other machine readable medium, the computer program can also be transmitted via a transmission medium such as a wired or wireless link or a network, e.g. the Internet, and loaded into a data processing system for being executed at a location different from that of the tangible medium.

A Data Processing System:

A data processing system comprising a processor and program code means for causing the processor to perform at least some of the steps (such as a majority or all of the steps) of the method described above, in the detailed description of 'mode(s) for carrying out the invention' and in the claims is furthermore provided by the present invention. In an embodiment, the processor is an audio processor, specifically adapted to run audio processing algorithms (e.g. to ensure a sufficiently low latency time to avoid perceivable or unacceptable signal delays).

Further objects of the invention are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The invention will be explained more fully below in connection with a preferred embodiment and with reference to the drawings in which.

Figure 1A:
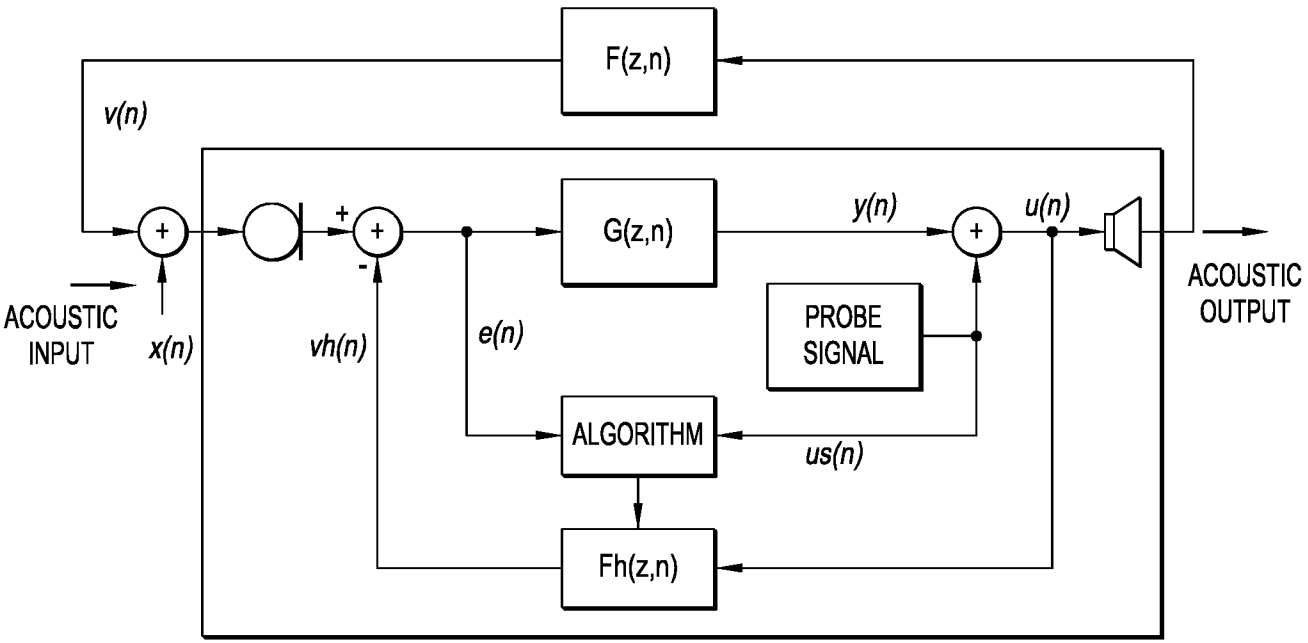
FIG. 1 shows an example of a an audio processing system, e.g. a listening device or a communication device comprising a traditional adaptive DFC system based on probe noise (FIG. 1*a*) and overviews of embodiments of an audio processing system, e.g. a listening device or a communication device according to the present invention, FIG. 1*b* illustrating the general concept of retrieval of characteristics of a signal of the forward path (e.g. intrinsic noise-like signal parts) for use in the estimation of the feedback path, FIG. 1*c* and 1*d* illustrating various combinations of the use of retrieval of characteristics of a signal of the forward path AND a probe signal in feedback path estimation, FIG. 1*e* showing an application scenario for an audio processing system comprising two or more separate physical units, FIG. 1*f* showing a listening device in the form of an active ear protection device EPD comprising an audio processing system and an active noise control system, FIG. 1*g* showing an embodiment with a probe signal generator, where an enhancement unit is inserted on the input as well as on the output side, FIG. 1*h* showing an embodiment similar to that of FIG. 1*g* but where a control unit determines the optimal settings of parameters (e.g. filter coefficients) of the two enhancement units, and FIG. 1*i* showing a general model of an active noise control ANC system in cooperation with an audio processing system APS as described in the present application.

The figures are schematic and simplified for clarity, and they just show details which are essential to the understanding of the invention, while other details are left out.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

According to embodiments of the present invention, methods which allow significantly faster convergence while maintaining the advantage of being robust against the autocorrelation (AC) problem are proposed. The following embodiments of the invention are shown as block diagrams of various functional elements of an audio processing system, e.g. a listening device or a communication device. In general the functional components can be implemented in hardware or software as the case may be depending on the current application and restrictions. It is, however, understood that most of the functional blocks shown in the drawings—at least in some embodiments—are intended to be implemented as software algorithms. Examples of such blocks are the forward gain block G(z,n), the adaptive filter blocks (e.g. feedback estimate transfer function Fh(z,n) and corresponding Algorithm or Filter Estimation blocks for updating filter coefficients of the feedback estimate transfer function), Enhancement/Noise retrieval blocks, and Probe signal generator blocks.

Traditional Probe Noise Solution:

A prior art probe noise based solution of an adaptive feedback cancellation (FBC) system is shown in FIG. 1*a* and described in the Background art section above.

Figure 1B:
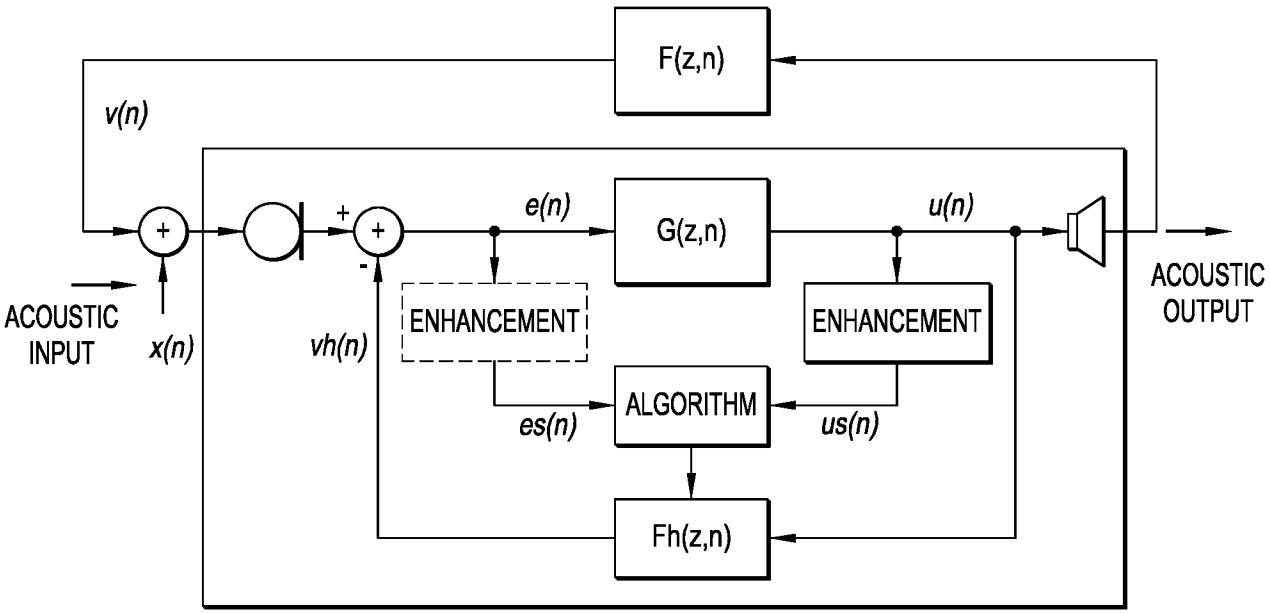

Noise Retrieval (Noise Enhancement):

FIG. 1*b* illustrates the general concept of noise retrieval using enhancement of (possibly) intrinsic noise-like signals in the estimation of the feedback path. The embodiment of an audio processing system, e.g. a listening device or a communication device, according to the invention in FIG. 1 comprises the same components as the audio processing system, e.g. a listening device or a communication device, of FIG. 1*a*, except that the Probe signal generator (and the output SUM unit '+') is omitted so that the output signal to the receiver u(n) is the output of the forward gain unit G(z,n). A forward path is defined between the microphone and the receiver. An input side of the forward path is defined by the microphone and an output side of the forward path is defined by the receiver. A delimiting functional unit between input and output side of the forward path can e.g. be a block in the forward gain unit G(z,n) providing a frequency dependent gain. An Enhancement unit for extracting noise-like parts of the output signal u(n) is provided. It takes the output signal u(n) as an input and provides as an output an estimate us(n) of the noise-like parts of the output signal, the estimate being connected to the Algorithm part of the adaptive FBC-filter. Additionally (or alternatively), an Enhancement unit for extracting noise-like parts (and/or other characteristics) of the feedback corrected input signal e(n) may be inserted (as indicated by the dashed outline of the Enhancement unit in the input path for the Algorithm part). The output from the (optional) additional Enhancement unit provides an estimate es(n) of the noise-like parts in the feedback corrected input signal e(n), which is connected to the Algorithm part of the adaptive FBC-filter and used in the calculation of update filter coefficients of the variable filter part Fh(z,n) of the adaptive FBC-filter. In an embodiment, the optional Enhancement unit on the input side is absent, in which case the input to the Algorithm part is the feedback corrected input signal e(n). The notation (e.g. u(n), e(n)) for signals of the an audio processing system, e.g. a listening device, indicates a digital representation, which is preferred. It is therefore understood that in such embodiments that are based on a digital representation of signals, the system or device comprises analogue to digital (ND) and digital to analogue (D/A) conversion units, where appropriate (e.g. in the forward paths as part of or subsequent to the microphone and prior to the receiver units, respectively). Further, preferred embodiments comprise processing of signals in a time-frequency framework. In such embodiments, the an audio processing system, e.g. a listening device, comprises time to time-frequency conversion units and time-frequency to time conversion units, where appropriate (e.g. filter banks and synthesizer units, respectively, or Fourier transform and inverse Fourier transform units/algorithms, respectively, e.g. in the forward paths as part of in connection with the microphone and receiver units, respectively). Also, a directional microphone system (e.g. providing directionally preferred directions of the microphone sensitivity) may form part of the processing of the input signal, before or after the estimate of the feedback path is subtracted. Further, other functional blocks of an audio processing system, e.g. a listening device, may be integrated with those described in connection with the present invention, e.g. systems or components for noise reduction, compression, warping, etc. The notation (e.g. G(z,n) and Fh(z,n)) in connection with transfer functions, e.g. for filters, implies a preferred time-frequency representation of the signals, n being a time parameter and z indicating a z transform ($z=e^{j\omega}$, where j is the complex unit ($j^2=-1$) and $\omega=2\pi f$, where f is frequency). Various implementations of an Enhancement unit are discussed below (noise retrieval methods I, II and C).

Figure 1C:
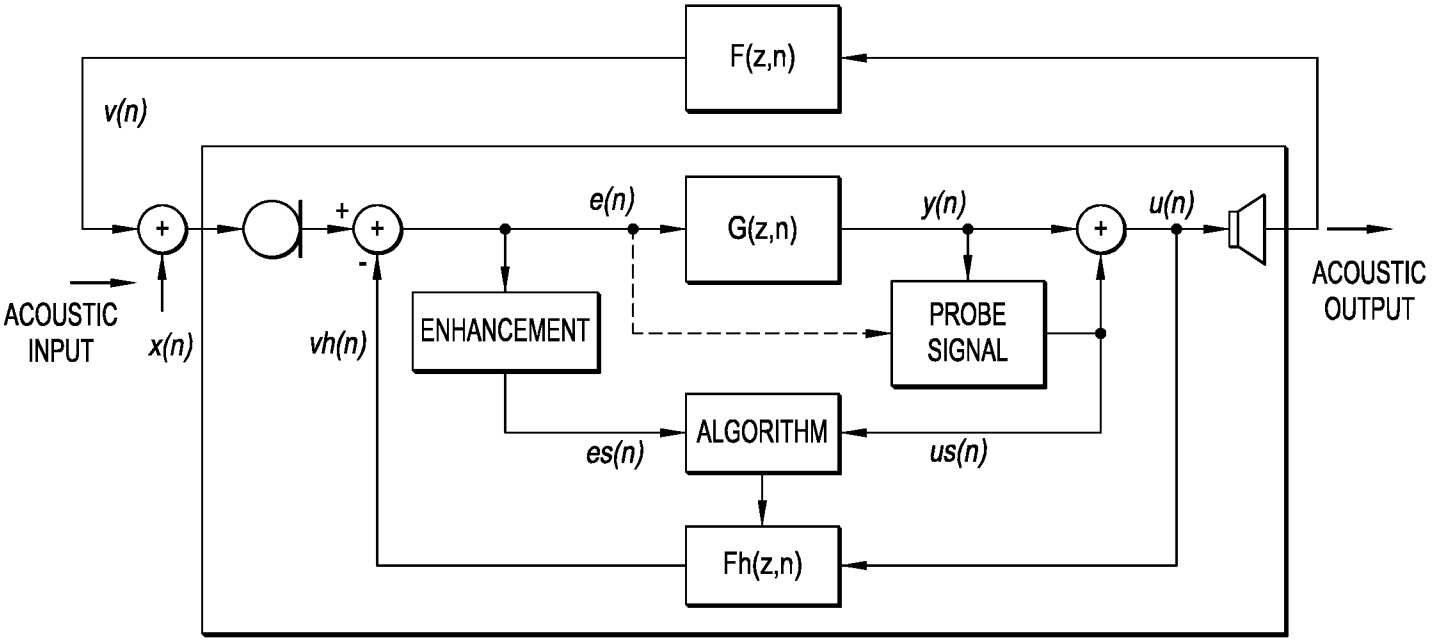

Noise Retrieval (Enhancement) and Probe Noise:

FIG. 1*c* illustrates the general concept of the use of noise retrieval AND a probe signal. FIG. 1 is described in the Disclosure of invention section above. In general, the probe signal may be generated in any appropriate way fulfilling the requirements of non-correlation indicated in the following. For illustration, various implementations of a Probe signal unit for generating a probe signal are discussed below (noise generation methods A, B).

Figure 1D:
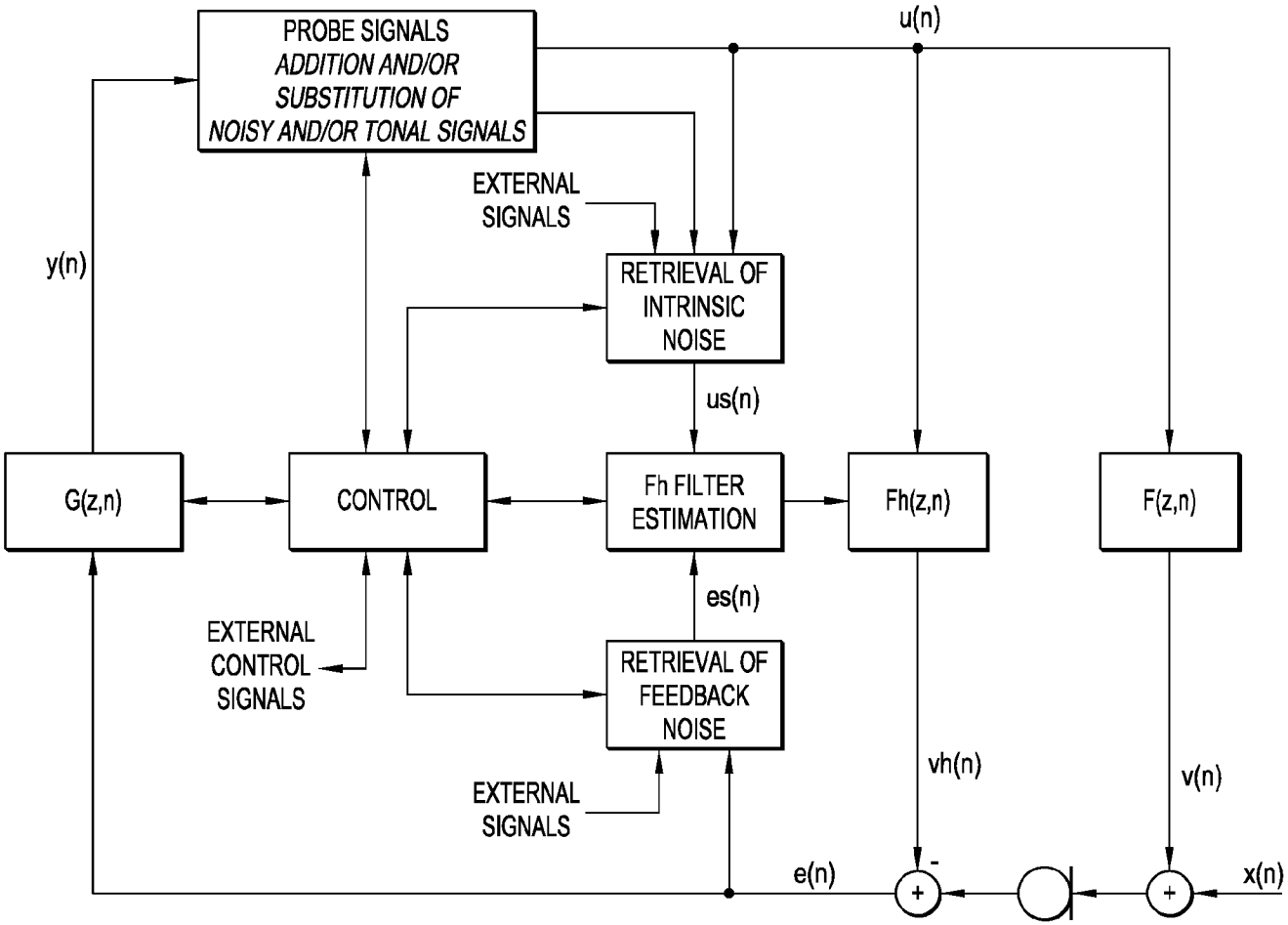

FIG. 1*d* shows a general block diagram of an embodiment of the proposed audio processing system, e.g. a listening or communication system. An output signal, u(n), is connected to a receiver for converting an electric input to an acoustic output. The acoustic output leaks back to the microphone through some (unknown) feedback channel F(z,n). In addition to the (undesired) feedback signal v(n), the microphone picks up the (desired) target signal x(n), e.g. a speech signal. After the microphone (and a possible ND converter and/or possible time→frequency converter, not shown), an estimate vh(n) of the feedback signal v(n) is subtracted from the microphone signal to form a feedback compensated signal e(n) (e(n)=x(n)+v(n)−vh(n)). This signal is connected to a forward path unit G(z,n), which represents noise suppression, amplification, compression, etc., to form the processed signal y(n). Normally, this signal would be identical to the receiver output u(n), but in some embodiments of the proposed system, we introduce a modification of the signal before outputting it (in FIG. 1*d* represented by the block Probe signals Addition and/or substitution of Noisy and/or tonal signals, termed Probe signals block in the following). In the block Fh filter estimation, an estimate Fh(z,n) of the feedback channel F(z,n) is computed. The Fh filter estimation block updates the filter estimate Fh(z,n) across time using any of the well-known adaptive filtering approaches such as (normalized) Least-Mean Square ((N)LMS), recursive least squares (RLS), methods based on affine projections (AP), Kalman filtering, etc. Clearly, if Fh(z,n) is 'close to' the true (unknown) feedback path F(z,n), the feedback signal v(n) will largely be eliminated from the feedback compensated signal e(n) by the feedback estimate signal vh(n). In contrast to most standard systems, in some embodiments of the present invention, the output y(n) of the forward path unit (or as in FIG. 1*d*, the output u(n) of the Probe signals block) is processed before it enters the Fh filter estimation block, cf. Retrieval of intrinsic noise block in FIG. 1*d* providing an estimate of output noise us(n). Furthermore, in some embodiments of the present invention, the feedback compensated signal e(n) is processed before it enters the Fh filter estimation block, cf. Retrieval of feedback noise block in FIG. 1*d* providing an estimate of input noise es(n). Consequently, we propose in some embodiments of the invention to introduce some or all of the blocks denoted in FIG. 1*d* as Probe signals, Retrieval of intrinsic noise, and Retrieval of feedback noise, accompanied by an appropriate Control block.

The general purpose of blocks Probe signals and/or Retrieval of intrinsic noise is to ensure that the signal us(n) is substantially uncorrelated with the (target) input signal x(n). This may be achieved by e.g. generating and adding to the output y(n) of the forward path unit an inaudible noise sequence, which by construction is uncorrelated with x(n) (Probe signals block in FIG. 1*d*), and/or replacing time-frequency regions in y(n) with filtered noise whenever this does not lead to audible artefacts (Probe signals block in FIG. 1*d*), and/or filtering out signal components from the receiver signal u(n), which are uncorrelated with x(n) (Retrieval of intrinsic noise block in FIG. 1*d*).

The general purpose of the Retrieval of feedback noise block is to filter out/retrieve signal components of the feedback corrected input signal e(n) originating from noise (e.g. from us(n)). Signal components in e(n) which do not originate from us(n) are, seen from the Fh filter estimation block, interference, and should ideally be rejected by the Retrieval of feedback noise block.

The blocks Retrieval of intrinsic noise and Retrieval of feedback noise providing the estimates us(n) and es(n), respectively, of noise-like signals may receive other inputs than the output u(n) and the feedback corrected input signal e(n). In an embodiment, one or both (as in FIG. 1*d*) of these noise retrieval blocks receive one or more External signals as inputs. Such signals can e.g. be an acoustic signal picked up by another microphone, either in the same hearing aid or elsewhere, e.g. from a contra-lateral hearing aid, an external device, or other external sensors. In FIG. 1*d*, the Retrieval of intrinsic noise block may receive—in addition to (or instead of) the output signal u(n)—an input from the Probe signals block. This input can be the noise sequence inserted by the Probe signals block or information describing in which signal regions the noise is inserted. The Retrieval of intrinsic noise block might then operate primarily in signal regions where noise is NOT inserted by the Probe signals generator.

Further, the embodiment of an audio processing system, e.g. a listening device, shown in FIG. 1*d* comprises a Control block having (one- or two-way) electrical connection to one or more of the blocks G(z,n), Probe signals Addition and/or substitution of Noisy and/or tonal signals, Retrieval of intrinsic noise, Fh filter estimation and Retrieval of feedback noise. The Control block is e.g. adapted to monitor and adjust the operation of the adaptive filter in the Fh filter estimation block in order to ensure that the loop gain of the system is appropriate. In some cases the feedback path may change quickly (e.g. when a telephone is placed by the ear), and the loop gain will become momentarily high leading to poor signal quality or even howls. In this case, a purpose of the Control block is to adjust the operation of the blocks G(z,n), Probe signals Addition and/or substitution of Noisy and/or tonal signals, Retrieval of intrinsic noise, Fh filter estimation and Retrieval of feedback noise, in order to extinguish the howl quickly and bring the system loop gain down. More specifically, based on the amount of inserted/intrinsic and/or retrieved noise in a given signal region, the Control block adjusts the adaptation speed of the adaptive filter. If e.g. a signal region has been substituted by filtered noise, the convergence rate (represented by a step length parameter $\mu$) can be increased. The Control block may also base its decisions on results from external detector algorithms, e.g. howl detectors, tonality detectors, loop gain estimators, own voice detectors, etc. (represented by External control signals in FIG. 1*d*), but also on the combined total gain applied in the forward path G(z,n) (represented by the arrow between the G(z,n) and Control blocks).

Rather than basing its decision on the amount of noise inserted by e.g. the Probe signals Addition and/or substitution of Noisy and/or tonal signal block, this procedure can also easily be reversed, such that the Control block informs the Probe signals Addition and/or substitution of Noisy and/or tonal signal block to insert an appropriate amount of noise in the receiver signal for a given loop gain (as estimated by a loop gain estimator). Furthermore, in high loop gain situations (as estimated by a loop gain estimator), the Control block may inform the G(z,n) block to reduce the gain applied in the forward path, and in this way reduce the total loop gain. An example of such a feedback control system is discussed in WO 2008/151970 A1.

Figure 1E:
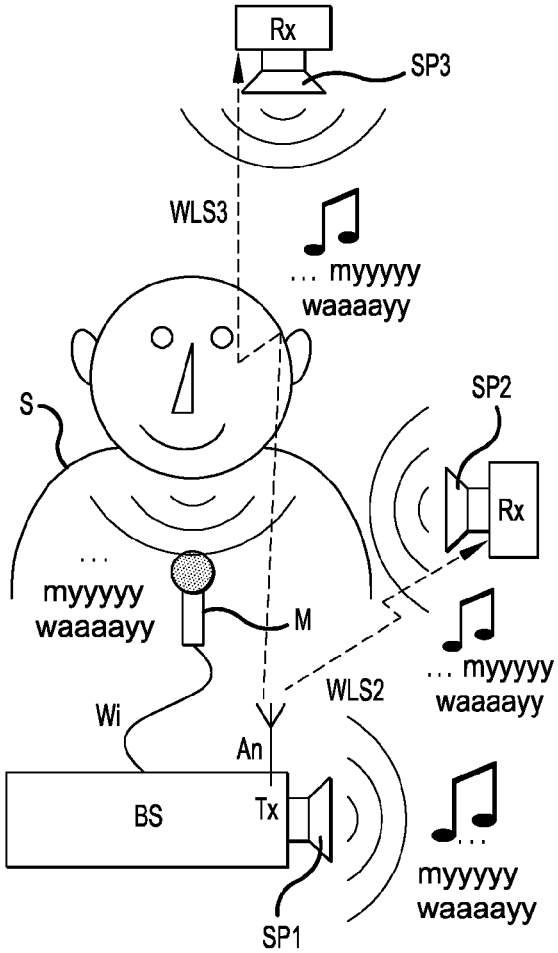

FIG. 1*e* shows an application scenario for an audio processing system according to an embodiment of the present invention. FIG. 1*e* illustrates an entertainment system comprising microphone M, base station BS and a number of speaker units (here three) SP1, SP2, SP3. A speaker S (or singer) speaks (or sings) into microphone M, which is electrically connected to base station BS via a wired connection Wi (which could be wireless). The utterance (indicated as 'myyyyy waaaayy' in FIG. 1*e*) of speaker (or singer) S is processed in base station BS and the processed signal is forwarded or transmitted to speakers SP1, SP2, SP3 via a wired or wireless connection. In the embodiment shown speaker SP1 is directly connected (e.g. integrated with) to base station BS, whereas speakers SP2, SP3 are reached via wireless links WLS2, WLS3, respectively, comprising appropriate corresponding transmit and receive circuitry (transmitter Tx and Antenna An of the base station BS, and receiver Rx of the speaker units SP2, SP3, respectively (receive antennas are not shown)). Apart from the microphone and speaker(s), embodiments of the base station BS comprise the rest of the components of the systems as shown in FIG. 1*b*-1*d*. Alternatively, a part of the remaining components are included in the microphone unit or the speaker unit(s). The acoustic feedback may arise from the pickup by the microphone of the sound presented by the speakers. In the example of FIG. 1*e*, the closest speaker is SP2 whose output may be especially prone be picked up by the microphone. If the person S moves around (if e.g. the connection to the base station BS is wireless), the situation may change over time. FIG. 1*e* may illustrate a karaoke system, where the person S sings in microphone M and his or her voice is processed in base station BS and transmitted to the speakers SP1-SP3 possibly together with accompanying music. Alternatively, FIG. 1*e* may represent a combination of a car stereo system and a telephone system, where the microphone part is used during a telephone conversation (preferably in a handsfree mode). The same acoustic feedback issues as discussed above may be relevant in such situation. Another application, which may be symbolized by FIG. 1*e* is a so-called public address (PA) system, where one or more (typically wireless) microphones are worn by one or more persons (speakers, actors, singers, musicians), processed in a base station and relayed to one or more loud speakers. One such application is for amplifying a voice of a teacher in a classroom amplification system to enable the pupils to better hear the teacher's voice independently of their relative position to the teacher.

In FIG. 1*e*, both microphone and speaker(s) are shown as physically separate units from the base station. In other embodiments, the microphone or the speaker(s) may be integrated with the base station.

In another application scenario a telephone (e.g. a mobile telephone) is used with its loudspeaker on, e.g. lying on a table to provide a handsfree operation to a user. In such case acoustic feedback between the loudspeaker and the microphones may well occur. Another application is active noise cancelling, where a noise signal arriving at a user's eardrum is counteracted by a signal generated by the audio processing device and attempting to estimate the noise and where the estimate is presented to the user as an anti-noise acoustic signal adapted in phase and amplitude to cancel the noise signal. Such active noise cancelling can e.g. be of value in a communication device or a listening device receiving a direct electric input with the target signal and which at the same time receives an acoustically interfering signal from the surrounding environment. In such case the signal from the loudspeaker of the device comprising the target signal (and the noise cancelling signal) may be acoustically fed back to the microphone(s) of the device being used for picking up sounds from the environment as illustrated in FIG. 1*f*.

Figure 1F:
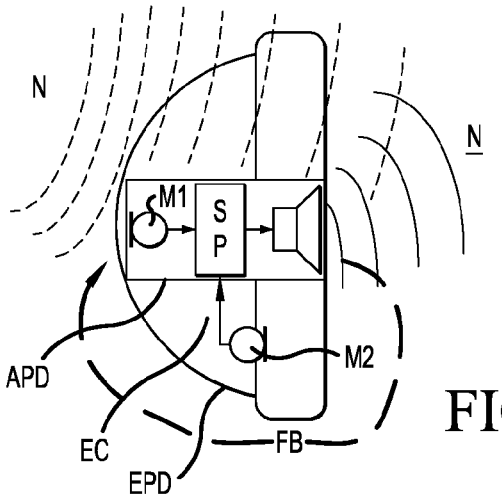

FIG. 1*f* shows a listening device in the form of an active ear protection device EPD comprising an active noise cancellation system. The ear protection device comprises an ear cup (EC) adapted for being placed over an ear of a user. The ear protection device comprises an audio processing device (APD) comprising an input transducer (e.g. a microphone) M1 for picking up a signal from the environment, e.g. noise, and providing an electric input signal, a signal processing unit (SP) for processing the electric input signal and providing a processed output signal, and an output transducer for converting the processed output signal to an output sound for being presented to a user. In an embodiment, the audio processing device (APD) is adapted to provide an acoustic cancellation (or anti-noise) signal $\overline{N}$ adapted in amplitude and phase to minimize or preferably cancel the acoustic signal N from the environment present at the ear of the user, thereby providing an active noise cancelling system. In an embodiment, a second input transducer (e.g. a microphone) M2 picks up the acoustic signal (ANC-error signal) present at the ear (within the ear cup (EC) of the ear protection device EPD). This (ANC-error) signal is preferably used to adaptively determine the anti-noise signal (by minimizing the ANC-error signal). A part of the acoustic cancellation signal $\overline{N}$ may leak out of the ear protection device EPD, e.g. in case of insufficient contact between the ear cup EC and the head of the user, and reach the input transducer, thereby possibly leading to a feedback problem (howl). Such feedback scenario may benefit from the teaching of the present application providing an improved estimate of the feedback cancellation path, thereby improving feedback cancellation. This may be utilized to provide a more open ear piece (as an alternative to the closed ear cup shown in FIG. 1*f*), which is more convenient for the user. In an embodiment, the ear protection device further comprises a direct electric input for enabling a user to receive an audio signal e.g. from a telephone or a music player, the device being adapted for presenting the received audio signal to the user via the output transducer. Such device may instead of an ear protection device constitute a hearing aid or a headphone or a combination thereof (e.g. involving a wired or wireless direct electric audio input). Other applications of an audio processing system as taught by the present disclosure may be in connection with communication devices (e.g. headsets, mobile telephones, etc.), the creation of acoustically quiet zones (e.g. in teleconferencing systems or call centre applications), active cancellation of machine noise, etc. Various aspects of active noise cancelling (including applications) is e.g. discussed in [Kuo et al.; 1999] and [Widrow et al; 1985] (chapter 12). A more general sketch of an active noise control system employing an audio processing system as taught by the present application is shown in FIG. 1*i*.

Figure 1G:
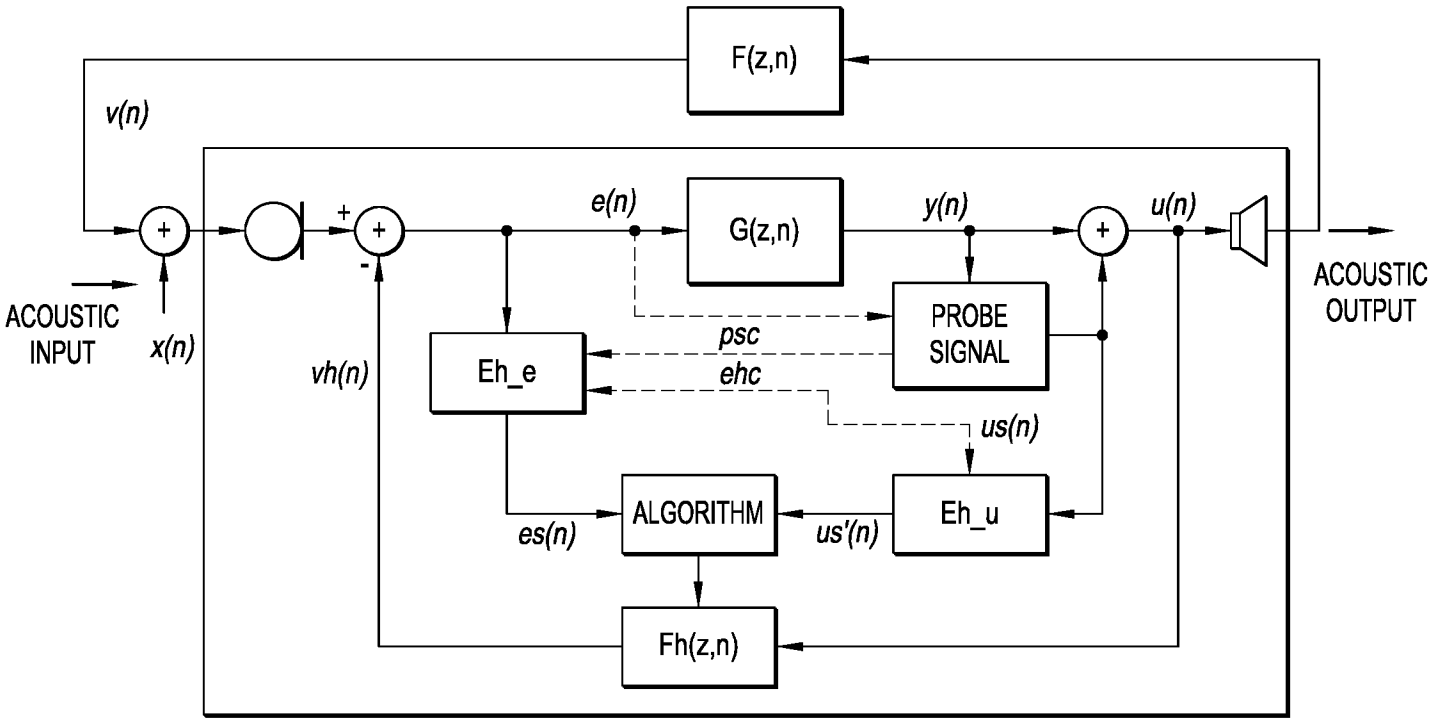
Figure 1H:
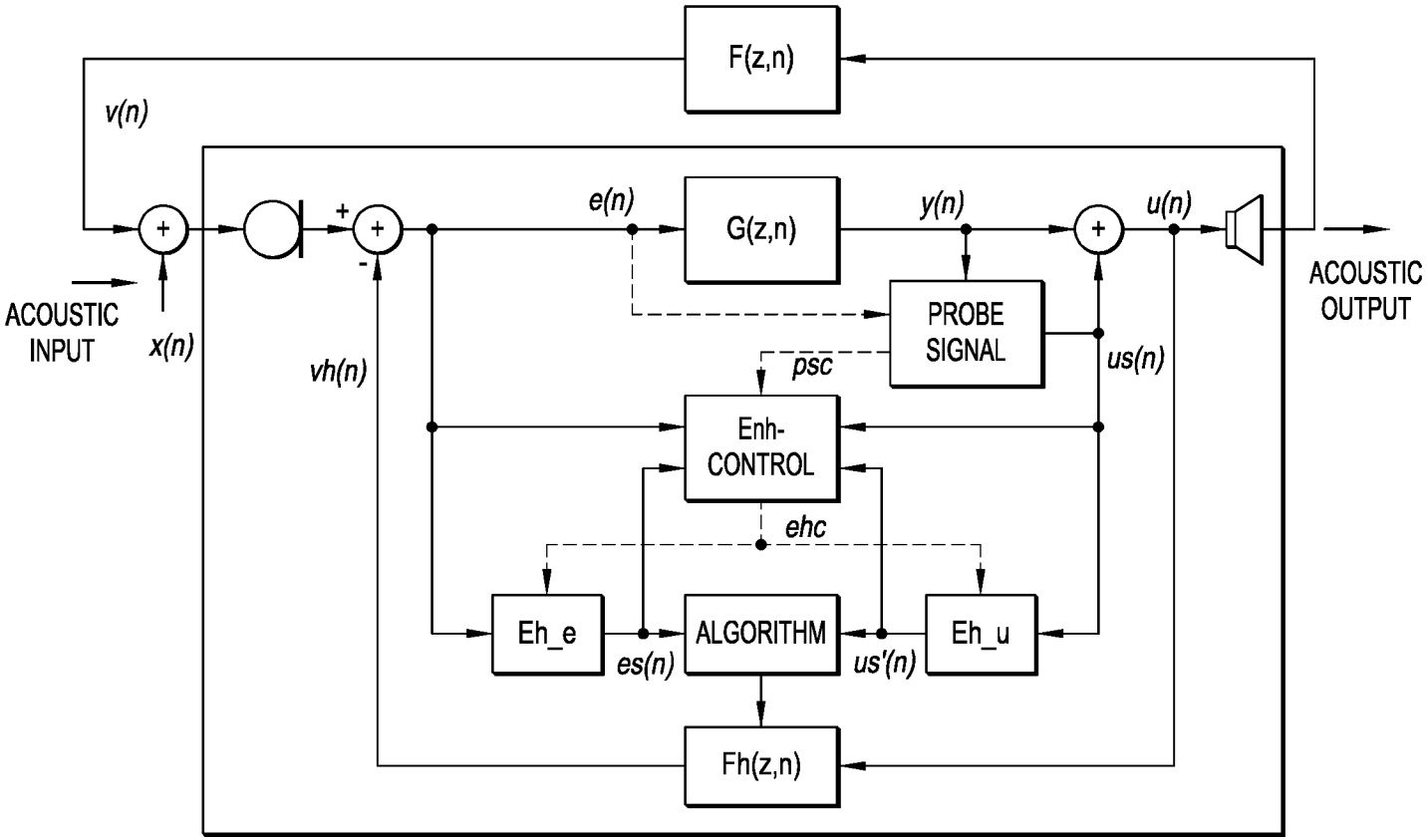
Figure 1I:
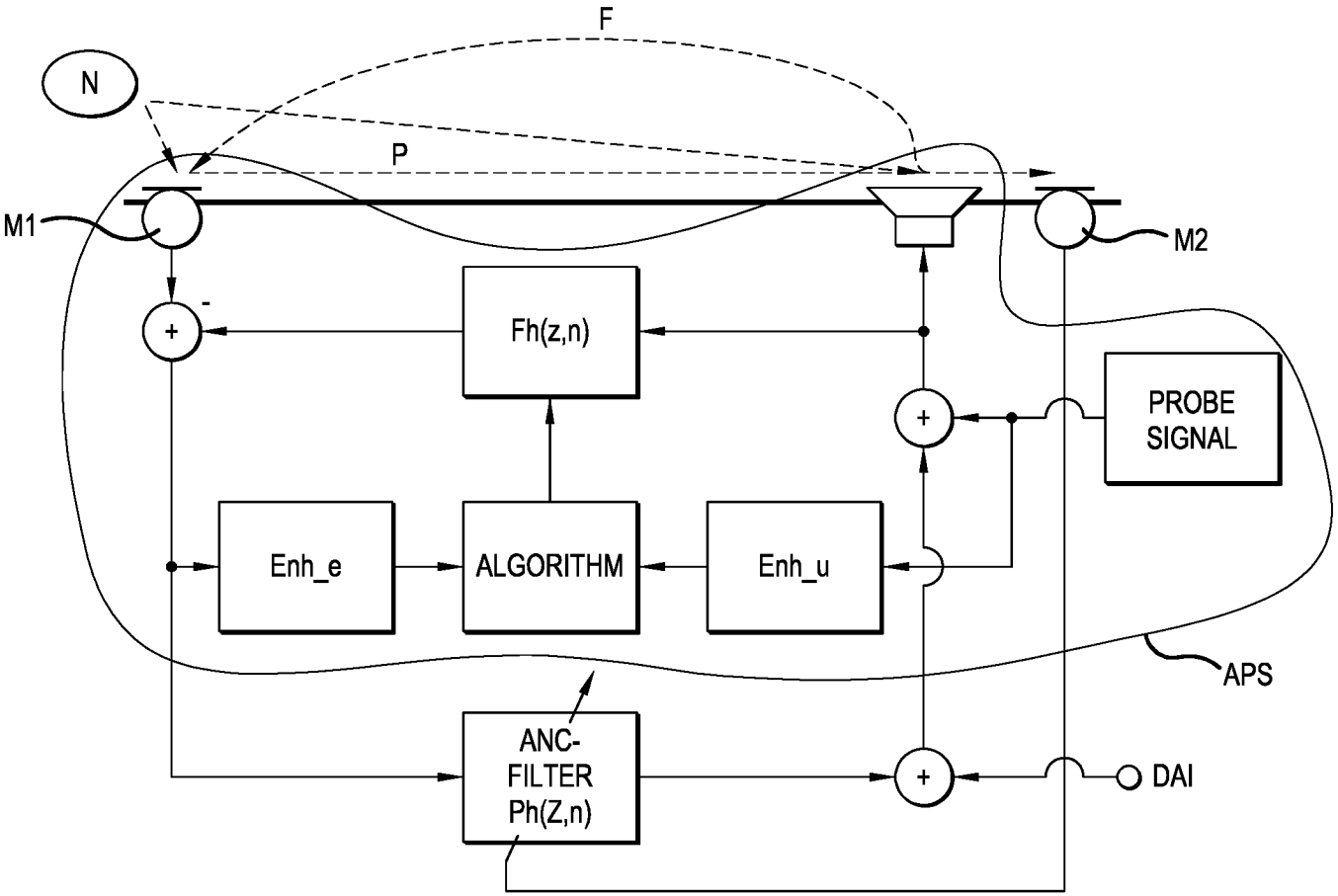

FIG. 1*i* shows a general model of active noise control ANC in the framework of an audio processing system APS as described in the present application. The system shown in FIG. 1*i* is adapted to actively (and here adaptively) cancel noise from a source N by providing an anti-noise acoustic signal that minimizes or cancels the noise signal at the speaker unit AND minimizes the acoustic feedback from the speaker unit to the $1^{st}$ microphone M1 located to pick up sound from the noise source (as indicated by dashed line representing acoustic feedback path F). The audio processing system APS can comprise any of the described embodiments. The embodiment of the audio processing system APS shown in FIG. 1*i* is similar to the embodiment shown in FIG. 1*g*. In a preferred embodiment, the probe signal generator is based on masked noise, see e.g. FIG. 3. The system of FIG. 1*i* comprises an ANC-reference microphone (M1, e.g. forming part of the audio processing system APS, as indicated by the dotted enclosure APS, or being separate there from) for picking of a noise reference signal and for being processed by an adaptive control unit (here adaptive filter ANC-filter Ph(z,n)) to generate an anti-noise signal to be fed to the loudspeaker and intended to minimize the acoustic noise. The system of FIG. 1*i* further comprises an ANC-error microphone (M2) for monitoring the effect of the noise cancellation. The signal picked up by the ANC-error microphone M2 is minimized by the adaptive filter ANC-filter Ph(z,n) to provide an estimate of acoustic path P from ANC-reference microphone M1 to ANC-error microphone M2. The system may be adapted to single channel (wideband) or multi channel operation. The system further comprises an (optional) direct electric input (e.g. a direct (electric) audio input DAI) for enabling, a user to receive an audio signal e.g. from a telephone or a music player, the device being adapted for presenting the received audio signal to the user via the output transducer (here by adding the DAI input signal to the anti-noise signal from the adaptive ANC-filter (ANC-filter Ph(z,n)).

FIG. 1*g* shows an embodiment of an audio processing system with a probe signal generator (Probe signal) similar to that of FIG. 1*c*, but where in addition to the enhancement unit on the input side (in FIG. 1*f* denoted Eh_e) an enhancement unit (denoted Eh_u in FIG. 1*g*) is inserted on the output side as well. The two enhancement units are in communication with each other as indicated by control signal(s) ehc. The enhancement unit Eh_e on the input side is further in communication with the probe signal generator (Probe signal) via signal psc, e.g. regarding information of the characteristics of the probe signal. In an embodiment, the enhancement unit on the output side (Eh_u) is controlled by (matched to) the enhancement unit on the input side (Eh_e). In an embodiment, where the enhancement unit on the input side Eh_e is represented by a filter, the characteristics of the filter (e.g. its filter coefficients) are mirrored in (e.g. copied to) the enhancement unit on the output side Eh_u (via signal(s) ehc) to provide an identical filtering function to that of the enhancement unit on the input side Eh_e. The signal us'(n) resulting from the filtering of the probe signal us(n) by the enhancement unit on the output side Eh_u is fed to the algorithm part (Algorithm) of the adaptive FBC-filter and used to estimate the transfer function of the feedback path together with the signal es(n) generated by the enhancement unit on the input side Eh_e. The use of a 'mirror enhancement unit' Eh_u in the input path of the algorithm part (Algorithm) of the adaptive FBC-filter has the advantage of providing an improved feedback path estimate, especially for small filter delays (cf. e.g. DE(z) of the LTP filter in section 2.2. below).

The probe signal us(n) generated by the probe signal generator (Probe signal) can in general be of any appropriate kind (generating predefined characteristics), as long as the enhancement unit Eh_e on the input side is matched to the probe signal in question (cf. e.g. control signal psc). In an embodiment, the probe signal is based on masked noise.

FIG. 1*h* shows an embodiment of an audio processing system similar to that of FIG. 1*g*, but where a enhancement control unit (Enh-control) determines the optimal settings of parameters (e.g. filter coefficients) of the two enhancement units (here termed Eh_e and Eh_u indicating the location of the units on the input and output side, respectively, of the forward gain unit G(z,n)). The enhancement control unit determines the settings of the two enhancement units based on information of the probe signal and on the signals us(n) (probe signal), us'(n) (output of enhancement unit Eh_u based on probe signal input us(n)), e(n) (the feedback corrected input signal), and es(n) (representing an estimate of characteristics in the feedback corrected input signal e(n) provided by enhancement unit Eh_e). The purpose of the enhancement control unit (Enh-control) is to improve, e.g. optimize, the working conditions of the feedback estimation unit, e.g. by maximizing the ratio between the probe signal and the interfering signal (the interfering signal being all other signal components (including a target speech signal) which are NOT associated with the probe signal).

Examples of embodiments of the invention are provided under the following headlines:

1. Noise Generation and/or Noise Retrieval. Processing of Signal y(n) on Output Side
   - 1.1. Generation of Masked Noise (Method A, FIG. 2*a*)
   - 1.2. Noise Generation by Perceptual Noise Substitution (Method B, FIG. 2*b*)
   - 1.3. Retrieval of Intrinsic Noise (Signal Decomposition, Method C, FIG. 2*c*)
   - 1.4. Combination of Noise Generation and Noise Retrieval Methods A, B, C (FIGS. 2*d*, 2*e*, 2*f*, 2*g*)
     - 1.4.1. Masked Noise (Method A) and Perceptual Noise Substitution (Method B) (FIG. 2*d*)
     - 1.4.2. Masked Noise (Method A) and Extraction of (Intrinsic) Noise-Like Parts (Method C) (FIG. 2*e*)
     - 1.4.3. Perceptual Noise Substitution (Method B) and Extraction of (Intrinsic) Noise-Like Parts (Method C) (FIG. 2*f*)
     - 1.4.4. Masked Noise (Method A), Perceptual Noise Substitution (Method B) and extraction of (intrinsic) noise-like parts (Method C) (FIG. 2*g*)
2. Feedback Noise Retrieval: Processing of Signal d(n) on Input Side
   - 2.1. Masked noise (Method A) and noise retrieval (FIG. 3)
   - 2.2. Noise Retrieval Based on Long Term Prediction (Method I, FIG. 4)
     - 2.2.1. Noise Retrieval Based on Long Term Prediction (Method I) Combined with any Noise Generation Method
   - 2.3. Noise Retrieval Based on Binaural Prediction Filtering (Method II) (FIG. 5.)
     - 2.3.1. Noise Retrieval Based on Binaural Prediction Filtering (Method II) Combined with any Noise Generation Method
3. Combination of Noise Retrieval Methods I, II and C with Noise Generation Methods A, B (FIGS. 4, 5, 6)
   - 3.1. Noise Retrieval Based on Long Term Prediction Filtering (Method I) and Binaural Prediction Filtering (Method II) Combined with Noise Generation Method Based on Masked Noise (Method A)
   - 3.2. Noise Retrieval Based on Long Term Prediction Filtering (Method I), on Binaural Prediction Filtering (Method II), and on Extraction of Intrinsic Noise-Like Signal Components (Method C) Combined with Noise Generation Based on Masked Noise (Method A), and on Perceptual Noise Substitution (Method B)

1. Noise Generation and/or Noise Retrieval. Processing of Signal y(n) on Output Side:

To provide a noise signal us(n), which is uncorrelated with the input signal x(n), we propose a combination of one or more methods (as indicated in the embodiment of FIG. 1*d* by the blocks Probe signals and/or Retrieval of intrinsic noise in combination with Control block):

A) Methods based on masked added noise (Block Probe signals in FIG. 1*d*)

B) Methods based on perceptual noise substitution (Block Probe signals in FIG. 1*d*)

C) Methods based on filtering out intrinsic noise in natural signals (Block Retrieval of intrinsic noise in FIG. 1*d*).

Methods A and B modify the signal y(n) by adding/substituting filtered noise whereas Method C does not modify the signal but simply aims at extracting (retrieving) the signal components which are uncorrelated with the (target) input signal x(n), and which are intrinsically present in the signal y(n) (the 'noise-like part of the signal').

Figure 2A:
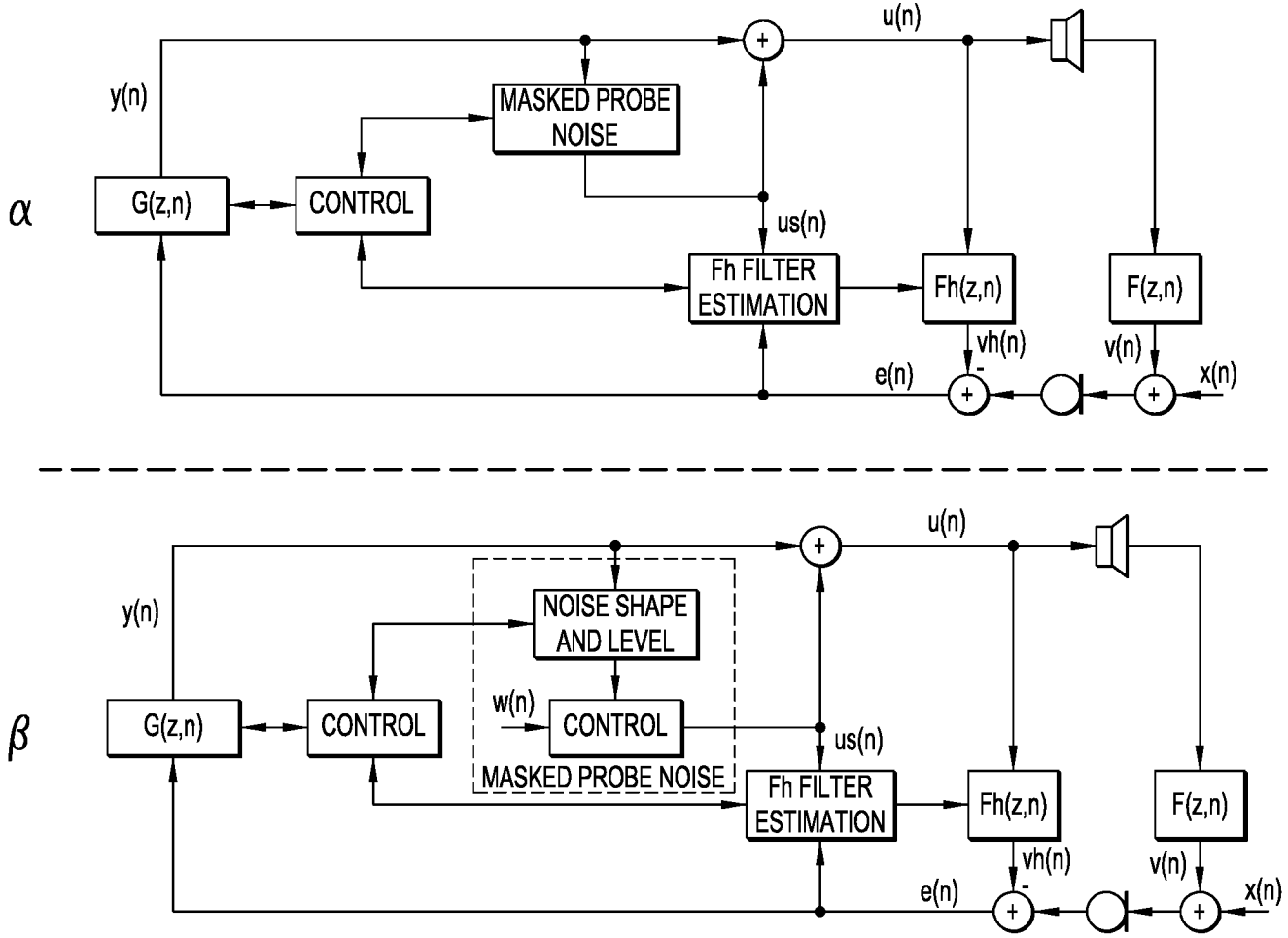
FIG. 2 shows block diagrams of various embodiments of a listening device comprising an adaptive feedback cancellation system based on probe noise or intrinsic noise, one providing adaptive feedback estimation based on masked probe noise (FIG. 2*a*), one providing adaptive feedback estimation based on perceptual noise substitution, PNS (FIG. 2*b*), one providing adaptive feedback estimation based on signal decomposition (intrinsic noise retrieval) (FIG. 2*c*), one providing adaptive feedback estimation based on masked probe noise and perceptual noise substitution (FIG. 2*d*), one providing adaptive feedback estimation based on signal decomposition and masked probe noise (FIG. 2*e*), one providing adaptive feedback estimation based on signal decomposition and perceptual noise substitution (FIG. 2*f*), and one providing adaptive feedback estimation based on signal decomposition, masked probe noise and perceptual noise substitution (FIG. 2*g*)

1.1. Generation of Masked Noise (Method A, FIG. 2*a*):

This method is illustrated by the embodiments of a listening device in FIG. 2*a* (embodiments α and β). The method aims at adding to the signal y(n) on the output side of the forward path a noise sequence us(n) (a sequence with low correlation time), which is uncorrelated with the input signal x(n), to form the receiver signal u(n). The noise sequence us(n) may be generated by filtering a white noise sequence w(n) through an appropriately shaped, time-varying shaping filter M(z,n) in order to achieve a desired noise spectral shape and level. The filter M(z,n) is estimated in block Noise shape and level, based on the signal y(n), cf. embodiment β in FIG. 2*a* as described below. The shaping filter M(z,n) may be found through the use of models of the (possibly impaired) human auditory system, more specifically, using any of the many existing masking models, cf. e.g. [ISO/MPEG, 1993], [Johnston, 1988], [Van de Par et al., 2008].

Ideally, the introduced noise sequence us(n) has the following properties:

P1): us(n) is inaudible in the presence of y(n), that is, u(n)=y(n)+us(n) is perceptually indistinguishable from y(n).

P2): us(n) is uncorrelated with x(n), i.e., $E us(n)\cdot x(n+k)=0$ for all k. This makes it in principle possible to completely by-pass the AC-problem.

P3): The correlation time $N_0$ of us(n) does not exceed dG+dF, where dG, dF denote the forward and feedback delay, respectively. That is, us(n) is uncorrelated with itself delayed by an amount corresponding to the combined delay of the feedback path and the forward path, i.e., $E us(n)us(n-\tau)=0$ for $\tau>dG+dF$.

Furthermore, dependent on which version of the Retrieval of feedback noise algorithm is used, see FIG. 1*d*, (details of the different versions of this block are given below), the following additional noise property is preferably obeyed by the noise sequence us(n):

P4): The correlation time $N_0$ of the noise sequence us(n) obeys $N_0<dG+dF$, i.e. a slight strengthening of requirement P3.

In principle, it is possible to generate a probe noise sequence us(n) with these characteristics. The well-known problem, however, is that the level of the probe noise should preferably be low, e.g. at least 15 dB below u(n) (y(n)) on average, for requirement P1 to be approximately valid (for normally hearing persons), but probably quite a bit more for requirements P3 and P4 to be valid in a low-delay setup, like e.g. a hearing aid.

In the embodiment in FIG. 2*a* denoted α, the processed output signal y(n) from the forward path unit G(z,n) (e.g. providing signal processing to compensate for a hearing loss) is connected to the block Masked probe noise for generating a masked noise based on a model of the human auditory system (which is fully or partially implemented in this block or more specifically in block Noise shape and level in embodiment β of FIG. 2*a*). The masked noise output us(n) of the block Masked probe noise is connected to the Fh filter Estimation unit for estimating the feedback path F. The masked noise output us(n) is further added to the processed output signal y(n) from the forward path unit G(z,n) in SUM-unit '+' providing output signal u(n), which is connected to the output transducer (receiver) and to the variable filter part Fh(z,n) of the adaptive FBC-filter. The output of the variable filter part Fh(z,n) providing an estimate vh(n) of the feedback signal v(n) is subtracted from the input signal from the microphone in SUM-unit '+', whose output e(n) is connected to the input of the forward path unit G(z,n) and to the Fh filter estimation unit. The error signal e(n) is ideally equal to the target signal x(n), which is added to the feedback signal v(n) in the microphone, so that the input signal from the microphone is equal to x(n)+v(n) and thus e(n)=x(n)+v(n)−vh(n). The Control unit is in one- or two-way communication with the forward path unit G(z,n), the Masked probe noise unit and the Fh filter estimation unit, e.g. to monitor and adjust the operation of the adaptive filter in the Fh filter estimation block (e.g. including an adaptation rate).

The embodiment in FIG. 2*a* denoted β is identical to the embodiment denoted α as described above, except—as indicated by the dotted rectangle—that the Masked probe noise unit is implemented by shaping filter unit M(z,n), which is estimated by Noise shape and level unit based on input y(n) from the forward path unit G(z,n). The masked noise us(n) is provided by the shaping filter unit M(z,n) based on a white noise sequence input w(n) and filter coefficients as determined by the Noise shape and level unit based on a model of the human auditory system (which is fully or partially implemented in this block). White noise is in the present context taken to mean a random signal with a substantially flat power spectral density (in the meaning that the signal contains substantially equal power within a fixed bandwidth when said fixed bandwidth is moved over the frequency range of interest, e.g. a part of the human audible frequency range). The white noise sequence may e.g. be generated using pseudo random techniques, e.g. using a pseudo-random binary sequence generator (with a large repetition number $N_{psr}$, e.g. $N_{psr} \geqq 1000$ or $\geqq 10000$). The Control unit is in one- or two-way communication with the forward path unit G(z,n), the Noise shape and level unit and the Fh filter Estimation unit (as in embodiment α).

1.2. Noise Generation by Perceptual Noise Substitution (Method B, FIG. 2*b*):

This method is similar in nature to Method A. We propose here another algorithm, though, called Perceptual Noise Substitution (PNS), for generating an imperceptible noise sequence, which is uncorrelated with the input signal x(n). Like Method A, the algorithm is embodied in block Probe signals in FIG. 1*d*. The algorithm may be seen as a complement (or an alternative) to the added masked noise solution described above. The method is illustrated by the embodiments of a listening device shown in FIG. 2*b* (embodiments α and β). The general goal is to process the signal y(n) so as to ensure that the receiver signal u(n) is uncorrelated to the (target) input signal x(n), at least in certain frequency regions. To achieve this, the idea is to substitute selected Spectral regions of the output signal y(n) of the forward path unit G(z,n) (cf. signal y(n) in FIGS. 1*d* and 2*b*) with filtered noise sequences and thereby ensure a degree of (un-) correlation in the frequency regions in question. Thus, rather than adding a low-level noise sequence as with Method A above, we propose here to completely substitute entire time frequency ranges or tiles of the receiver signal. Denoting by ups(n) the (filtered) noise sequence substituting parts of y(n) (cf. FIG. 2*b*), the requirements to ups(n) are identical to those outlined for Method A (cf. P1, P2, P3, and optionally P4 above).

The advantage of the proposed procedure is that the desired noise-to-signal ratio in the substituted signal regions is high, much higher than what can typically be achieved with other probe noise solutions. Obviously, since the modified receiver input signal u(n) ideally should be perceptually indistinguishable (for a particular user) from the original signal y(n), not all time-frequency ranges or tiles can be substituted at all times. Several possibilities exist for deciding which ranges or tiles can be substituted without perceptual consequences. One is to compare the original and the modified signal using a perceptual model, e.g. a simplified version of the model in [Dau et al., 1996], and let the model predict the detectability of the modification. Another is to use a masking model as in Method A to decide on spectral regions of low sensitivity. Other, simpler and probably less accurate, methodologies based on the log-spectral distortion measure (see e.g. [Loizou, 2007]) could be envisioned.

Figure 2B:
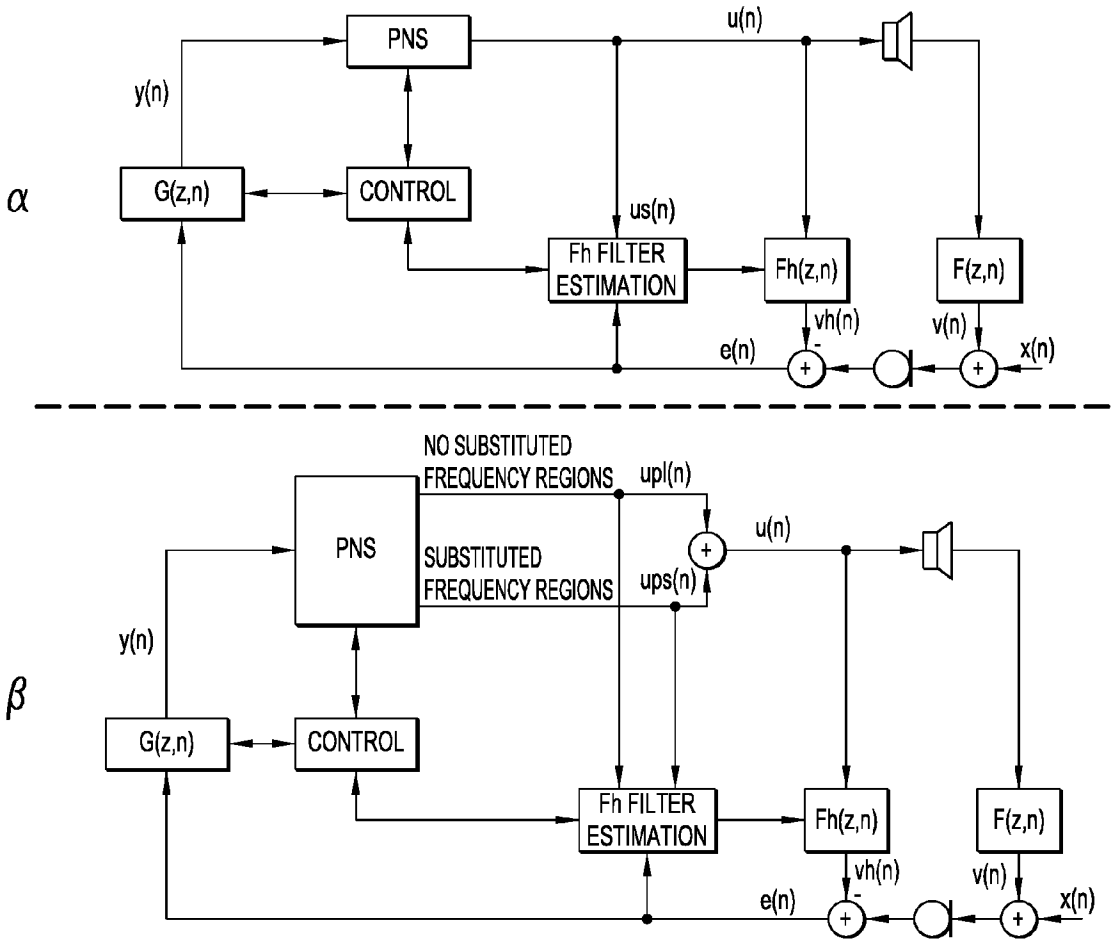

In the embodiment in FIG. 2*b* denoted α, the processed output signal y(n) from the forward path unit G(z,n) (e.g. providing signal processing to compensate for a hearing loss) is connected to the block PNS for providing Perceptual Noise Substitution, including substituting selected bands of the signal y(n) with filtered noise, to form the output signal u(n). The selection of appropriate bands for substitution is controlled by the Control unit as indicated above (e.g. based on a perceptual model, masking model, etc.). The Control unit is further in communication with the forward path unit G(z,n) and also controls the generation of filter coefficients for the variable filter part Fh(z,n) by the Fh filter Estimation unit. The Fh filter estimation unit receives its inputs from the output signal u(n) (receiver input signal containing imperceptible noise in selected bands) and from the feedback corrected input signal e(n), respectively. Apart from that, the embodiment α of FIG. 2*b* comprises the same functional units connected in the same way as in the embodiment α of FIG. 2*a*.

The embodiment in FIG. 2*b* denoted β is largely identical to the embodiment denoted α as described above. In embodiment β, however, two outputs of the PNS unit are shown, a first PNS-output upl(n) denoted No substituted frequency regions and comprising frequency bands that have been left unaltered and a second PNS-output ups(n) denoted Substituted frequency regions and comprising frequency bands comprising substituted frequency regions that are ideally substantially uncorrelated to the (target) input signal x(n). The two output signals upl(n) and ups(n) from the PNS unit are combined in SUM unit '+' to provide the output signal u(n), which is connected to the receiver and to the variable filter part Fh(z,n) of the adaptive FBC-filter. Both output signals upl(n) and ups(n) from the PNS unit are connected to the Fh filter estimation unit for—together with the feedback corrected input signal e(n)—generating filter coefficients for the variable filter part Fh(z,n) (possibly influenced by the Control unit) providing feedback estimate signal vh(n).

Figure 2C:
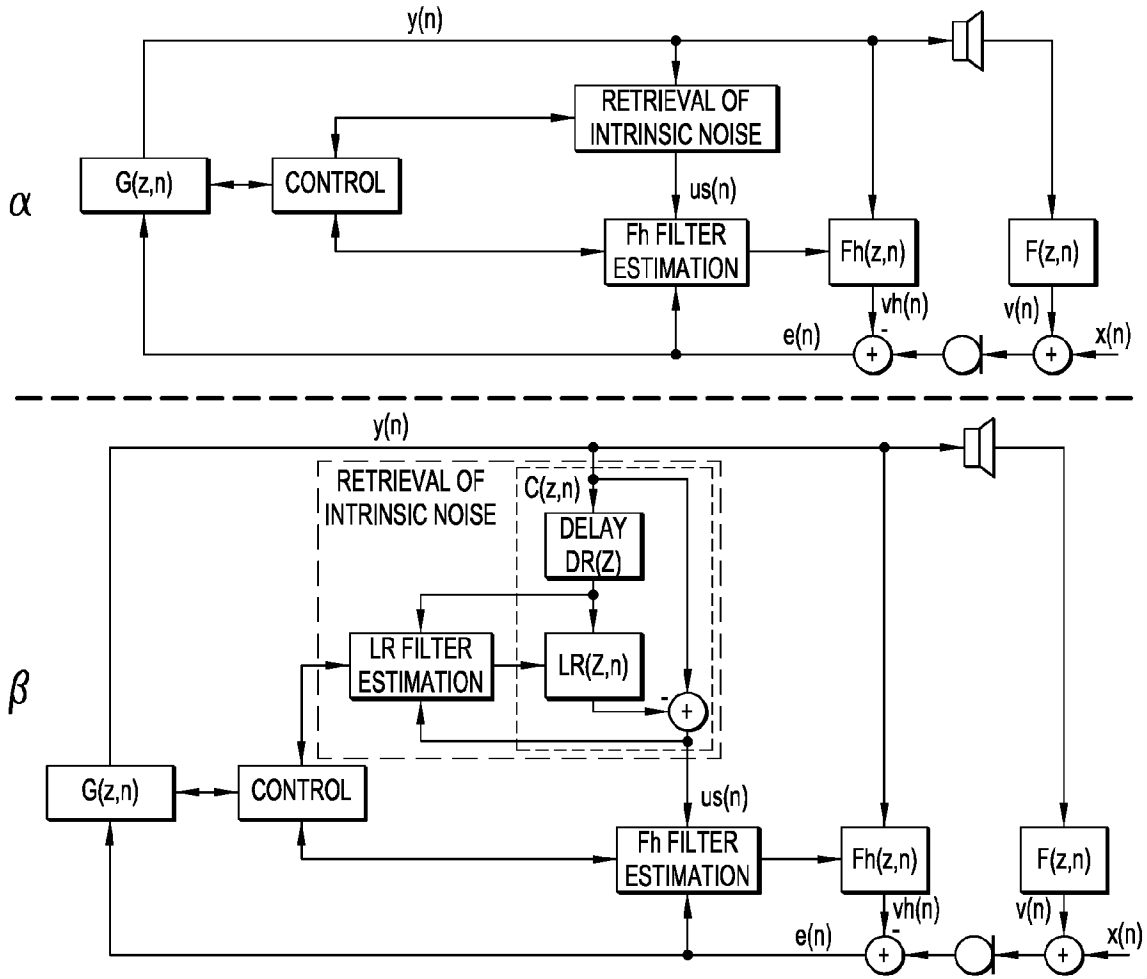

1.3. Retrieval of Intrinsic Noise (Signal Decomposition, Method C, FIG. 2*c*):

This method is illustrated by the embodiments of a listening device according to the invention shown in FIG. 2*c* (embodiments α and β). The method differs from methods A and B in that it does not modify the output signal y(n) from the forward path unit G(z,n) (so y(n)=u(n)). Rather, it filters the signal y(n) in order to identify components intrinsically present in y(n) which are uncorrelated with the input signal x(n). The basic idea here is to observe that the signal y(n) is approximately a (scaled) version of the input signal x(n), delayed by dG samples, dG being the delay of the forward path (in units of the sampling time $T_s=1/f_s$). Consequently, components of y(n) with a correlation time shorter than dG are approximately uncorrelated with x(n). Thus, the identified signal components (us(n)) of y(n) should preferably obey property P2 discussed above in connection with generation of masked noise: P2): us(n) is uncorrelated with x(n), i.e., Eus(n)·x(n+k)=0 for all k, and additionally:

P5) The correlation time $N_1$ of the extracted sequence us(n) obeys $N_1 \leqq dG$.

The signal components with low correlation time, i.e. noise or noise-like signal parts, which are intrinsically present in y(n) are extracted and the corresponding signal connected to the Fh filter estimation block (cf. FIG. 2*c*). The extraction is performed in the Retrieval of intrinsic noise block of FIG. 2*c*. The intrinsic noise components are understood to be parts of the signal y(n) which are noisy in character (although, the signal y(n) is not noisy in traditional sense). More specifically, the noise-like signal parts comprising components with low correlation time in (otherwise noise-free) speech signals could be speech sounds like /s/ and /f/. In the case where the signal y(n) is noisy in a traditional sense, e.g. due to acoustical noise in the environment or due to microphone noise (or to a deliberately inserted probe signal from a probe signal generator), these components would also be extracted by the Retrieval of intrinsic noise block and in that case the output of the block would be a combination of traditional acoustic noise and intrinsic noise in the target signal (and possibly probe noise). The Retrieval of intrinsic noise block can be implemented using an adaptive filter, e.g. an adaptively updated FIR filter with the following z-transform (cf. e.g. FIG. 2*c*, embodiment β):

$$\begin{aligned} C(z,n) &= 1 - DR(z) \times LR(z,n) \\ &= 1 - z^{-N_1} \times \sum_{p=0}^{P_1} c_{p+N_1} z^{-p} \\ &= 1 - \sum_{p=N_1}^{N_1+P_1} c_p z^{-p}, \end{aligned}$$

where C(z,n) represents the resulting filter, $DR(z)=z^{-N1}$ represents a delay corresponding to $N_1$ samples, LR(z,n) represents the variable filter part, $N_1$ is the maximum correlation time, and $c_p$ are the filter coefficients, where $P_1$ is the order of LR(z,n).

The filter coefficients $c_p$ are updated across time in order to minimize the variance of the output, us(n), i.e. adapted to minimize $\epsilon[|us(n)|^2]$, where ϵ is the expected value operator. By doing so, components of the input signal having a correlation time longer than $N_1$ are reduced. Typically, $N_1$ is chosen as $N_1$=dG, the delay of the forward path (dG), preferably including an average acoustic propagation delay from receiver to microphone. The updating of the filter coefficients $c_p$ may e.g. be performed using any of the well-known adaptive filtering algorithms, including (normalized) LMS, RLS, etc., cf. LR filter estimation unit in FIG. 2*c* (β).

In the embodiment in FIG. 2*c* denoted α, the processed output signal y(n) from the forward path unit G(z,n) (providing signal processing) is connected to the enhancement unit Retrieval of intrinsic noise as well as to the receiver (thereby constituting the output (receiver input) signal). The Retrieval of intrinsic noise unit extracts the noise-like part us(n) of the output signal y(n), e.g. as indicated above. The noise-like signal us(n) is connected to the Fh filter estimation unit, which provides filter coefficients for the variable filter part Fh(z,n) estimating the feedback signal v(n). The Control unit is in one- or two-way communication with the forward path unit G(z,n), the Retrieval of (intrinsic) noise unit and the Fh filter estimation unit. Apart from that, the embodiment α of FIG. 2*c* comprises the same functional units (G(z,n), Fh(z,n), F(z,n), microphone and receiver units) connected in the same way as the embodiment α of FIG. 2*a*.

The embodiment in FIG. 2*c* denoted β is identical to the embodiment denoted α as described above, except that the enhancement unit Retrieval of intrinsic noise is implemented by a Delay DR(z) unit, an LR filter estimation unit, an LR(z,n) variable filter unit and a SUM unit '+' (as indicated by the dotted rectangle enclosing these units). The filter C(z,n) described above is implemented by the components Delay DR(z), LR(z,n) and SUM unit '+' enclosed by the dashed rectangle and denoted C(z,n). The Delay DR(z) unit receives as an input the output signal y(n) from the forward path unit G(z,n) (which here is equal to the receiver input signal) and provides an output representing a delayed version of the input (e.g. with a delay corresponding to the delay of the forward path unit G(z,n)), which is connected to the LR filter estimation unit as well as to the variable filter unit LR(z,n). The output of the variable filter unit LR(z,n) is subtracted from the output signal y(n) from the forward path unit G(z,n) in SUM unit '+', whose output represents the noise-like part us(n) of the output signal y(n) predicted based on previous samples of y(n). The noise-like part us(n) of the output signal y(n) is connected to the LR filter estimation unit and used in the calculation of filter coefficients for the variable filter unit LR(z,n) as well as to the Fh filter estimation unit of the feedback cancellation system and used in the calculation of filter coefficients for the variable filter unit Fh(z,n). The Control unit is in one- or two-way communication with the forward path unit G(z,n) and the two (LR- and Fh-) filter estimation units.

1.4. Combination of Noise Generation and Noise Retrieval Methods A, B, C (FIGS. 2*d*, 2*e*, 2*f*, 2*g*):

The noise generation or retrieval methods A, B and C may be mutually combined in any appropriate way (and with possible other schemes for generating appropriate noise sequences and possible other schemes for retrieving noise). In the embodiments shown, noise is typically added to the forward path on the output side (in the examples shown, after the forward path gain unit G(z,n)). In practice, this need not be the case. The noise generator(s) may insert noise-like signal parts at any appropriate location of the forward path, e.g. on the input side (before the forward path gain unit G(z,n)) or in the forward path gain unit G(z,n) or at several different locations of the forward path.

Figure 2D:
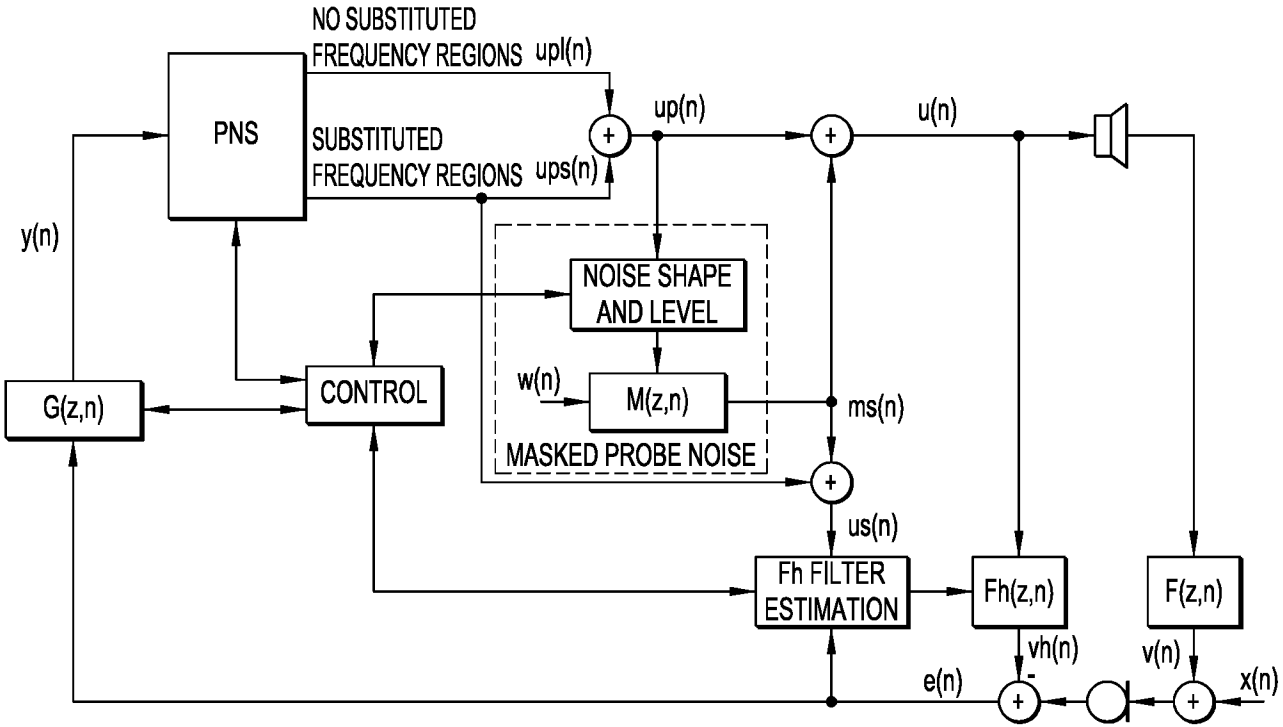

1.4.1. Masked Noise (Method A) and Perceptual Noise Substitution (Method B) (FIG. 2*d*):

FIG. 2*d* illustrates a model of an embodiment of a listening device, wherein noise generation Method A (masked noise) and B (perceptual noise substitution) are used in combination. In the embodiment of FIG. 2*d*, the output signal y(n) of the forward path gain unit G(z,n) is connected to a PNS unit that (controlled by the Control unit) substitutes selected spectral regions of the output signal y(n) (e.g. with spectral content comprising noise-like signal components) and provides an output signal up(n) that is substantially uncorrelated to the (target) input signal x(n), at least in certain frequency regions. In the embodiment of FIG. 2*d*, the output up(n) from the PNS unit is represented by two outputs (as also in FIG. 2*b*), a first PNS-output upl(n) denoted No substituted frequency regions and comprising frequency bands that have been left unaltered and a second PNS-output ups(n) denoted Substituted frequency regions and comprising frequency bands comprising substituted frequency regions that are ideally substantially uncorrelated to the (target) input signal x(n). The two output signals upl(n) and ups(n) from the PNS unit are combined in SUM unit '+' to provide the output signal up(n). The output signal up(n) is connected to a masked noise generator (indicated by dotted rectangle denoted Masked probe noise) comprising a Noise shape and level unit for estimating the time-varying shaping filter M(z,n), which filters a white noise sequence w(n) and provides as an output the masked noise signal ms(n). The masked noise signal ms(n) is added to the second output ups(n) from the PNS unit in SUM unit '+' whose output us(n) is used together with the feedback corrected input signal e(n) as inputs to Fh filter estimation unit for generating filter coefficients for the variable filter part Fh(z,n) for estimating the feedback path. The Fh filter estimation unit is in communication with the Control unit, which is also connected to the Noise shape and level unit, to the forward path gain unit G(z,n) and to the PNS-unit. The masked noise signal ms(n) is further added to the (combined) output signal up(n) from the PNS unit in SUM unit '+' whose output signal u(n) is connected to the receiver and converted to an acoustic signal as well as to the variable filter part Fh(z,n) of the adaptive FBC-filter. The feedback corrected input signal e(n) is further, as in other embodiments, connected to the forward path gain unit G(z,n). The output and input transducers, feedback F(z,n) and feedback estimation Fh(z,n) paths and signals v(n), vh(n) and x(n) have the same meaning as described in connection with other embodiments of the invention (e.g. FIG. 2*a*).

The masked noise generation method (Method A, FIG. 2*a*) and the perceptual noise substitution method (Method B, FIG. 2*b*) and functional units for implementations thereof are further discussed above. Details of masking of noise and perceptual noise substitution are e.g. discussed by [Painter et al., 2000].

Figure 2E:
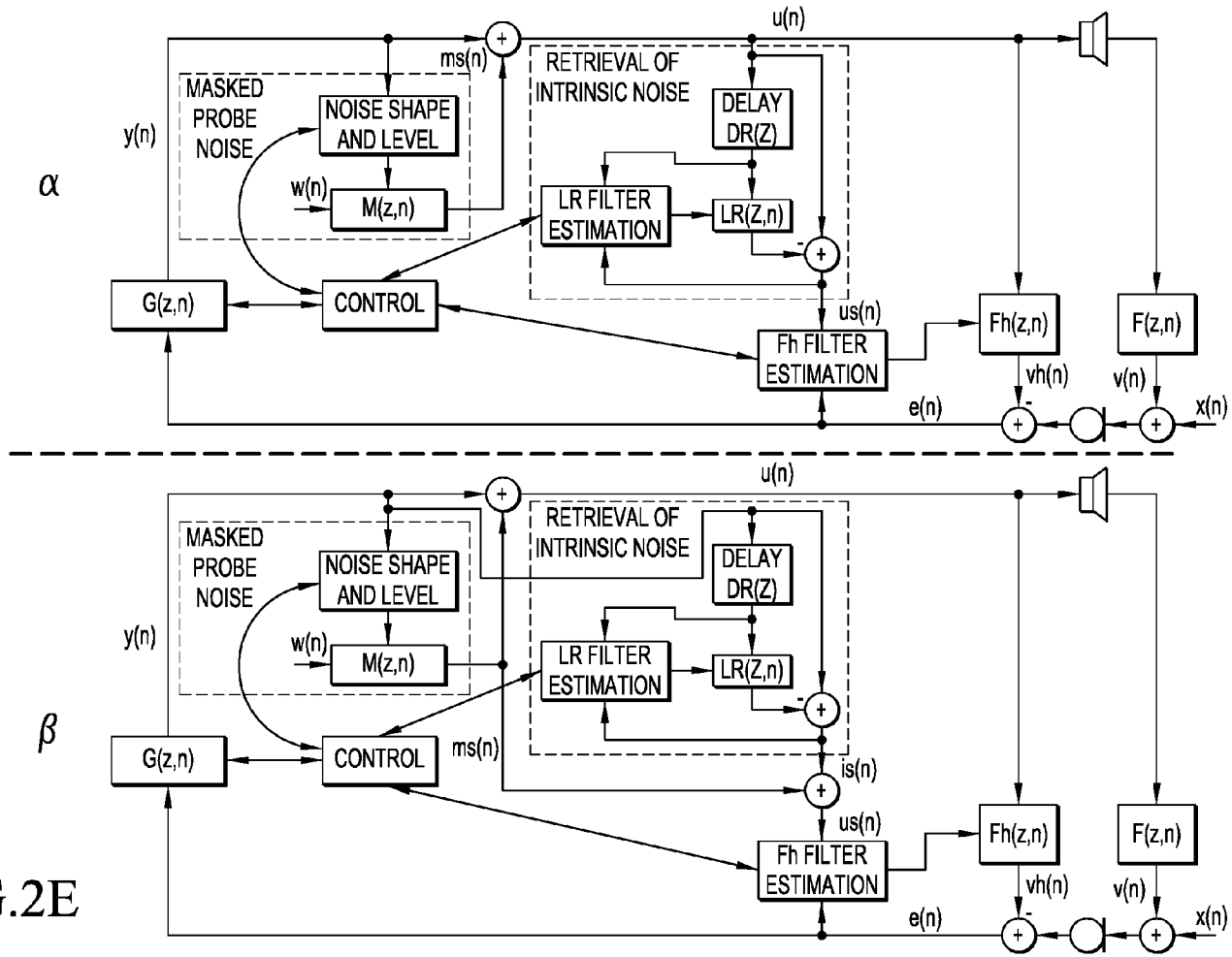

1.4.2. Masked Noise (Method A) and Extraction of (Intrinsic) Noise-Like Parts (Method C) (FIG. 2*e*):

FIG. 2*e* illustrates block diagrams of two embodiments of a listening device according to the invention, wherein noise generation Method A (masked noise) and C (extraction of intrinsic noise-like parts) are used in combination. In the embodiment α of FIG. 2*e*, the output signal y(n) of the forward path gain unit G(z,n) is connected to a masked noise generator (indicated by dotted rectangle denoted Masked probe noise, cf. also FIG. 2*a* and the discussion above) comprising Noise shape and level unit (controlled by a Control unit) for estimating time-varying shaping filter M(z,n), which filters white noise sequence w(n) and provides as an output the masked noise signal ms(n), which is added to the output signal y(n) of the forward path gain unit in SUM unit '+' to provide output signal u(n), which is connected to the receiver. The output signal u(n) comprising masked noise is connected to an enhancement unit for retrieval of noise-like signal parts from the input signal (indicated by dotted rectangle denoted Retrieval of intrinsic noise, cf. also FIG. 2*c* and the discussion of Method C above). The unit for retrieval of intrinsic noise-like signal parts comprises a Delay DR(z) unit, an LR Filter estimation unit, an LR(z,n) variable filter unit and a SUM unit '+'. The Delay DR(z) unit receives as an input the output signal u(n) and provides an output representing a delayed version of u(n), which is connected to the LR Filter estimation unit as well as to the variable filter unit LR(z,n). The output of the variable filter unit LR(z,n) is subtracted from the output signal u(n) in SUM unit '+', whose output represents the noise-like parts us(n) (masked as well as intrinsic) of the output u(n). The noise-like signal us(n) is connected to the LR Filter estimation unit as well as to the Fh filter estimation unit of the feedback cancellation system and used in the calculation of filter coefficients for the variable filter units LR(z,n) and Fh(z,n), respectively. The Control unit is in one- or two-way communication with the two (LR- and Fh-) Filter estimation units, with the Noise shape and level unit of the Masked probe noise generator and with the forward path gain unit G(z,n). The feedback corrected input signal e(n) is used as a second input to the Fh filter estimation unit and is further, as in other embodiments, connected to the forward path gain unit G(z,n). The output and input transducers, feedback F(z,n) and feedback estimation Fh(z,n) paths and signals v(n), vh(n) and x(n) have the same meaning as described in connection with other embodiments of the invention (e.g. FIG. 2*a*).

Embodiment β of FIG. 2*e* is largely identical to embodiment a of FIG. 2*e*. The two embodiments differ in that in embodiment β of FIG. 2*e* the input to the Retrieval of intrinsic noise unit is the output y(n) from the forward path gain unit G(z,n). This means that the noise retrieval unit extracts noise-like parts is(n) of the output signal (y(n)) before a (masked) probe signal (ms(n)) has been added. Consequently, the masked noise signal ms(n) is added to the output is(n) of the Retrieval of intrinsic noise unit to provide the resulting noise estimate us(n), which is connected to the Fh filter estimation unit (as in embodiment α). This has the advantage that the Retrieval of intrinsic noise unit does not have to extract the noise-like parts of the signal that originated from the inserted probe noise.

The masked noise generation method (Method A, FIG. 2*a*) and signal decomposition method comprising extraction of noise-like parts (Method C, FIG. 2*c*) and functional units for implementations thereof are further discussed above.

Figure 2F:
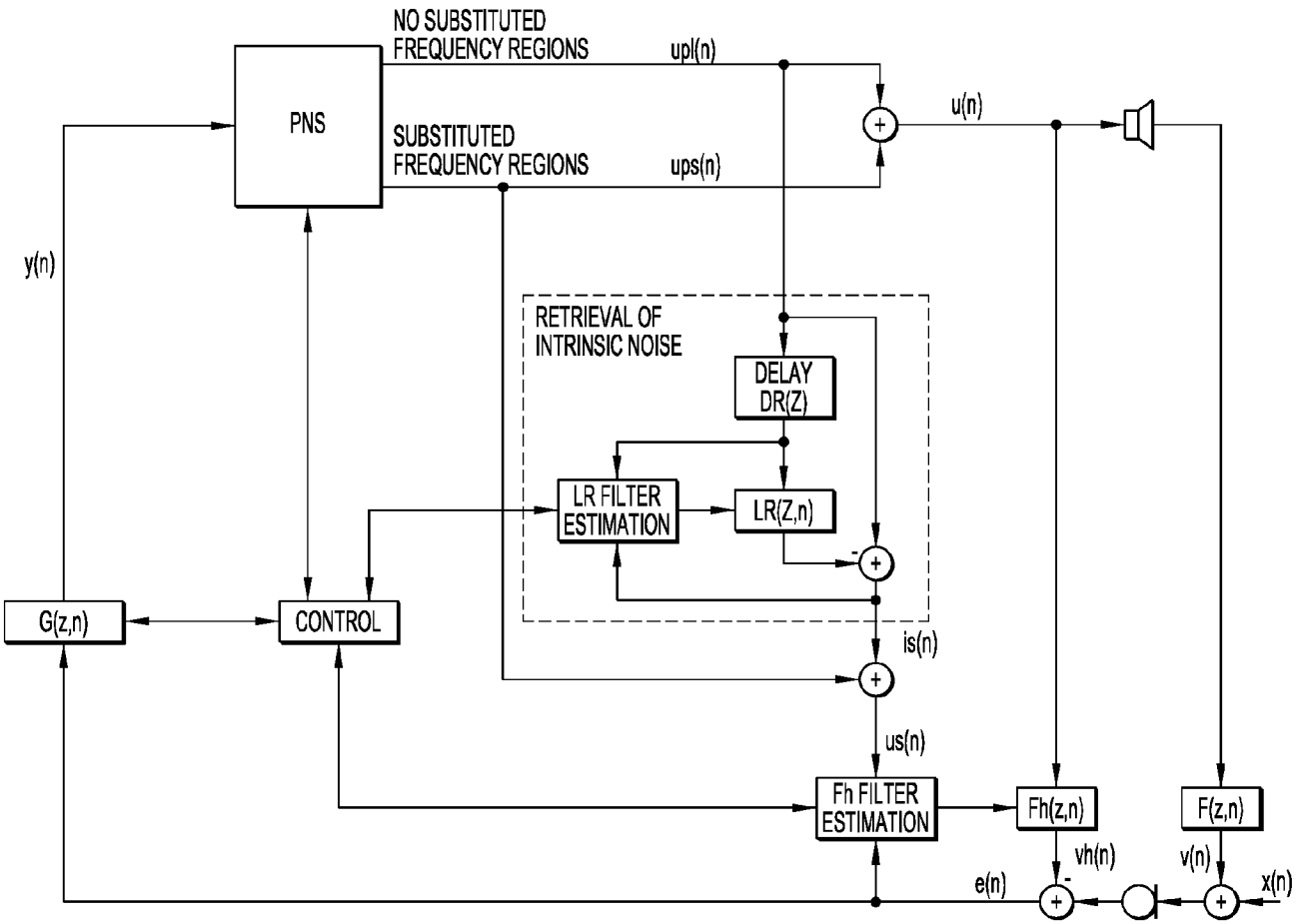

1.4.3. Perceptual Noise Substitution (Method B) and Extraction of (Intrinsic) Noise-Like Parts (Method C) (FIG. 2*f*):

FIG. 2*f* illustrates a model of an embodiment of a listening device according to the invention, wherein noise generation Method B (perceptual noise substitution) and C (extraction of (intrinsic) noise-like parts) are used in combination. In the embodiment of FIG. 2*f*, the output signal y(n) of the forward path gain unit G(z,n) is connected to a PNS unit that (controlled by the Control unit) substitutes selected spectral regions of the output signal y(n) and provides a first output signal upl(n) comprising frequency parts that have been left unaltered (output signal No substituted frequency regions in FIG. 2*f*) and a second output signal ups(n) comprising frequency parts that have been substituted with spectral content comprising noise-like signal components (output signal Substituted frequency regions in FIG. 2*f*) that are substantially uncorrelated to the (target) input signal x(n). The two output signals from the PNS unit are combined in SUM unit '+' to provide the output signal u(n), which is connected to the receiver and to the variable filter part Fh(z,n) of the adaptive FBC-filter. The output signal upl(n) from the PNS unit comprising frequency ranges that has been left unaltered is connected to an enhancement unit denoted Retrieval of intrinsic noise enclosed by a dotted rectangle in FIG. 2*f* and comprising a Delay DR(z) unit, an LR filter estimation unit, an LR(z,n) variable filter unit and a SUM unit '+' (cf. FIG. 2*c* and the discussion of Method C above), which are adapted for estimating the (intrinsic) noise-like parts of the output signal upl(n) from the PNS unit. The output signal is(n) of the Retrieval of intrinsic noise unit (the output of the SUM unit '+' in the dotted rectangle) is connected to a further SUM unit '+' together with the other output signal ups(n) of the PNS unit comprising the frequency parts that have been substituted with spectral content comprising noise-like signal components. The output of this further SUM unit thus represents the estimate us(n) of the noise-like signal parts of the output signal u(n). The estimate us(n) is connected to the Fh filter estimation unit together with the feedback corrected input signal e(n) and used to update the variable filter part Fh(z,n) of the adaptive FBC-filter for estimating the feedback signal v(n). The LR- and Fh-filter estimation units can be influenced via the Control unit, which can also influence and/or receive information from forward path gain unit G(z,n) and the PNS unit. The feedback corrected input signal e(n) is further, as in other embodiments, connected to the forward path gain unit G(z,n). The output and input transducers, feedback F(z,n) and feedback estimation Fh(z,n) paths and signals v(n), vh(n) and x(n) have the same meaning as described in connection with other embodiments of the invention (e.g. FIG. 2*a*).

The perceptual noise substitution method (Method B, FIG. 2*b*) and the signal decomposition method comprising extraction of noise-like parts (Method C, FIG. 2*c*) and functional units for implementations thereof are further discussed above.

Figure 2G:
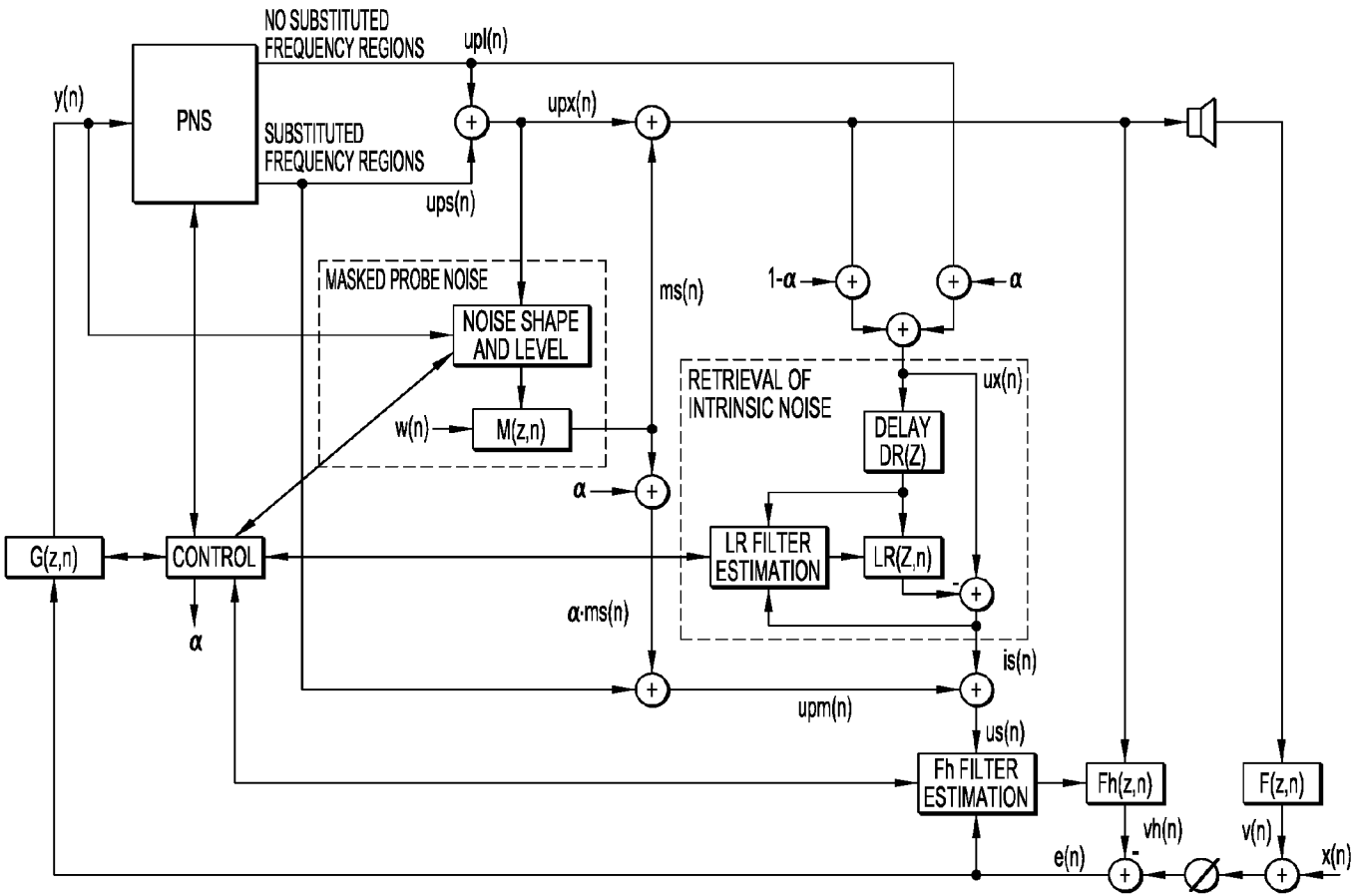

1.4.4. Masked Noise (Method A), Perceptual Noise Substitution (Method B) and Extraction of (Intrinsic) Noise-Like Parts (Method C) (FIG. 2*g*):

FIG. 2*g* illustrates a model of an embodiment of a listening device according to the invention, wherein noise generation Method A (masked noise), Method B (perceptual noise substitution) and noise retrieval Method C (extraction of (intrinsic) noise-like parts) are used in combination. In the embodiment of FIG. 2*g*, the output signal y(n) of the forward path gain unit G(z,n) is connected to a PNS unit that (controlled by the Control unit) substitutes selected spectral regions of the output signal y(n) and provides a first output signal upl(n) comprising frequency parts that have been left unaltered (output signal No substituted frequency regions in FIG. 2*g*) and a second output signal ups(n) comprising frequency parts that have been substituted with spectral content comprising noise-like signal components (output signal Substituted frequency regions in FIG. 2*g*) providing frequency regions that are substantially uncorrelated to the (target) input signal x(n). The first and second output signals from the PNS unit are combined in SUM unit '+' and the resulting combined signal upx(n) is connected to a further SUM unit '+' and to a masked noise generator (as indicated by a dotted rectangle denoted Masked probe noise, cf. also FIG. 2*a* and the discussion above) comprising Noise shape and level unit (controlled by a Control unit) for estimating time-varying shaping filter M(z,n), which filters white noise sequence w(n) and provides as an output the masked noise signal ms(n), which is added to the combined output signal upx(n) from the PNS unit in further SUM unit '+' to provide output signal u(n), which is connected to the receiver. The Noise shape and level unit further receives input signal y(n) from the forward path gain unit G(z,n). The purpose of this is to enable the Masked probe noise unit to operate on the forward path signal before (y(n)) or after (upx(n)=upl(n)+ups(n)) perceptual noise substitution (controlled by the Control unit). The Noise shape and level unit may further receive information from the Control unit regarding which bands have been subject to perceptual noise substitution in the PNS unit, which may advantageously influence the generation of masking noise. The masked noise signal output ms(n) of shaping filter M(z,n) is further connected to a gain factor unit for applying gain factor $\alpha$ to the masked noise signal ms(n). The gain factor $\alpha$ can in general take on any value between 0 and 1. In a preferred embodiment, $\alpha$ is equal to 1 or 0, controlled by the Control unit (cf. output $\alpha$). The output $\alpha\cdot$ms(n) of gain factor unit 'x' is added to the output signal ups(n) from the PNS unit (comprising substituted frequency regions) in SUM unit '+' providing output signal upm(n)=$\alpha\cdot$ms(n)+ups(n).

The listening device further comprises an enhancement unit for retrieval of noise-like signal parts from an input signal (enclosed by dotted rectangle denoted Retrieval of intrinsic noise in FIG. 2*g*, cf. also FIG. 2*c* and the discussion of Method C above). The embodiment of a unit for retrieval of noise-like signal parts comprises a Delay DR(z) unit, an LR filter estimation unit, an LR(z,n) variable filter unit and a SUM unit '+'. The Retrieval of intrinsic noise block (and thus Delay DR(z) unit) receives as an input the output ux(n) from SUM unit '+' providing signal $(1-\alpha)\cdot$u(n)+$\alpha\cdot$upl(n) via two gain factor units 'x' applying gain $(1-\alpha)$ and $\alpha$ to signals u(n) and upl(n), respectively, where the gain factor $\alpha$ is controlled by the Control unit. The gain factor $\alpha$ can in general take on any value between 0 and 1. In a preferred embodiment, $\alpha$ is equal to 1 or 0, controlled by the Control unit (cf. output $\alpha$). The Delay DR(z) unit provides an output representing a delayed version of the input ux(n). The delayed output is connected to the LR filter estimation unit as well as to the variable filter unit LR(z,n). The output of the variable filter unit LR(z,n) is subtracted from the input signal ux(n)=$(1-\alpha)\cdot$u(n)+$\alpha\cdot$upl(n) in SUM unit '+', whose output is(n) represents an estimate of the noise-like part of the input signal ux(n). The output upm(n)=$\alpha\cdot$ms(n)+ups(n) from SUM unit '+' is added to the estimate is(n) of noise-like parts of the signal ux(n) in SUM unit '+', whose output represents the resulting noise-like signal us(n). If $\alpha$=0, the retrieval of intrinsic noise block operates on the signal in which noise has just been inserted. If, on the other hand, $\alpha$=1, the retrieval of intrinsic noise block only operates on signal parts which have not already been substituted by noise. In principle, this could be advantageous since there is in general no need to retrieve the noise which has just been inserted. The noise-like signal us(n) is connected to the Fh filter estimation unit of the feedback cancellation system and used in the calculation of filter coefficients for the variable filter unit Fh(z,n). The Control unit is further in one- or two-way communication with forward path gain unit G(z,n) and the two (LR- and Fh-) Filter Estimation units. The electrical equivalent of the leakage feedback from output to input transducer F(z,n) resulting in input signal v(n) is added to a target signal x(n) in SUM unit '+' representing the microphone. The feedback estimation Fh(z,n) resulting in feedback signal vh(n) is subtracted from the combined input x(n)+v(n) in SUM unit '+' whose output, the feedback corrected input signal e(n), is, as in other embodiments (cf. e.g. FIG. 2*a*), connected to the forward path gain unit G(z,n) and to the Fh filter estimation unit.

The masked noise generation method (Method A, FIG. 2*a*), the perceptual noise substitution method (B) and the signal decomposition method comprising extraction of noise-like parts (Method C, FIG. 2*c*) and functional units for implementations thereof are further discussed above.

2. Feedback Noise Retrieval: Processing of Signal e(n) on Input Side:

The algorithms for noise enhancement/retrieval include, but are not limited to:

I) Methods based on long-term prediction (LTP) filtering.

II) Methods based on binaural prediction filtering.

As mentioned above, any method (or combination of methods) of generating noise, including the methods outlined above (methods A, B) are intended to be combinable with any method (or combination of methods) for noise enhancement/retrieval including the methods outlined in the following (methods I, II and C).

Figure 3A:
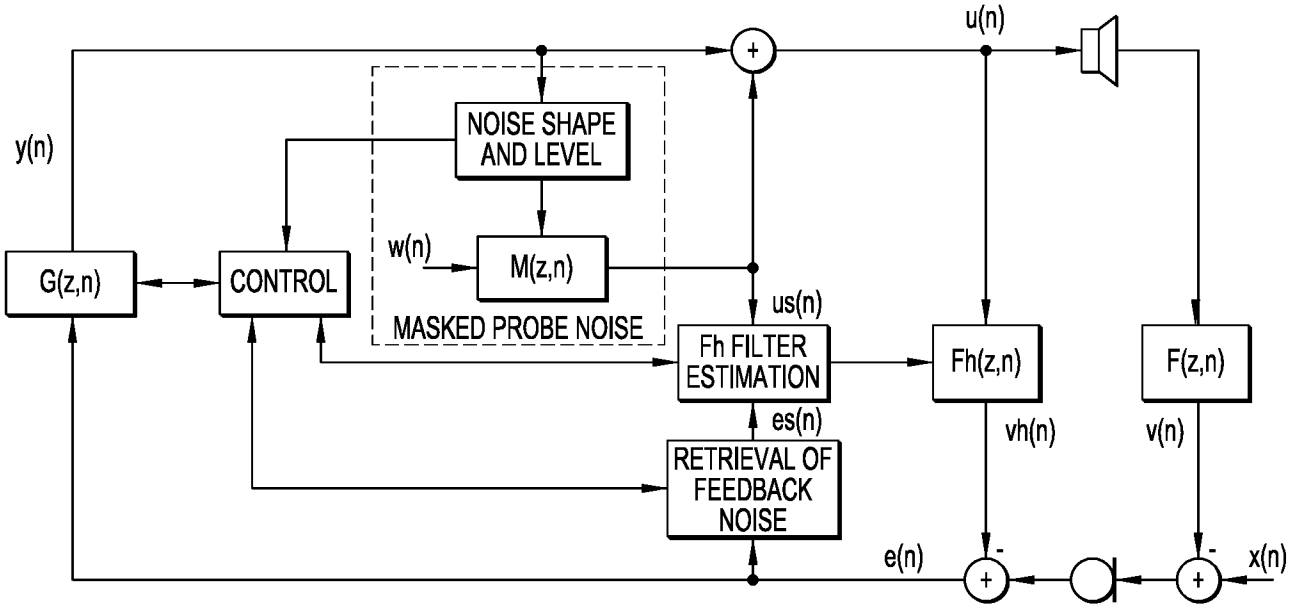
FIG. 3 shows an embodiment of the invention providing adaptive feedback estimation based on masked probe noise and (feedback) noise retrieval, FIG. 3*a* showing an embodiment comprising an enhancement unit on the input side and FIG. 3*b* showing an embodiment comprising an enhancement unit on the input side and additionally a (matched) enhancement unit on the output side.

2.1. Masked Noise (Method A) and Noise Retrieval (FIG. 3):

As an example, FIG. 3 shows a combination of noise generation method A (masked noise) with a noise enhancement/retrieval algorithm (Retrieval of feedback noise unit in FIG. 3*a* (cf. e.g. Enhancement unit in FIG. 1*c*), e.g. implementing Method I as outlined below) in a model of an audio processing system, e.g. a listening device or a communication device, according to the present invention. The model embodiment of FIG. 3*a* comprises the same elements as the model embodiment β of FIG. 2*a*. Additionally, the model embodiment of FIG. 3*a* comprises enhancement unit Retrieval of feedback noise for estimating the signal components of the feedback corrected input signal e(n) which originate from the masked noise signal us(n). The output es(n) of the Retrieval of feedback noise unit is connected to the Fh filter estimation unit for updating the variable filter part Fh(z,n) of the adaptive FBC-filter for estimating the feedback signal v(n). The other input to the Fh filter estimation unit is the masked noise signal output us(n) from the filter M(z,n) of the Masked probe noise generator. The Retrieval of feedback noise unit is in one or two-way communication with a Control unit.

Figure 3B:
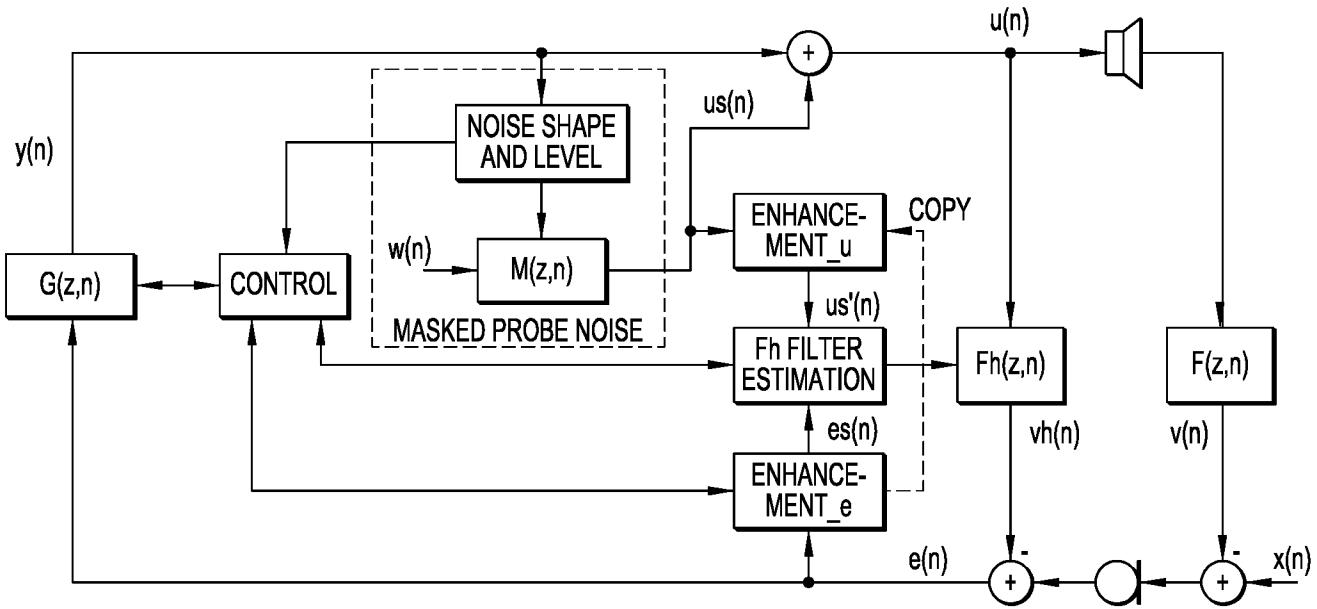

FIG. 3*b* shows an embodiment of an audio processing system comprising an enhancement unit (Enhancement_e) on the input side and additionally a (matched) enhancement unit (Enhancement_u) on the output side. The model embodiment of FIG. 3*b* comprises the same elements as the model embodiment of FIG. 3*a*, but comprises additionally an enhancement unit (Enhancement_u) on the output side of the of the forward gain unit G(z,n), cf. also the embodiment of FIG. 1*g*. The two enhancement units are in communication with each other as indicated by control signal copy. In an embodiment, the enhancement unit on the output side (Enhancement_u)) is controlled by (matched to) the enhancement unit on the input side (Enhancement_e). In an embodiment, where the enhancement unit on the input side Enhancement_e is represented by a filter (e.g. filter D(z,n) as shown in FIG. 4 and discussed below in connection therewith), the characteristics of the filter (e.g. its filter coefficients) are mirrored in (e.g. copied to) the enhancement unit on the output side Enhancement_u (via signal copy) to provide an identical filtering function to that of the enhancement unit on the input side Enhancement_e. The embodiment of FIG. 3*b* may alternatively be configured with a control unit as shown in and discussed in connection with FIG. 1*h*.

2.2. Noise Retrieval Based on Long Term Prediction (Method I, FIG. 4):

When using this method, the correlation time of noise signal us(n) preferably does not exceed $N_0$, i.e., during synthesis of us(n), the signal requirements P1-P3(P4) as outlined in the section on generation of masked noise (Method A) above are preferably obeyed.

The components of e(n) which originate from us(n) may be retrieved from the signal e(n) using the observation that the introduced/intrinsic noise in Methods A, B, C has a limited and known, correlation time, say $N_0$. Assuming that the feedback path F(z,n) is (equivalent to) a FIR filter of order N, it follows that the correlation time of the noise picked up at the microphone has a correlation time no longer than $N+N_0$. In other words, signal components in e(n) with longer correlation time than $N+N_0$ do not originate from the introduced/intrinsic noise sequence us(n). Thus, introducing a filter in the Retrieval of feedback noise block of FIG. 1*d*, which aims at rejecting signal components with a correlation time longer than $N+N_0$, is proposed. Such a filter can be realized using an adaptively updated FIR filter with the following z-transform (cf. e.g. FIG. 4, dashed rectangle denoted D(z,n)), where noise retrieval method I (based on long term prediction) is illustrated in combination with noise generation method A (masked noise, see also the corresponding treatment of the output signal y(n) to generate masked noise signal us(n) as discussed above in connection with Method A, and as illustrated in FIG. 2*a*, embodiment β):

$$\begin{aligned} D(z,n) &= 1 - DE(z) \times LE(z,n) \\ &= 1 - z^{-N_2} \times \sum_{p=0}^{P_2} d_{p+N_2} z^{-p} \\ &= 1 - \sum_{p=N_2}^{N_2+P_2} d_p z^{-p} \end{aligned}$$

where D(z,n) represents the resulting filter, $DE(z)=z^{-N2}$ represents a delay corresponding to $N_2$ samples, LE(z,n) represents the variable filter part, $N_2$ is the maximum correlation time, $d_p$ are the filter coefficients adapted to minimize $\epsilon[es(n)^2]$, where ϵ is the expected value operator, and $P_2$ is the order of the filter LE(z,n). The dependency of $d_p$ on the discrete-time index n has been omitted. The actual values of parameters $N_2$ and $P_2$ depend on the application in question (sampling rate, frequency range considered, hearing aid style, etc.). For a sampling rate larger than 16 kHz, and full band processing, typically, $N_2 \leqq 32$, such as 64, such as 128. The Fourier transform of the filter is found by replacing z by $e^{j\omega}$, j being the complex unit ($j^2=-1$) and ω being equal to $2\cdot\pi\cdot f$, where f is the normalized frequency.

The updating of the filter coefficients $d_p$ is performed in LE filter estimation unit in FIG. 4 (*a, b*). The filter coefficients $d_p$ may be found adaptively, using any standard adaptive algorithm, such as NLMS, as $$d_p^* = arg\ \min E[(es(n))^2]$$

where es(n) is the output signal of the filter D(z,n), and $$es(n) = e(n) - \sum_{l=0}^{P2} d_l e(n - N2 - l) = e(n) - z(n),$$

where e(n) is a feedback-corrected input signal on the input side at time instant n. On the right-hand side, z(n), can be seen as a prediction of e(n), based on signal samples which are at least $N_2$ samples old. The filter coefficients $d_1$ are estimated here to provide the MSE-optimal linear predictor, although other criteria than MSE (Mean Square Error) may be equally appropriate. By doing so, components of the signal e(n) having a correlation time longer than $N_2$ are reduced. $N_2$ may preferably be chosen as $N_2=N_0+N$, where $N_0$ represents the correlation time of the (probe) noise sequence, and N represents the delay in the feedback path, in order to reject signal components clearly not originating from the introduced/intrinsic noise. Often, D(z,n) is called a long-term prediction (LTP) error filter, a term coined in the area of speech coding [Spanias, 1994]. The important thing to note is that the LTP error filter can be considered as a whitening filter, but due to the special structure of D(z,n) with $N_2>>0$, the output is in general not completely white. In an embodiment, $N_2>>0$ is taken to mean $N_2 \geqq 32$, such as $\geqq 64$ or $\geqq 128$.

By doing so, the NIR may be significantly improved and the adaptation rate of the Fh filter estimation block can be increased beyond what is possible with traditional systems based on probe noise.

In the proposed setup, the (probe) noise properties and the LTP error filter D(z,n) are chosen such that their characteristics match: The introduced/intrinsic noise has a correlation time shorter than $N_0$, while D(z,n) reduces signal components with a correlation time longer than $N_2=N_0+N$. In an embodiment, $N_0$ is in the range from 32 to 128 samples (assuming a sampling rate of 20 kHz). In this way, D(z,n) can be seen as a matched filter. If N is e.g. equal to 64, this leads to $N_2$ in the range from 96 to 192. The idea of introducing (probe) noise with certain characteristics (in this case in the autocorrelation domain) is easy to generalize: Alternatively, for example, certain probe signal characteristics in the modulation domain can be introduced and a corresponding matched filter in this domain designed.

Figure 4A:
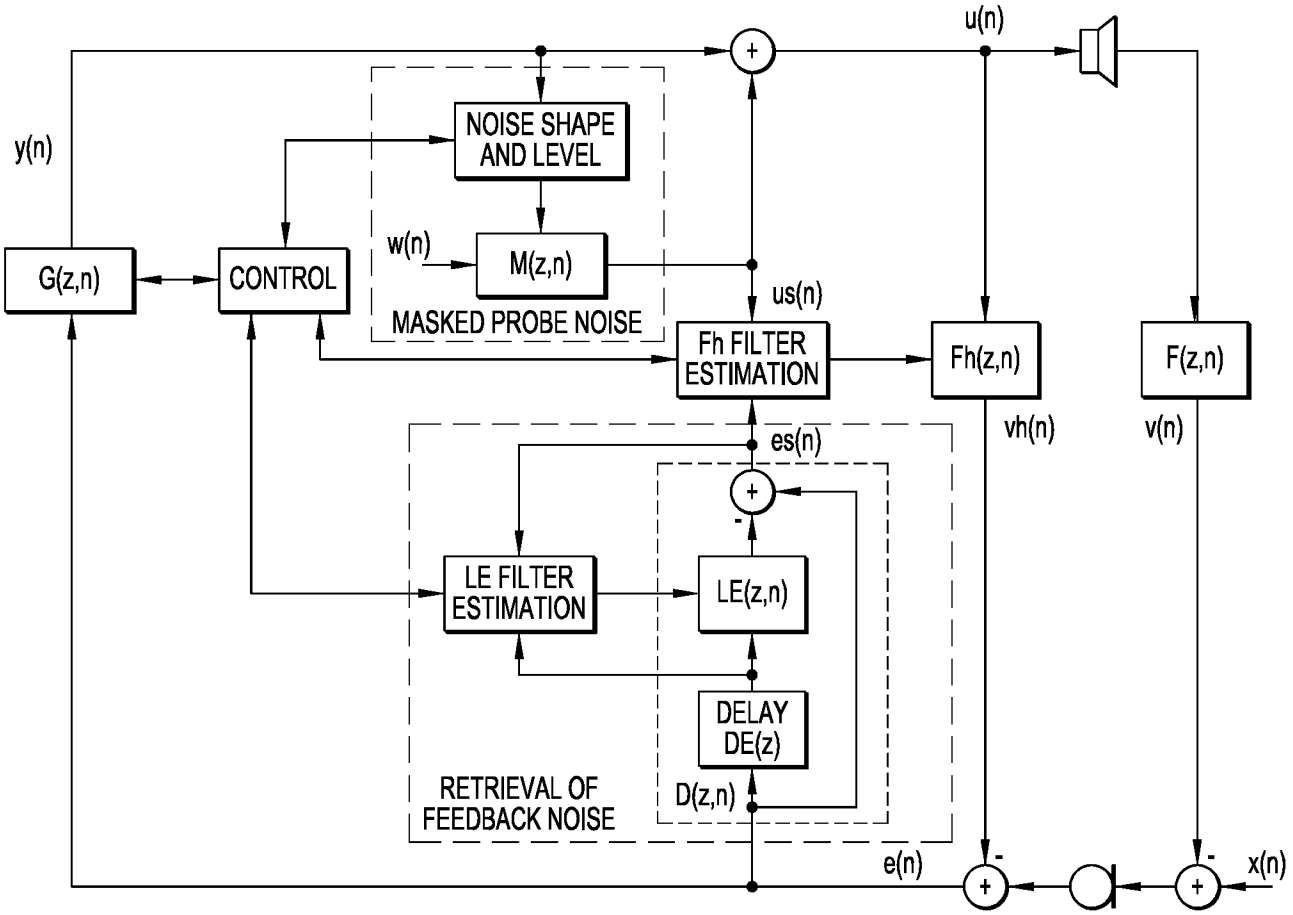
FIG. 4 shows an embodiment of the invention providing adaptive feedback estimation based on masked probe noise and noise retrieval based on Long Term Prediction filtering (LTP) (FIG. 4*a*) and an embodiment including a sensitivity remover (FIG. 4*b*)

In FIG. 4, the adaptive filter D(z,n) is correspondingly implemented in Retrieval of feedback noise block by units Delay DE(z), LE(z,n), and SUM '+' (as indicated by the corresponding dashed enclosing rectangle denoted D(z,n)) providing output es(n). In the embodiment of FIG. 4*a*, the Delay DE(z) unit receives feedback corrected input signal e(n) as an input and filter parts LE filter estimation and LE(z,n), respectively. The output of the variable filter part LE(z,n) is subtracted from the input signal e(n) in SUM unit '+'. The output of the adaptive filter D(z,n) (i.e. output of Retrieval of feedback noise block, i.e. output of SUM-unit '+' in FIG. 4) is the signal es(n) representing the noise-like part of the (feedback corrected) input signal e(n). The signal es(n) is connected to the variable filter part LE filter estimation of the adaptive filter D(z,n) as well as to the Fh filter estimation part of the FBC-filter and used in the latter to estimate of filter coefficients for estimating the feedback signal v(n). The other input to the Fh filter estimation unit is the signal us(n) providing a masked noise signal generated by Masked probe noise unit (cf. FIG. 2*a*) implemented by shaping filter unit M(z,n), which is estimated by Noise shape and level unit based on input y(n) from the forward path unit G(z,n). The masked noise us(n) is provided by the shaping filter unit M(z,n) based on a white noise sequence input w(n) and filter coefficients as determined by the Noise shape and level unit based on a model of the human auditory system. The masked noise us(n) is added to the output y(n) from the forward path unit G(z,n) in SUM unit '+' to provide output signal u(n) connected to the receiver and to the variable filter part Fh(z,n) of the adaptive FBC filter. A Control unit is in one- or two-way communication with the forward path gain unit G(z,n), the Noise shape and level unit and the LE- and Fh-filter estimation units. The electrical equivalent F(z,n) of the leakage feedback from output to input transducer resulting in input signal v(n) is added to a target signal x(n) in SUM unit '+' representing the microphone. The feedback estimation Fh(z,n) (variable filter part of an adaptive FBC filter) resulting in feedback signal estimate vh(n) is subtracted from the combined input x(n)+v(n) in SUM unit '+' whose output, the feedback corrected input signal e(n), is connected to the forward path gain unit G(z,n) and (in the embodiment in FIG. 4*a*) to the Retrieval of feedback noise unit (here to the Delay DE(z) unit).

Figure 4B:
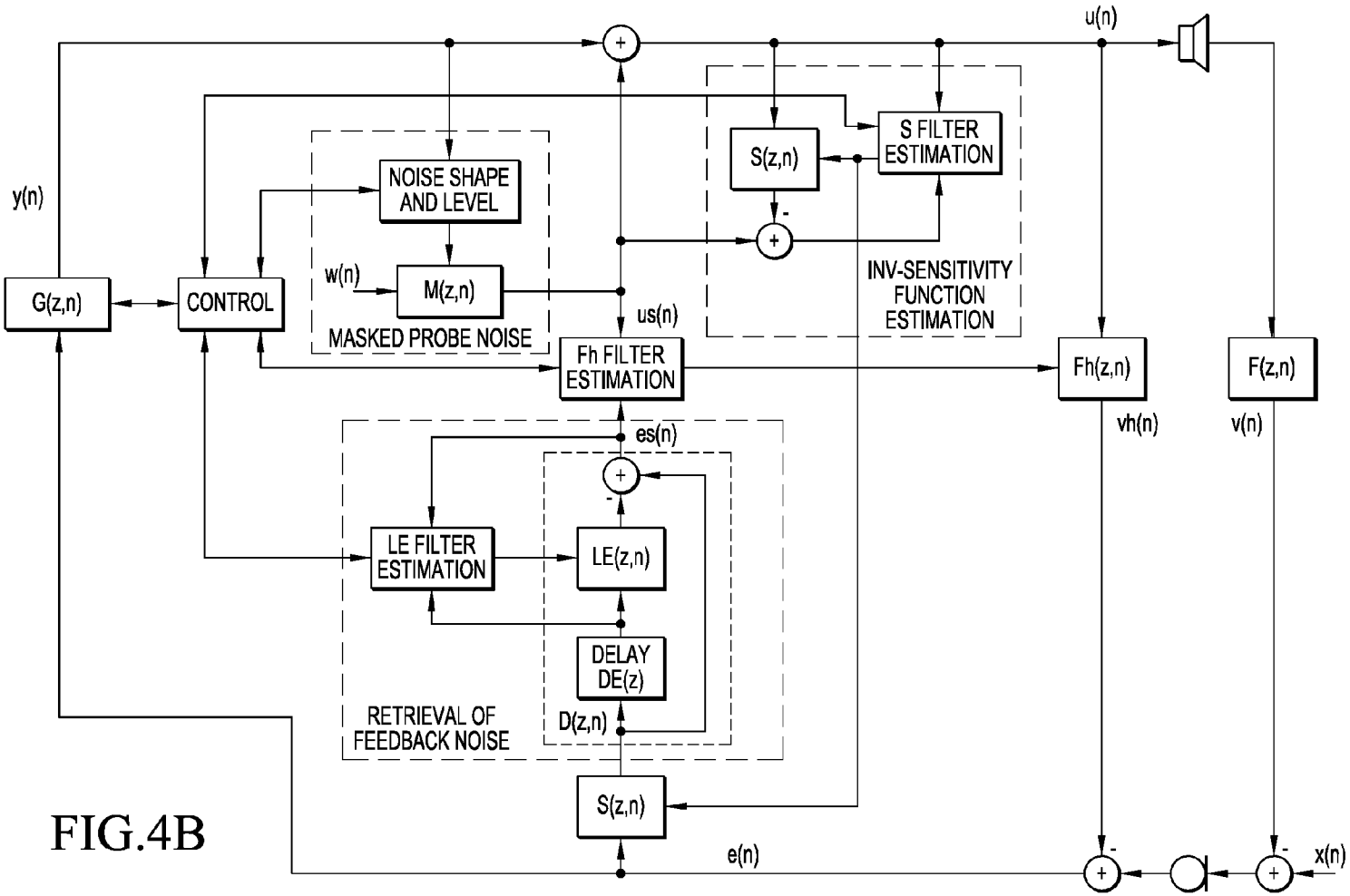

The embodiment of a listening device according to the invention shown in FIG. 4*b* is largely identical to the one shown in FIG. 4*a*. The differences are the following: In addition to the functional blocks of the embodiment of FIG. 4*a*, the embodiment of FIG. 4*b* comprises an Inv-sensitivity function estimation block comprising an adaptive filter with an algorithm part S filter estimation and a variable filter part S(z,n) getting its filter coefficient updates from the S filter estimation part. This filter update may be achieved through classical methods such as NLMS. The FIR filter S(z,n) is an estimate of the so-called inverse sensitivity function. The sensitivity function concept in closed-loop identification (see e.g. [Forsell, 1997]) describes the coloration of (intrinsic or introduced) noise components due to the fact that the system is closed-loop. Had the system been open-loop, the sensitivity function would have been S(z,n)=1. Strictly speaking, the proposed algorithms for feedback path estimation assume the system to be open-loop, but any hearing aid system is, obviously, closed-loop. By taking into account the sensitivity function, it is possible to bring the situation "experienced" by the Fh filter estimation block closer to being open-loop, and consequently achieve better performance. Specifically, this is done by filtering e(n) in the filter S(z,n) receiving its update filter coefficients from the S filter estimation part of the Inv-sensitivity function estimation block.

2.2.1. Noise Retrieval Based on Long Term Prediction (Method I) Combined with any Noise Generation Method:

FIG. 4 illustrates as described above a combination of noise retrieval based on long term prediction (Method I) with noise generation based on the generation of masked noise (Method A). Noise retrieval method I may, however, be combined with any other noise generation method, alone or in combination with other noise generation methods.

Among the advantages provided by embodiments of the present invention with noise retrieval based on LTP are:

- Higher gain possible, especially for tonal signal regions (which are usually considered difficult to handle in traditional systems).
- Significantly reduced distortions in audio signals.
- Fewer howls/distortions as feedback path estimate is generally healthier.
- Proposed algorithm is particularly strong in signal regions with tonal components as these have long correlation times. This is particularly interesting as (any) standard system has weaknesses in such regions.
- Can be used in single HA situations.

Figure 5:
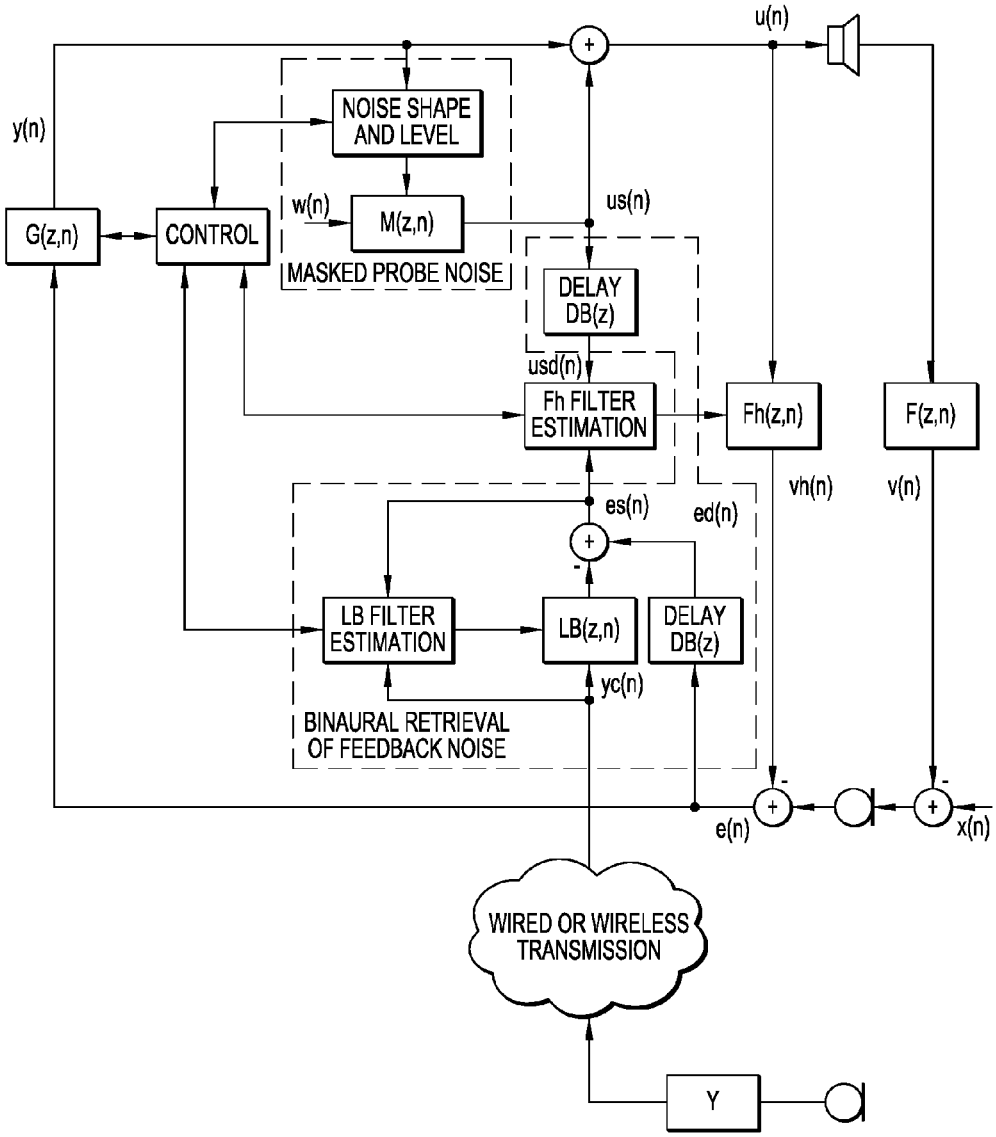
FIG. 5 shows an embodiment of the invention providing adaptive feedback estimation based on masked probe noise and binaural prediction filtering based feedback noise retrieval.

2.3. Noise Retrieval Based on Binaural Prediction Filtering (Method II) (FIG. 5):

The general idea in Method I proposed above is to use far-past samples of the error signal e(n) to predict the current sample of e(n), and in this way reduce signal components in the error signal estimate es(n) which are not due to the introduced/intrinsic noise. Clearly, this framework is not dependent of which signal samples are used to predict the current error signal sample e(n), as long as the signal samples used are uncorrelated with the introduced/intrinsic noise and do correlate to some extent with the current error signal sample. Based on this observation, it is proposed to use signal samples from another microphone, e.g. from a contra-lateral microphone to predict the components of the error signal e(n), which do not originate from the introduced/intrinsic noise us(n). The setup is shown in FIG. 5, where a combination of noise retrieval method II based on binaural prediction filtering with noise generation method A based on masked noise is implemented. In an embodiment, non-linearity is introduced into the forward path, e.g. by frequency transposition or PNS. FIG. 5 shows a noise based DFC system using a signal $y_c(n)$ from another microphone (i.e. e.g. a signal from an external sensor, e.g. a contra-lateral listening device located at another ear than the current one) for retrieving the signal components in e(n) originating from us(n). In the embodiment of FIG. 5, the signal $y_c(n)$ is a processed version of an additional microphone signal (cf. block Y), e.g. a feedback corrected microphone signal, as received via a connection to another device (cf. indication Wired or wireless transmission). In FIG. 5, the LTP error filter D(z) of Method I (cf. FIG. 4) has been replaced by another FIR filter structure (implemented in Binaural retrieval of feedback noise block in FIG. 5), described by the difference equation $$e_s(n) = e(n - N_3) - \sum_{p=0}^{P_3} e_p y_c(n - p),$$

where $y_c(n)$ represents samples from the external sensor, $$LB(z, n) = \sum_{p=0}^{P_3} e_p z^{-p}$$

represents the variable filter part, where $e_p$ are the filter coefficients adapted to minimize $\epsilon[es(n)^2]$, where $\epsilon$ is the expected value operator and where es(n) is the output signal of the proposed filter structure, $N_3$ is a delay which may be needed to account for the fact that a latency may be introduced for transmitting a signal from another sensor to the current one and $P_3$ is the order of the filter LB(z,n). The purpose of this filter is identical to that of the predictor of D(z,n) of method I, namely to predict samples of the error signal e(n) in order to eliminate signal components NOT related to the probe signal. Specifically, the filter coefficients $e_p$ are found so as to minimize $E[es(n)^2]$. However, in contrast to the predictor of D(z,n), the predictor LB(z,n) bases the prediction, not on e(n), but on samples from a signal $y_c(n)$ from another (e.g. a contra-lateral) microphone.

Consequently, when using this feedback noise retrieval technique, the introduced/intrinsic noise should preferably have properties P1-P3 (as outlined in the section on generation of masked noise (Method A) above), and in addition preferably:

P6) The introduced/intrinsic noise us(n) is uncorrelated with the contra-lateral microphone signal $y_c(n)$, i.e., $Eus(n) \cdot y_c(n+k) \sim 0$ for all k.

In FIG. 5, the proposed filter structure is implemented in Binaural retrieval of feedback noise block by units Delay DB(z), LB Filter Estimation, LB(z,n), and SUM '+'. The Delay DB(z) unit receives (feedback corrected) input signal e(n) as an input and provides a delayed output ed(n) which is connected to SUM unit '+'. The algorithm and variable filter parts LB filter estimation and LB(z,n), respectively, receive input $y_c(n)$ originating from another microphone than the one on which signal e(n) is based (yc(n) being transmitted by wire or wirelessly, e.g. from a microphone of a contra-lateral device or from another microphone of the same listening device or from another device; the microphone signal from the other microphone has been processed in processing unit Y, e.g. to provide a feedback corrected version of the input signal). The output of the variable filter part LB(z,n) is subtracted from the output signal ed(n) of the Delay DB(z) unit in SUM unit '+'. The output of the filter structure of the Binaural retrieval of feedback noise block (output of SUM-unit '+' in FIG. 5) is the signal es(n) representing the noise-like part of the (feedback corrected) input signal e(n). This signal (es(n)) is connected to the variable filter part LB filter estimation of the filter structure as well as to the Fh filter estimation part of the FBC-filter and in the latter used in the estimate of filter coefficients for estimating the feedback signal v(n) provided as vh(n) by variable FBC-filter part Fh(z,n). The LB filter estimation part of the filter structure is electrically connected to a Control unit. The other input to the Fh filter estimation unit is the signal usd(n) (an appropriately delayed version of us(n) delayed in Delay DB(z) unit, equal to the other delay unit of the Binaural retrieval of feedback noise block). Signal us(n) is a masked noise signal generated by Masked probe noise unit (cf. FIG. 2*a*) implemented by shaping filter unit M(z,n), which is estimated by Noise shape and level unit based on input y(n) from the forward path unit G(z,n). The masked noise us(n) is provided by the shaping filter unit M(z,n) based on a white noise sequence input w(n) and filter coefficients as determined by the Noise shape and level unit based on a model of the human auditory system. A Control unit is in one- or two-way communication with the Noise shape and level unit and the LB- and Fh-filter estimation units and the forward path gain unit G(z,n). The masked noise us(n) is added to the output y(n) from the forward path unit G(z,n) in SUM unit '+', the sum providing output signal u(n) to the receiver. The output signal u(n) is connected to the variable filter part Fh(z,n) of the adaptive FBC-filter. The electrical equivalent F(z,n) of the leakage feedback from output to input transducer resulting in input signal v(n) is added to a target signal x(n) in SUM unit '+' representing the microphone. The feedback estimation Fh(z,n) (variable filter part of an adaptive FBC filter) resulting in feedback signal estimate vh(n) is subtracted from the combined input signal x(n)+v(n) in SUM unit '+' whose output, the feedback corrected input signal e(n), is connected to the forward path gain unit G(z,n) and to the Binaural retrieval of feedback noise unit, here specifically to the Delay DB(z) unit. The Binaural retrieval of feedback noise unit is in FIG. 5 represented by units enclosed by the dotted polygon, i.e. including units Delay DB(z), LB Filter Estimation, LB(z,n), and SUM '+' as outlined above AND delay unit Delay DB(z) for delaying masked noise signal us(n) to adapt it to the delay of es(n) before entering the Fh filter estimation unit.

As mentioned above, the goal of the proposed filter structure is similar to that of D(z,n) of method I and the coefficients of the proposed filter structure can be estimated and updated in a similar fashion, using e.g. NLMS. However, whereas D(z,n) is dependent on samples of the microphone signal only (in fact, in the embodiment of FIG. 4*a*, D(z,n) is derived from the feedback compensated signal, e(n)), the proposed filter structure is dependent on the spatial configuration of sound sources. This is clear from the observation that LB(z,n) aims at representing the transfer function from one ear to the other (in case of using a signal originating from a microphone of a contra-lateral device), which is related to head related transfer functions HRTF (in the case of a single point source in the free field, this relation is particularly simple), which in turn are functions of the direction-of-arrival of the sound source. Further, whereas D(z,n) is dependent on far-past samples of the error signal, the proposed filter structure may potentially be based on current samples of the contra-lateral microphone signal. This would be reflected by choosing $N_3=0$.

2.3.1. Noise Retrieval Based on Binaural Prediction Filtering (Method II) Combined with any Noise Generation Method:

FIG. 5 illustrates as described above a combination of noise retrieval method II based on binaural prediction with noise generation method A based on masked noise generation. Noise retrieval method II may, however, be combined with any other noise generation methods, alone or in combination.

Among the advantages provided by embodiments of the noise retrieval method II of the present invention based on binaural prediction filtering are:

- Higher gain possible without howls/distortions, in principle, for any input signal, tonal or not.
- Proposed algorithm is in principle strong for any input signal as long as the spatial configuration is simple (not too many reflections) and somewhat stationary across time.
- Somewhat complementary to the LTP solution proposed above. The LTP solution is signal dependent whereas the proposed solution is signal independent but dependent on spatial configuration.

The method requires dual, e.g. contra-lateral, listening devices or another microphone signal from the same listening device or from another device, e.g. from a communication device, e.g. from an audio selection device.

3. Combination of Noise Retrieval Methods I, II and C with Noise Generation Methods A, B (FIGS. 4, 5, 6):

In general, combinations of one or more of the noise generation methods A, and B with one or more of the noise retrieval methods I, II and C can advantageously be implemented using at least one algorithm from each class.

Figure 6A:
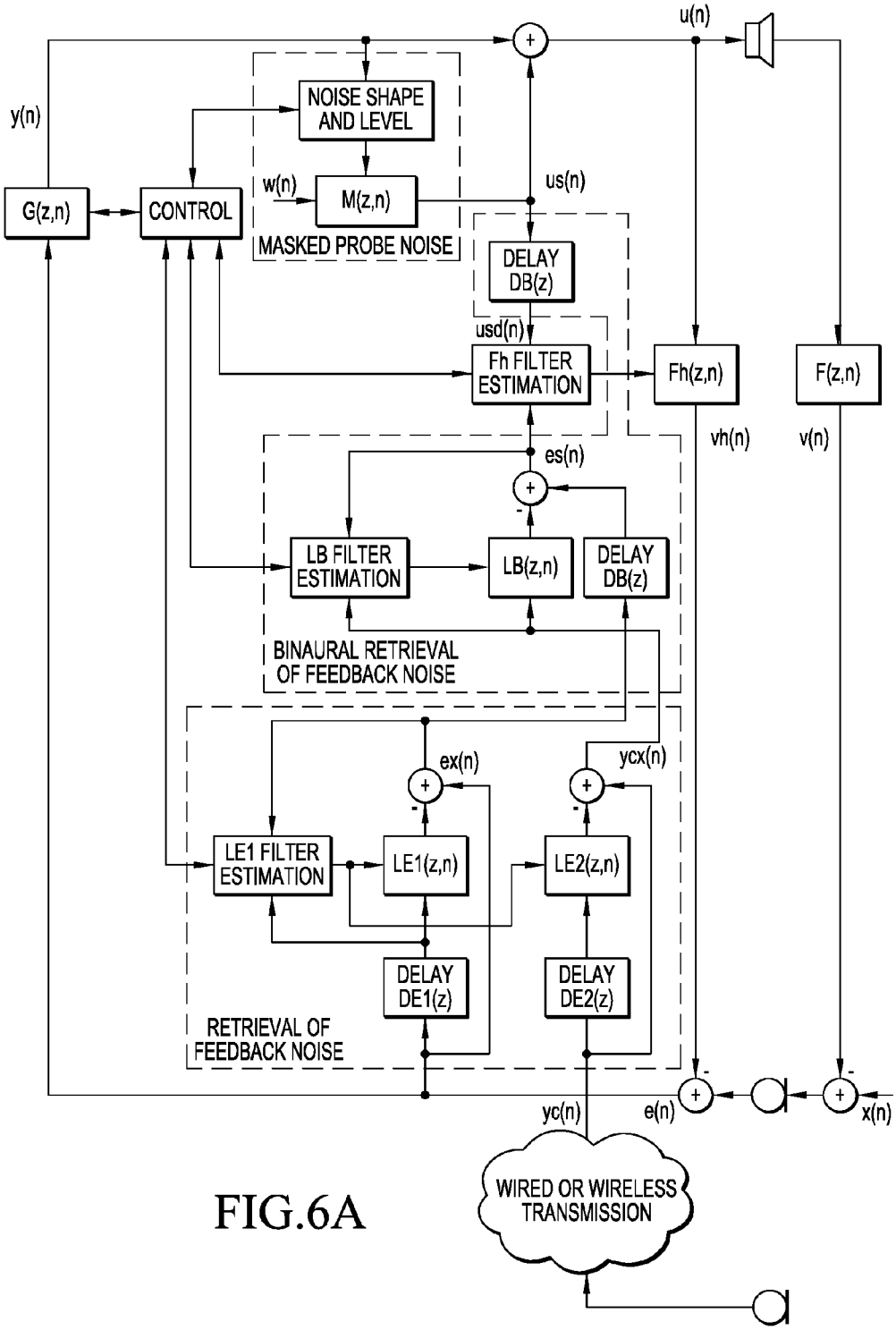
FIG. 6 shows an embodiment of the invention providing adaptive feedback estimation based on masked probe noise, binaural prediction filtering based feedback noise retrieval and LTP based noise retrieval (FIG. 6*a*) and an embodiment of the invention providing adaptive feedback estimation based on signal decomposition (retrieval of 'intrinsic' noise), masked probe noise, perceptual noise substitution, binaural prediction filtering based feedback noise retrieval and noise retrieval based on LTP (FIG. 6*b*).

3.1. Noise Retrieval Based on Long Term Prediction Filtering (Method I) and Binaural Prediction Filtering (Method II) Combined with Noise Generation Method Based on Masked Noise (Method A):

FIG. 6*a* shows a model for an embodiment of a listening device according to the invention, wherein noise generation method A based on masked noise is combined with noise retrieval method I based on long term prediction filtering as well as with noise retrieval method II based on binaural prediction filtering. In FIG. 6*a*, masked noise us(n) (Method A, cf. above) is inserted in the output part of the forward path by block Masked probe noise and used as a first input to the algorithm part (Fh filter estimation) of the adaptive FBC-filter for estimating the feedback path. The noise in the feedback corrected input signal e(n) originating from the inserted masked noise is retrieved in enhancement unit Retrieval of feedback noise using long term prediction filtering (Method I, filter D(z,n), cf. above) and noise from an alternative (possibly processed) microphone signal yc(n) (e.g. from a contra lateral device) is retrieved in enhancement unit Binaural retrieval of feedback noise using binaural prediction filtering (Method II, cf. above). The combined noise signal es(n) is used as a second input to the algorithm part of the adaptive FBC-filter. Appropriate delays are inserted to 'align' the samples of the different signals. In the embodiment of FIG. 6*a*, the output signal y(n) of the forward path gain unit G(z,n) is connected to a masked noise generator (cf. FIG. 2*a* and the discussion above) comprising Noise shape and level unit (controlled by a Control unit) for estimating time-varying shaping filter M(z,n), which filters white noise sequence w(n) and provides as an output the masked noise signal us(n), which is added to the output signal y(n) of the forward path gain unit in SUM unit '+' to provide output signal u(n), which is connected to the receiver. The masked noise signal us(n) is delayed in delay unit Delay DB(z) providing output usd(n) which is connected to the Fh filter estimation unit. The purpose of the delay of us(n) is to align the noise-signal samples of the two input signals (usd(n) and es(n)) to the Fh filter estimation unit for generating update filter coefficients to the variable filter part Fh(z,n) of the FBC-filter for estimating the feedback signal v(n). The other input es(n) of the Fh filter estimation unit is generated by an enhancement unit implementing a combination of noise retrieval based on long term prediction filtering (Method I) and binaural prediction filtering (Method II).

The processing of the signal on the input side in FIG. 6*a* is a combination of the two retrieval techniques considered separately above: long term prediction (LTP) filtering (cf. block Retrieval of feedback noise) and binaural prediction filtering (cf. block Binaural retrieval of feedback noise). The blocks Delay DE1(*z*), LE1 filter estimation and LE1(*z,n*) form the LTP filter considered above. The blocks have been described in section Noise retrieval based on long term prediction (method I above). The output of this filter, ex(n), consists ideally of signal components with a correlation time no longer than $N_2$. The filter structure consisting of Delay DE2(*z*) and LE2(*z,n*) implements exactly the same filter as Delay DE1(*z*) and LE1(*z,n*). Specifically, DE2(*z*)=DE1(*z*), and LE2(*z,n*) is copied whenever LE1(*z,n*) is updated, so LE2(*z,n*)=LE1(*z,n*) at all times. Consequently, ycx(n) is the signal yc(n) received from the external sensor, filtered through the LTP filter. The signals ex(n) and ycx(n) now enter the binaural retrieval filter in a similar manner as e(n) and yc(n) did it for the stand-alone binaural retrieval filter described in FIG. 5. As mentioned, ex(n) consists of "noise-like" components, some originating from the inserted noise (these are the components of interest in this context) and some intrinsically present in the input signal (these are interference components in the given context). The purpose of the binaural retrieval filter is to reject these interference components, such that, ideally, the signal es(n) contains the noise-like components originating from the introduced noise.

The outputs of the Retrieval of feedback noise block are a first signal ex(n) comprising the noise-like parts of the feedback corrected input signal e(n) and a second signal ycx(n) comprising the alternative microphone signal, which has been filtered in a copy of the LTP filter (DE1(*z*), LE1(*z,n*)) These signals are connected to the Binaural retrieval of feedback noise block, the second signal ycx(n) to the algorithm and variable filter parts of the adaptive filter (LB filter estimation and LB(z,n), respectively) and the first signal ex(n) to delay unit Delay DB(z). The output of the variable filter part LB(z,n) is subtracted from the output of Delay DB(z) in SUM unit '+'. This output es(n) of the Binaural retrieval of feedback noise block represents the combined retrieved noise and is connected to the (internal) LB filter estimation unit (and used in the estimate of the variable filter part LB(z,n)) as well as to the Fh filter estimation unit and used for updating the variable filter part Fh(z,n) of the adaptive feedback cancellation filter.

A Control unit is in one- or two-way communication with the Noise shape and level unit and the LB-, LE- and Fh-Filter Estimation units and the forward path gain unit G(z,n).

The output signal u(n) is connected to the variable filter part Fh(z,n) of the adaptive FBC-filter. The electrical equivalent F(z,n) of the leakage feedback from output to input transducer resulting in input signal v(n) is added to a target signal x(n) in SUM unit '+' representing the microphone. The feedback signal estimate vh(n) resulting from the feedback estimation Fh(z,n) is subtracted from the combined input x(n)+v(n) in SUM unit '+' whose output, the feedback corrected input signal e(n), is connected to the forward path gain unit G(z,n) and to the Retrieval of feedback noise block (here specifically to the Delay DE1(*z*) unit). The Retrieval of feedback noise block is in FIG. 6*a* represented by units enclosed by the dotted rectangle, i.e. including units implementing filter D(z,n) and the update LE1 filter estimation unit as outlined above AND delay unit DE2(*z*) and variable filter part LE2(*z,n*) for delaying and filtering alternative microphone signal yc(n) before it enters the Binaural retrieval of feedback noise block.

Figure 6B:
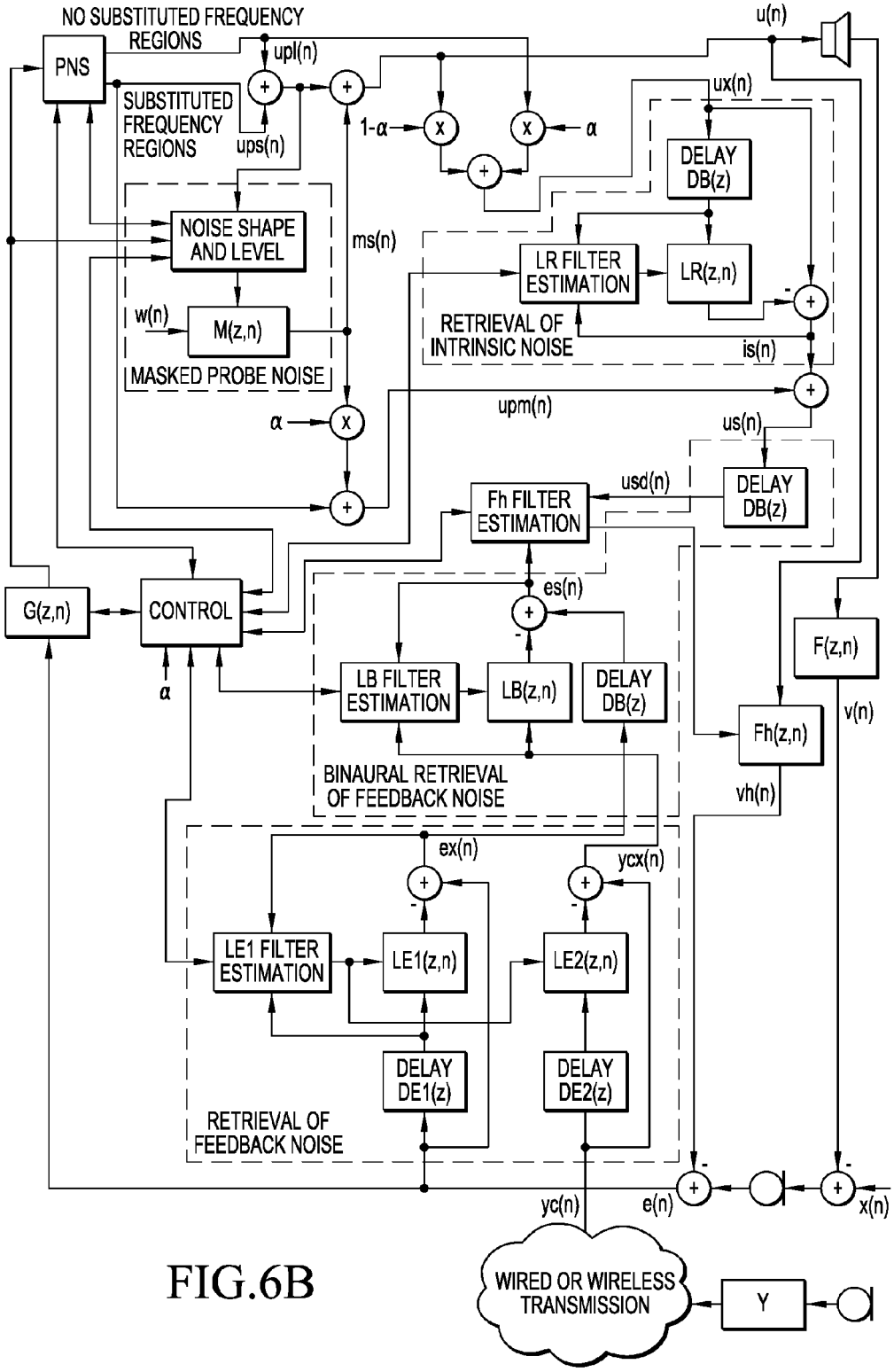

3.2. Noise Retrieval Based on Long Term Prediction Filtering (Method I), on Binaural Prediction Filtering (Method II), and on Extraction of Intrinsic Noise-Like Signal Components (Method C) Combined with Noise Generation Based on Masked Noise (Method A), and on Perceptual Noise Substitution (Method B):

In the embodiment of a listening device shown in FIG. 6*b*, processing on the output side includes perceptual noise substitution performed on the output signal y(n) from the forward path gain unit G(z,n) by block PNS providing corresponding outputs upl(n), ups(n), which in successive SUM units '+' (the first providing combined PNS-output signal upx(n)=upl(n)+ups(n)) are combined with the masked noise signal ms(n) (Method A, cf. above) generated by block Masked probe noise to provide the output signal u(n)=upx(n)+ms(n). These noise generation methods are further combined with the extraction of intrinsic noise in block Retrieval of intrinsic noise (Method C, filter C(z,n), cf. above) from the output signal u(n) ($\alpha$=0) OR from the unaltered signal parts upl(n) from the PNS block ($\alpha$=1) (OR from a combination of the two, cf. gain factor $0<\alpha<1$) to generate a resulting noise-like signal us(n), which is used as a first input to the algorithm part (Fh filter estimation) of the adaptive FBC-filter for estimating the feedback path. This is largely as shown in FIG. 2*g* and as described in connection therewith. In FIG. 6*b* processing on the input side includes that the noise in the feedback corrected input signal e(n) originating from the inserted noise on the output side is retrieved in enhancement unit Retrieval of feedback noise using long term prediction filtering (Method I, filter D(z,n), cf. above) and noise from an alternative microphone signal (e.g. from a contra lateral device, e.g. processed in processing unit Y) is retrieved in enhancement unit Binaural retrieval of feedback noise using binaural prediction filtering (Method II, cf. above). The resulting noise signal es(n) is used as a second input to the algorithm part of the adaptive FBC-filter. Appropriate delays are inserted to 'align' the samples of the different signals. This is largely as shown and described in connection with FIG. 6*a* above.

The output signal u(n) is connected to the variable filter part Fh(z,n) of the adaptive FBC-filter. The electrical equivalent F(z,n) of the leakage feedback from output to input transducer resulting in input signal v(n) is added to a target signal x(n) in SUM unit '+' representing the microphone. The feedback signal estimate vh(n) resulting from the feedback estimation Fh(z,n) is subtracted from the combined input x(n)+v(n) in SUM unit '+' whose output, the feedback corrected input signal e(n), is connected to the forward path gain unit G(z,n) and to the Retrieval of feedback noise block.

In FIG. 2-6, the term listening device has been used to exemplify embodiments of the present invention. The term audio processing system or audio processing device may likewise be used.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

REFERENCES

[Dau et al., 1996] T. Dau, D. Püschel, and A. Kohlrausch, A quantitative model of the "effective" signal processing in the auditory system. I. Model structure, J. Acoust. Soc. Am. 99, pp. 3615-3622, June 1996.

EP 0 415 677 A2 (GN Danavox) Mar. 6, 1991

[Forsell, 1997] U. Forsell and L. Ljung, Closed-loop Identification Revisited, Technical Report, Report number: LiTH-ISY-R-1959, Linkoping University, 1997.

[Haykin, 1996] Simon Haykin, Adaptive Filter Theory, Prentice Hall, 3rd edition, 1996, ISBN 0-13-322760-X.

[Härmä et al., 2000] A. Härmä et al., Frequency-Warped Signal Processing for Audio Applications, J. Audio Eng. Soc., Vol. 48, No. 11, 2000, pp. 1011-1031.

ISO/MPEG Committee, *Coding of moving pictures and associated audio for digital storage media at up to about* 1.5 *Mbit/s—part* 3*: Audio,* 1993, ISO/IEC 11172-3.

[Johnston, 1988] Estimation for perceptual entropy using noise masking criteria, in Proceedings of International Conference on Acoustics, Speech and Signal Processing (ICASSP), pp. 2524-2527, April 1988.

[Kuo et al.; 1999] S. M. Kuo, D. R. Morgan, Active Noise Control: A tutorial Review, Proceedings of the IEEE, Vol. 87, No. 6, June 1999, pp. 943-973.

[Loizou, 2007] Speech Enhancement: Theory and Practice, P. C. Loizou, CRC Press, 2007.

[Lotter, 2005] T. Lotter and P. Vary, Speech Enhancement by MAP spectral magnitude estimation using a super-gaussian speechmodel, Eurasip Journal on Applied Signal Processing, No. 7, pp. 1110-1126, 2005

[Painter et al., 2000] T. Painter and A. Spanias, Perceptual Coding of Digital Audio, Proceedings of the IEEE, Vol. 88, No. 4, April 2000, pp. 451-513.

[Sayed, 2003] Ali H. Sayed, Fundamentals of Adaptive Filtering, John Wiley & Sons, 2003, ISBN 0-471-46126-1

[Spanias, 1994] A. Spanias, "Speech Coding: A Tutorial Review," Proceedings of the IEEE, Vol. 82, No. 10, October 1994, pp. 1541-1582.

US 2007/172080 A1 (Philips) Jul. 26, 2007

[Van de Par et al., 2008] Van de Par et al., "A new perceptual model for audio coding based on spectro-temporal masking", Proceedings of the Audio Engineering Society 124th Convention, Amsterdam, The Netherlands, May 2008.

[Widrow et al; 1985] "Adaptive Signal Processing", B. Widrow and S. D. Stearns, Prentice-Hall, Inc., Englewood Cliffs, N.J., USA, 1985, pp. 302-367.

WO 2007/113282 A1 (Widex) Oct. 11, 2007

WO 2007/125132 A2 (Phonak) Nov. 8, 2007

WO 2008/151970 A1 (Oticon) Dec. 18, 2008

The invention claimed is:

1. An audio processing system for processing an input sound to an output sound, the audio processing system comprising:

an input transducer for converting an input sound to an electric input signal and defining an input side;

an output transducer for converting a processed electric output signal to an output sound and defining an output side;

a forward path being defined between the input transducer and the output transducer, and comprising a signal processing unit (SPU) configured to process an SPU-input signal originating from the electric input signal and to provide a processed SPU-output signal; and an electric feedback loop from the output side to the input side comprising:

a feedback path estimation unit for estimating an acoustic feedback transfer function from the output transducer to the input transducer, and an enhancement unit for extracting characteristics of an electric signal of the forward path, the characteristics of the electric signal including at least one of modulation index, periodicity, correlation time, and noise-like parts of the electric signal, and providing an estimated characteristics output, wherein the feedback path estimation unit is adapted to use the estimated characteristics output in the estimation of the acoustic feedback transfer function.

2. An audio processing system according to claim 1 wherein said feedback path estimation unit comprises an adaptive filter comprising a variable filter part and an algorithm part for updating filter coefficients of the variable filter part, the algorithm part being adapted to base the update at least partly on said estimated characteristics output from the enhancement unit.

3. An audio processing system according to claim 1, wherein the enhancement unit is adapted for retrieving intrinsic noise-like signal components in the electric signal of the forward path.

4. An audio processing system according to claim 3, wherein the correlation time $N_1$ of the noise signal estimate output from the enhancement unit obeys $N_1 \leqq dG$, where dG is the delay of the forward path.

5. An audio processing system according to claim 1 comprising a probe signal generator for generating a probe signal contributing to the estimation of the feedback transfer function.

6. An audio processing system according to claim 5 wherein the probe signal generator is adapted to provide a probe signal based on masked added noise.

7. An audio processing system according to claim 5 wherein the probe signal generator is adapted to provide a probe signal based on perceptual noise substitution, PNS.

8. An audio processing system for processing an input sound to an output sound, the audio processing system comprising:

an input transducer for converting an input sound to an electric input signal and defining an input side;

an output transducer for converting a processed electric output signal to an output sound and defining an output side;

a forward path being defined between the input transducer and the output transducer, and comprising a signal processing unit (SPU) configured to process an SPU-input signal originating from the electric input signal and to provide a processed SPU-output signal; and an electric feedback loop from the output side to the input side, including a feedback path estimation unit for estimating an acoustic feedback transfer function from the output transducer to the input transducer, and an enhancement unit for extracting characteristics of an electric signal of the forward path and providing an estimated characteristics output, wherein the feedback path estimation unit is configured to use the estimated characteristics output in the estimation of the acoustic feedback transfer function, wherein the enhancement unit is configured to retrieve intrinsic noise-like signal components in the electric signal of the forward path, and the enhancement unit comprises an adaptive filter C(z,n) of the form $$\begin{aligned} C(z,n) &= 1 - DR(z) \times LR(z,n) \\ &= 1 - z^{-N_1} \times \sum_{p=0}^{P_1} c_{p+N_1} z^{-p} \\ &= 1 - \sum_{p=N_1}^{N_1+P_1} c_p z^{-p}, \end{aligned}$$

where C(z,n) represents the resulting filter, $DR(z)=z^{-N1}$ represents a delay corresponding to $N_1$ samples, LR(z,n) represents the variable filter part, $N_1$ is the maximum correlation time, and $c_p$ are the filter coefficients adapted to minimize a statistical deviation measure of us(n) and us(n) is the noise signal estimate output, and where $P_1$ is the order of LR(z,n).

9. An audio processing system for processing an input sound to an output sound, the audio processing system comprising:

an input transducer for converting an input sound to an electric input signal and defining an input side;

an output transducer for converting a processed electric output signal to an output sound and defining an output side;

a forward path being defined between the input transducer and the output transducer, and comprising a signal processing unit (SPU) configured to process an SPU-input signal originating from the electric input signal and to provide a processed SPU-output signal;

an electric feedback loop from the output side to the input side, including a feedback path estimation unit for estimating an acoustic feedback transfer function from the output transducer to the input transducer, and an enhancement unit for extracting characteristics of an electric signal of the forward path and providing an estimated characteristics output; and a probe signal generator for generating a probe signal contributing to the estimation of the feedback transfer function, wherein the feedback path estimation unit is configured to use the estimated characteristics output in the estimation of the acoustic feedback transfer function, wherein the probe signal generator is configured to provide that the probe signal has predefined characteristics, and the enhancement unit is configured to provide a noise signal estimate output based on said characteristics.

10. An audio processing system for processing an input sound to an output sound, the audio processing system comprising:

an input transducer for converting an input sound to an electric input signal and defining an input side;

an output transducer for converting a processed electric output signal to an output sound and defining an output side;

a forward path being defined between the input transducer and the output transducer, and comprising a signal processing unit (SPU) configured to process an SPU-input signal originating from the electric input signal and to provide a processed SPU-output signal;

an electric feedback loop from the output side to the input side, including a feedback path estimation unit for estimating an acoustic feedback transfer function from the output transducer to the input transducer, and an enhancement unit for extracting characteristics of an electric signal of the forward path and providing an estimated characteristics output; and a probe signal generator for generating a probe signal contributing to the estimation of the feedback transfer function, wherein the feedback path estimation unit is configured to use the estimated characteristics output in the estimation of the acoustic feedback transfer function, wherein the probe signal generator is adapted to provide that the probe signal has a correlation time $N_0$ which is smaller than or equal to the sum of the forward path and feedback path delays.

11. An audio processing system for processing an input sound to an output sound, the audio processing system comprising:

an input transducer for converting an input sound to an electric input signal and defining an input side;

an output transducer for converting a processed electric output signal to an output sound and defining an output side;

a forward path being defined between the input transducer and the output transducer, and comprising a signal processing unit (SPU) configured to process an SPU-input signal originating from the electric input signal and to provide a processed SPU-output signal;

an electric feedback loop from the output side to the input side, including a feedback path estimation unit for estimating an acoustic feedback transfer function from the output transducer to the input transducer, and an enhancement unit for extracting characteristics of an electric signal of the forward path and providing an estimated characteristics output; and a probe signal generator for generating a probe signal contributing to the estimation of the feedback transfer function, wherein the feedback path estimation unit is configured to use the estimated characteristics output in the estimation of the acoustic feedback transfer function, wherein the algorithm part of the feedback path estimation unit comprises a step length control block for controlling the step length of the algorithm in a given frequency region, and the step length control block receives a control input from the probe signal generator.

12. An audio processing system for processing an input sound to an output sound, the audio processing system comprising:

an input transducer for converting an input sound to an electric input signal and defining an input side;

an output transducer for converting a processed electric output signal to an output sound and defining an output side;

a forward path being defined between the input transducer and the output transducer, and comprising a signal processing unit (SPU) configured to process an SPU-input signal originating from the electric input signal and to provide a processed SPU-output signal;

an electric feedback loop from the output side to the input side, including a feedback path estimation unit for estimating an acoustic feedback transfer function from the output transducer to the input transducer, and an enhancement unit for extracting characteristics of an electric signal of the forward path and providing an estimated characteristics output; and a probe signal generator for generating a probe signal contributing to the estimation of the feedback transfer function, wherein the feedback path estimation unit is configured to use the estimated characteristics output in the estimation of the acoustic feedback transfer function, wherein the probe signal generator is configured to provide a probe signal based on masked added noise, the probe signal generator comprises an adaptive filter for filtering a white noise input sequence w, the output of the variable part M of the adaptive filter forming the masked probe signal, and the variable part M of the adaptive filter being updated based on a signal from the forward path by an algorithm part comprising a model of the human auditory system.

13. An audio processing system for processing an input sound to an output sound, the audio processing system comprising:

an input transducer for converting an input sound to an electric input signal and defining an input side;

an output transducer for converting a processed electric output signal to an output sound and defining an output side;

a forward path being defined between the input transducer and the output transducer, and comprising a signal processing unit (SPU) configured to process an SPU-input signal originating from the electric input signal and to provide a processed SPU-output signal;

an electric feedback loop from the output side to the input side, including a feedback path estimation unit for estimating an acoustic feedback transfer function from the output transducer to the input transducer, and an enhancement unit for extracting characteristics of an electric signal of the forward path and providing an estimated characteristics output; and a probe signal generator for generating a probe signal contributing to the estimation of the feedback transfer function, wherein the feedback path estimation unit is configured to use the estimated characteristics output in the estimation of the acoustic feedback transfer function, wherein the enhancement unit is configured to base the noise signal estimate output on an adaptive filter configured for filtering a feedback corrected input signal on the input side of the forward path to provide a noise signal estimate output comprising noise-like signal components said feedback corrected input signal.

14. An audio processing system according to claim 13 wherein the adaptive filter is a linear, finite impulse response (FIR) type filter with a time varying long-term prediction, LTP, filter characteristic of the specific form $$\begin{aligned} D(z,n) &= 1 - DE(z) \times LE(z,n) \\ &= 1 - z^{-N_2} \times \sum_{p=0}^{P_2} d_{p+N_2} z^{-p} \\ &= 1 - \sum_{p=N_2}^{N_2+P_2} d_p z^{-p} \end{aligned}$$

where D(z,n) represents the resulting filter, $DE(z)=z^{-N2}$ represents a delay corresponding to $N_2$ samples, LE(z,n)

represents the variable filter part, $N_2$ is the maximum correlation time, $d_p$ are the filter coefficients adapted to minimize a statistical deviation measure of es(n), and $P_2$ is the order of the filter LE(z,n), and where es(n) is the output signal of the filter D(z,n), and $$es(n) = e(n) - \sum_{l=0}^{P2} d_l e(n - N2 - l) = e(n) - z(n),$$

and e(n) is a feedback-corrected input signal on the input side at time instant n.

15. An audio processing system for processing an input sound to an output sound, the audio processing system comprising:

an input transducer for converting an input sound to an electric input signal and defining an input side;

an output transducer for converting a processed electric output signal to an output sound and defining an output side;

a forward path being defined between the input transducer and the output transducer, and comprising a signal processing unit (SPU) configured to process an SPU-input signal originating from the electric input signal and to provide a processed SPU-output signal;

an electric feedback loop from the output side to the input side, including a feedback path estimation unit for estimating an acoustic feedback transfer function from the output transducer to the input transducer, and an enhancement unit for extracting characteristics of an electric signal of the forward path and providing an estimated characteristics output; and a probe signal generator for generating a probe signal contributing to the estimation of the feedback transfer function, wherein the feedback path estimation unit is configured to use the estimated characteristics output in the estimation of the acoustic feedback transfer function, the enhancement unit is adapted to provide a noise signal estimate output based on binaural prediction filtering, an adaptive noise retrieval filter E is adapted for filtering a signal $y_c$ from another microphone, and the adaptive noise retrieval filter E has a time varying filter characteristic described by the difference equation $$e_s(n) = e(n - N_3) - \sum_{p=0}^{P_3} e_p y_c(n - p),$$

where $y_c(n)$ represents samples from the other microphone, and $$LB(z, n) = \sum_{p=0}^{P_3} e_p z^{-p}$$

represents the variable filter part, where $e_p$ are the filter coefficients adapted to minimize a statistical deviation measure of es(n) and where, $N_3$ is a delay in samples and $P_3$ is the order of the filter LB(z,n).

16. An audio processing system according to claim 15, wherein the other microphone is a microphone of a contra-lateral listening device, or an external sensor.

17. An audio processing system according to claim 15, wherein the other microphone is a microphone of a communication device or of an audio selection device.

18. An audio processing system for processing an input sound to an output sound, the audio processing system comprising:

an input transducer for converting an input sound to an electric input signal and defining an input side;

an output transducer for converting a processed electric output signal to an output sound and defining an output side;

a forward path being defined between the input transducer and the output transducer, and comprising a signal processing unit (SPU) configured to process an SPU-input signal originating from the electric input signal and to provide a processed SPU-output signal;

an electric feedback loop from the output side to the input side, including a feedback path estimation unit for estimating an acoustic feedback transfer function from the output transducer to the input transducer, and an enhancement unit for extracting characteristics of an electric signal of the forward path and providing an estimated characteristics output;

a probe signal generator for generating a probe signal contributing to the estimation of the feedback transfer function; and a master enhancement unit on the input side and a slave enhancement unit on the output side, each enhancement unit being electrically connected to the feedback estimation unit, wherein the slave enhancement unit is adapted to provide the same transfer function as the master enhancement unit, and the feedback path estimation unit is configured to use the estimated characteristics output in the estimation of the acoustic feedback transfer function.

19. A method of estimating a feedback transfer function in an audio processing system including a feedback estimation system for estimating acoustic feedback, a forward path between an input transducer and an output transducer, and a signal processing unit (SPU) adapted for processing an SPU-input signal originating from the electric input signal and to provide a processed SPU-output signal, and an electric feedback loop from the output side to the input side including a feedback path estimation unit for estimating the feedback transfer function from the output transducer to the input transducer, the method comprising:

extracting characteristics of the electric signal of the forward path, said characteristics including at least one of a modulation index, periodicity, correlation time, and noise-like parts of said electric signal;

providing an estimated characteristics output; and adapting the feedback path estimation unit based on the estimated characteristics output in the estimation of the feedback transfer function.

20. A tangible non-transitory computer-readable medium storing instructions, wherein the instructions when executed on a data processor of an audio processing system including a feedback estimation system for estimating acoustic feedback, a forward path between an input transducer and an output transducer, and a signal processing unit (SPU) adapted for processing an SPU-input signal originating from the electric input signal and to provide a processed SPU-output signal, and an electric feedback loop from the output side to the input side including a feedback path estimation unit for estimating the feedback transfer function from the output transducer to the input transducer, cause the audio processing system to perform a method comprising:

extracting characteristics of the electric signal of the forward path, said characteristics including at least one of a modulation index, periodicity, correlation time, and noise-like parts of said electric signal;

providing an estimated characteristics output; and adapting the feedback path estimation unit based on the estimated characteristics output in the estimation of the feedback transfer function.

* * * * *